US008927183B2

(12) United States Patent
Kawasaki et al.

(10) Patent No.: US 8,927,183 B2
(45) Date of Patent: Jan. 6, 2015

(54) ELECTROPHOTOGRAPHIC PHOTORECEPTOR, METHOD FOR PREPARING THE ELECTROPHOTOGRAPHIC PHOTORECEPTOR, AND IMAGE FORMING METHOD AND APPARATUS AND PROCESS CARTRIDGE USING THE ELECTROPHOTOGRAPHIC PHOTORECEPTOR

(75) Inventors: Yoshiaki Kawasaki, Susono (JP); Akihiro Sugino, Numazu (JP); Mitsuaki Hirose, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1928 days.

(21) Appl. No.: 12/128,061

(22) Filed: May 28, 2008

(65) Prior Publication Data

US 2008/0318142 A1 Dec. 25, 2008

(30) Foreign Application Priority Data

Jun. 19, 2007 (JP) ..... 2007-161275
Mar. 18, 2008 (JP) ..... 2008-070084

(51) Int. Cl.

| | |
|---|---|
| ***G03G 13/14*** | (2006.01) |
| ***G03G 5/147*** | (2006.01) |
| ***G03G 5/05*** | (2006.01) |
| ***G03G 15/00*** | (2006.01) |

(52) U.S. Cl.

CPC ..... *G03G 5/1476* (2013.01); *G03G 5/0567* (2013.01); *G03G 5/0575* (2013.01); *G03G 5/0592* (2013.01); *G03G 5/14769* (2013.01); *G03G 5/14791* (2013.01); *G03G 15/751* (2013.01); *G03G 2215/00957* (2013.01)

USPC ..... 430/48; 430/58.65; 430/132; 430/159

(58) Field of Classification Search

USPC ..... 430/56, 58.65, 66, 58.75, 58.8

See application file for complete search history.

(56) References Cited

U.S. PATENT DOCUMENTS

| | | | |
|---|---|---|---|
| 4,818,650 | A | 4/1989 | Limburg et al. |
| 4,956,440 | A | 9/1990 | Limburg et al. |

(Continued)

FOREIGN PATENT DOCUMENTS

| | | |
|---|---|---|
| JP | 56-48637 | 5/1981 |
| JP | 4-281461 | 10/1992 |

(Continued)

OTHER PUBLICATIONS

May 31, 2012 communication from the Japanese Patent Office in connection with a corresponding patent application.

*Primary Examiner* — Mark F Huff
*Assistant Examiner* — Rashid Alam
(74) *Attorney, Agent, or Firm* — Cooper & Dunham LLP

(57) ABSTRACT

A photoreceptor including an electroconductive substrate; a photosensitive layer, which is located overlying the electroconductive substrate and which includes a charge generation material, a charge transport material having no radical polymerizability, a binder resin having no radical polymerizability, and a crosslinked polymer including a unit obtained from a first radically polymerizable monomer having three or more functional groups and no charge transport structure and a unit obtained from a second radically polymerizable monomer having a charge transport structure; and an outermost layer, which is located on the photosensitive layer and which includes a crosslinked polymer including a unit obtained from a third radically polymerizable monomer having three or more functional groups and no charge transport structure and a unit obtained from a fourth radically polymerizable monomer having a charge transport structure. An image forming method and apparatus, and a process cartridge using the photoreceptor.

16 Claims, 3 Drawing Sheets

(56) References Cited

U.S. PATENT DOCUMENTS

| | | | | |
|---|---|---|---|---|
| 5,411,827 | A | 5/1995 | Tamura et al. | |
| 5,496,671 | A | 3/1996 | Tamura et al. | |
| 6,010,810 | A * | 1/2000 | Uesaka et al. | 430/58.8 |
| 6,180,303 | B1 | 1/2001 | Uematsu et al. | |
| 6,824,939 | B2 | 11/2004 | Kurimoto et al. | |
| 7,175,957 | B2 | 2/2007 | Suzuki et al. | |
| 7,179,573 | B2 | 2/2007 | Suzuki et al. | |
| 7,212,777 | B2 | 5/2007 | Takada et al. | |
| 7,267,916 | B2 | 9/2007 | Sugino et al. | |
| 7,314,693 | B2 | 1/2008 | Ikegami et al. | |
| 7,361,438 | B2 | 4/2008 | Suzuki et al. | |
| 2005/0158641 | A1 | 7/2005 | Yanagawa et al. | |
| 2005/0266325 | A1 | 12/2005 | Yanagawa et al. | |
| 2005/0287452 | A1 | 12/2005 | Tamura et al. | |
| 2006/0057479 | A1 * | 3/2006 | Niimi et al. | 430/59.4 |
| 2006/0078809 | A1 * | 4/2006 | Nagai et al. | 430/59.6 |
| 2006/0105255 | A1 * | 5/2006 | Toda et al. | 430/59.5 |
| 2006/0110668 | A1 * | 5/2006 | Kawasaki et al. | 430/58.7 |
| 2006/0141378 | A1 | 6/2006 | Takada et al. | |
| 2006/0199092 | A1 | 9/2006 | Sugino et al. | |
| 2006/0240346 | A1 * | 10/2006 | Toda et al. | 430/64 |
| 2007/0009818 | A1 | 1/2007 | Yanagawa et al. | |
| 2007/0015074 | A1 | 1/2007 | Sugino et al. | |
| 2007/0031746 | A1 * | 2/2007 | Toshine et al. | 430/58.7 |
| 2007/0082282 | A1 * | 4/2007 | Mishra et al. | 430/58.05 |
| 2007/0117033 | A1 | 5/2007 | Sugino et al. | |
| 2007/0122724 | A1 * | 5/2007 | Suzuki et al. | 430/58.7 |
| 2007/0196749 | A1 * | 8/2007 | Inaba et al. | 430/58.2 |
| 2007/0212627 | A1 | 9/2007 | Yanagawa et al. | |
| 2007/0254224 | A1 | 11/2007 | Sugino | |
| 2007/0287083 | A1 | 12/2007 | Gondoh et al. | |
| 2007/0297836 | A1 | 12/2007 | Kawasaki et al. | |
| 2008/0038649 | A1 | 2/2008 | Hirose et al. | |
| 2008/0113285 | A1 | 5/2008 | Nakamori et al. | |

FOREIGN PATENT DOCUMENTS

| | | |
|---|---|---|
| JP | 8-262779 | 10/1996 |
| JP | 11-212291 | 8/1999 |
| JP | 2005-173334 | 6/2005 |
| JP | 2006-227567 | 8/2006 |
| JP | 2007-17633 | 1/2007 |
| JP | 2007-17672 | 1/2007 |
| JP | 2007-72141 | 3/2007 |
| JP | 2008-225043 | 9/2008 |

* cited by examiner

ELECTROPHOTOGRAPHIC PHOTORECEPTOR, METHOD FOR PREPARING THE ELECTROPHOTOGRAPHIC PHOTORECEPTOR, AND IMAGE FORMING METHOD AND APPARATUS AND PROCESS CARTRIDGE USING THE ELECTROPHOTOGRAPHIC PHOTORECEPTOR

BACKGROUND

1. Technical Field

This disclosure relates to an electrophotographic photoreceptor (hereinafter referred to as a photoreceptor). In addition, the present invention also relates to a method for preparing the electrophotographic photoreceptor, and an image forming method, an image forming apparatus and a process cartridge using the electrophotographic photoreceptor.

2. Discussion of the Background

Recently, organic photoreceptors (OPCs) have been used for various image forming apparatuses such as copiers, printers, facsimiles and multi-functional apparatuses instead of inorganic photoreceptors because of having the following advantages over inorganic photoreceptors:

(1) good optical properties such that the photoreceptors have photosensitivity over a broad wavelength range and can absorb a large amount of light;
(2) good electric properties such as high photosensitivity and stable charging property;
(3) wide material selectivity (i.e., various kinds of materials can be used for the photosensitive layer);
(4) good productivity;
(5) low costs; and
(6) little toxicity.

On the other hand, recently, image forming apparatuses are required to have a small size and to produce images at a high speed without frequently performing a maintenance operation, and therefore a need exists for a small-size photoreceptor having a good durability. In general, organic photoreceptors are soft because of having an outermost layer including a low molecular weight charge transport material and an inactive polymer. Therefore, when image forming operations such as charging, developing, transferring and cleaning operations are repeatedly performed on such organic photoreceptors, the surface of the photoreceptors is easily abraded due to the mechanical stresses applied thereto.

In addition, in order to produce high quality images, the particle size of the toners used for forming visual images in image forming apparatus becomes smaller and smaller. In order to well remove residual toner particles on the surface of the photoreceptors used for the image forming apparatuses, a cleaning blade having a high hardness is contacted with the surface of the photoreceptors at a high pressure. Thereby, abrasion of the surface of the photoreceptors is accelerated.

Abrasion of the surface of a photoreceptor deteriorates the photosensitivity and charging properties of the photoreceptor, resulting in decrease of image density and formation of abnormal images such as background development in that background of images is soiled with toner particles. If local abrasion (such as formation of scratches) is caused to the surface of a photoreceptor, the photoreceptor produces streak images due to defective cleaning.

When the surface of a photoreceptor is abraded and/or local abrasion (scratches) is caused to the surface, the photoreceptor has to be undesirably replaced with a new photoreceptor, resulting in shortening of the life of the photoreceptor. Thus, the abrasion problem is a big problem to be solved.

Therefore various attempts have been made to solve the abrasion problem of organic photoreceptors.

In attempting to improve the abrasion resistance of photoreceptors, the following techniques have been proposed.

(1) A crosslinked binder resin is used for the outermost layer of a photoreceptor (published unexamined Japanese patent application No. (hereinafter referred to as JP-A) 56-48637);
(2) A charge transport polymer is used for the photosensitive layer of a photoreceptor (JP-A64-1728); and
(3) An inorganic filler is dispersed in the outermost layer of a photoreceptor (JP-A 04-281461).

The photoreceptor (1) using a crosslinked binder resin for the outermost layer thereof has a drawback in that the residual potential (i.e., the potential of a light-irradiated portion of the photosensitive layer) is high due to poor compatibility of the crosslinked binder resin with charge transport materials, and impurities (such as polymerization initiators, and unreacted materials and groups) included therein, and thereby low density images are produced.

The photoreceptors (2) and (3) have a relatively improved abrasion resistance. However, the abrasion resistance thereof is not so satisfactory as to satisfy the recently required durability. In addition, the photoreceptor (3) tends to have a relatively high residual potential due to carrier traps (in general, positive hole traps are formed in OPCs) present on the surface of the inorganic filler, thereby easily causing a problem in that low density images are produced.

Thus, the photoreceptors (1), (2) and (3) do not have the recently required durability (i.e., good combination of electric durability and mechanical durability).

In attempting to improve the abrasion resistance and scratch resistance of the photoreceptor (1), Japanese patent No. 3,262,488 (i.e., JP-A 08-262779) discloses a photoreceptor having a protective layer prepared using a multifunctional crosslinking acrylate monomer. Although it is described therein that a charge transport material can be included in the protective layer, there is no detailed description of the charge transport material. As a result of the present inventors' study, it is found that when a low molecular weight charge transport material is included in the protective layer, the photoreceptor causes a problem in that such a low molecular weight charge transport material has poor compatibility with a crosslinked acrylate, thereby causing problems in that the charge transport material is separated from the crosslinked acrylate while precipitated, resulting in occurrence of a blushing phenomenon, and the strength of the protective layer deteriorates.

In addition, the photoreceptor is prepared by reacting monomers while a binder resin is included in the reaction system. Therefore, problems in that the crosslinking reaction does not sufficiently proceed and the crosslinked material has poor compatibility with the binder resin occur. In this case, a phase separation phenomenon is caused in the crosslinking reaction, resulting in roughening of the surface of the resultant photoreceptor, thereby causing a defective cleaning problem.

Japanese patent No. 3,194,392 (i.e., JP-A 05-216249) proposes another technique for improving abrasion resistance of a photosensitive layer such that a charge transport layer is formed using a coating liquid including a combination of a monomer having a carbon-carbon double bond (C=C), a binder resin, and a charge transport material having a carbon-carbon double bond, which is to be reacted with the monomer. In this regard, the binder resin may have a carbon-carbon double bond to be reacted with the charge transport material.

The photoreceptor has a good combination of abrasion resistance and electric properties. However, according to our study, the photoreceptor has a drawback in that when a binder resin having no reactivity is used, the binder resin has poor compatibility with the crosslinked material formed by the reaction of the monomer with the charge transport material, thereby causing a phase separation phenomenon in the crosslinking reaction, resulting in roughening of the surface of the resultant photoreceptor. Therefore, the photoreceptor causes a defective cleaning problem. In addition, the binder resin retards the crosslinking reaction of the monomers.

Further, the monomers described therein are di-functional, and therefore the crosslinking density is relatively low. Therefore, the abrasion resistance of the photoreceptor is not so satisfactory as to satisfy the recently required durability. The same is true for the case where a reactive binder resin having a carbon-carbon double bond is used. Specifically, in this case, it is impossible to increase the amount of the charge transport material while increasing the crosslinking density because the numbers of the functional groups included in the monomers and binder resins are small. Therefore, the resultant photoreceptor cannot have a good combination of electric properties and abrasion resistance.

JP-A 2000-66425 proposes a photoreceptor having a photosensitive layer including a compound prepared by crosslinking a positive hole charge transport material having two or more chain-polymerizable functional groups in a molecule. However, the crosslinked positive hole charge transport material is bulky because of having two or more chain-polymerizable functional groups and therefore the photosensitive layer tends to be strained, resulting in increase of internal stress. Therefore, the photoreceptor tends to cause problems in that the surface of the photosensitive layer is roughened and/or cracks are formed in the photosensitive layer. Namely, the photoreceptor has unsatisfactory durability.

Other crosslinked outermost layers prepared by crosslinking a radically polymerizable monomer, which has three or more functional groups and no charge transport structure, and a radically polymerizable monofunctional monomer, which has a charge transport structure, have been proposed in JP-As 2004-302450, 2004-302451, and 2004-302452. The outermost layers have good abrasion resistance, but the abrasion resistance is not so satisfactory as to satisfy the recently required excellent and long-term durability. Particularly, the adhesion between the outermost layers and the photosensitive layers deteriorates due to the internal force caused by crosslinking of the outermost layers. Therefore, when a mechanical force is applied thereto for a long period of time, a problem in that the outermost layers are peeled from the photosensitive layers tends to be caused.

Because of these reasons, a need exists for a photoreceptor which can maintain a good combination of electric properties and abrasion resistance and which can produce high quality images over a long period of time.

SUMMARY

In an aspect of this disclosure, a photoreceptor is provided which includes:

an electroconductive substrate;

a photosensitive layer, which is located overlying the electroconductive substrate and which includes at least a charge generation material, a charge transport material having no radical polymerizability, a binder resin having no radical polymerizability, and a reaction product (i.e., a crosslinked polymer) including a unit obtained from a first radically polymerizable monomer having three or more functional groups and no charge transport structure and a unit obtained from a second radically polymerizable monomer having a charge transport structure; and an outermost layer, which is located on the photosensitive layer and which includes a crosslinked polymer (such as photo-crosslinked polymers) including a unit obtained from a third radically polymerizable monomer having three or more functional groups and no charge transport structure and a unit obtained from a fourth radically polymerizable monomer having a charge transport structure.

In this regard, the first monomer may be the same as or different from the third monomer, and the second monomer may be the same as or different from the fourth monomer. It is preferable that the first and second monomers are reacted with the third and forth monomers.

In another aspect, a method for forming a photoreceptor is provided, which includes:

applying a photosensitive layer coating liquid, which includes a charge generation material, a charge transport material having no radical polymerizability, a binder resin having no radical polymerizability, a first radically polymerizable monomer having three or more functional groups and no charge transport structure and a second radically polymerizable monomer having a charge transport structure, on the surface of an electroconductive substrate with or without a layer therebetween;

applying an outermost layer coating liquid, which includes a third radically polymerizable monomer having three or more functional groups and no charge transport structure, a fourth radically polymerizable monomer having a charge transport structure, and a solvent, on the surface of the photosensitive layer; and irradiating the outermost layer with light to crosslink the outermost layer and the photosensitive layer.

It is preferable that the photosensitive layer coating liquid applying step includes applying a charge generation layer coating liquid including a charge generation material to form a charge generation layer, and applying a charge transport layer coating liquid including a charge transport material, a binder resin, and first and second radically polymerizable monomers to form a charge transport layer thereon.

In yet another aspect, an image forming method is provided, which includes:

charging the photoreceptor mentioned above;

irradiating the charged photoreceptor with imagewise light to form an electrostatic latent image on the photoreceptor;

developing the electrostatic latent image with a developer including a toner to form a toner image on the photoreceptor; and transferring the toner image onto a receiving material.

In a further aspect, an image forming apparatus is provided, which includes:

the photoreceptor mentioned above;

a charging device configured to charge the photoreceptor;

a light irradiating device configured to irradiate the charged photoreceptor with imagewise light to form an electrostatic latent image on the photoreceptor;

a developing device configured to develop the electrostatic latent image with a developer including a toner to form a toner image on the photoreceptor; and a transferring device configured to transfer the toner image onto a receiving material.

In a still further aspect, a process cartridge is provided, which includes:

the photoreceptor mentioned above; and at least one of a charging device, a developing device, a transferring device, a cleaning device configured to clean the surface of the photoreceptor, and a discharging device configured to reduce charges remaining on the surface of the photoreceptor after the image transferring process.

The aforementioned and other aspects, features and advantages will become apparent upon consideration of the following description of preferred embodiments taken in conjunction with the accompanying drawings.

DESCRIPTION OF THE PREFERRED EMBODIMENTS

Figure 1:
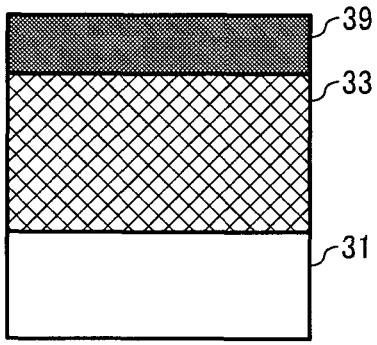
FIG. 1 is a schematic diagram illustrating the sectional view of a photoreceptor of an embodiment of the present invention.

At first, the photoreceptor of the present invention will be explained.

The photoreceptor of the present invention includes an electroconductive substrate; a photosensitive layer, which is located overlying the electroconductive substrate and which includes a charge generation material, a charge transport material having no radical polymerizability, a binder resin having no radical polymerizability, and a reaction product (a crosslinked polymer) including a unit obtained from a first radically polymerizable tri- or more-functional monomer (A) having no charge transport structure and a unit obtained from a second radically polymerizable monomer (B) having a charge transport structure; and an outermost layer, which is located on the photosensitive layer and which includes a crosslinked polymer (such as photo-crosslinked polymers) including a unit obtained from a third radically polymerizable monomer (A') having three or more functional groups and no charge transport structure, which is the same as or different from the first monomer (A), and a unit obtained from a fourth radically polymerizable monomer (B') having a charge transport structure, which is the same as or different from the second monomer (B). In this photoreceptor, not only the outer portion of the outermost layer but also the inner portion thereof have a good combination of abrasion resistance and scratch resistance, and therefore the resultant photoreceptor has good cleanability and can produce high quality images over a long period of time.

In this regard, "overlying" can include direct contact and allow for an intermediate layer or layers.

The reason why the photoreceptor has such good properties is considered as follows.

The outermost layer of the photoreceptor of the present invention is prepared using a radically polymerizable tri- or more-functional monomer (A') having no charge transport structure. Therefore, the resultant outermost layer has a well-developed three dimensional network, and a high crosslinking density. Namely, the outermost layer has high hardness and high abrasion resistance. In addition, since the outermost layer includes a unit obtained from a radically polymerizable monomer (B') having a charge transport structure, the outermost layer has high charge transportability as well as high abrasion resistance.

When such an outermost layer is formed on a photosensitive layer, a large internal stress is caused when the outermost layer is crosslinked, thereby causing a peeling problem in that the outermost layer is peeled from the photosensitive layer if a large mechanical force is applied to the outermost layer.

Since a radically polymerizable tri- or more-functional monomer (A) having no charge transport structure and a radically polymerizable monomer (B) having a charge transport structure are included in the photosensitive layer and the layer is exposed to light (such as UV light) after the outermost layer is applied thereon, not only the monomers (A) and (B) are reacted with each other but also some of the molecules of the monomers (A) and (B) are reacted (crosslinked) with molecules of the third radically polymerizable tri- or more-functional monomer (A') having no charge transport structure and the fourth radically polymerizable monomer (B') having a charge transport structure included in the outermost layer. As a result, the adhesion between the outermost layer and the photosensitive layer is dramatically improved, and thereby occurrence of the peeling problem is prevented while imparting good abrasion resistance to the photoreceptor.

Next, the outermost layer coating liquid will be explained.

The radically polymerizable tri- or more-functional monomers (A') are defined as monomers, which have three or more radically polymerizable groups and which do not have a charge transport structure such as positive hole transport structures (e.g., triarylamine, hydrazone, pyrazoline and carbazole structures), and electron transport structures (e.g., condensed polycyclic quinine structures, diphenoquinone structures, and electron accepting aromatic ring structures having a cyano group or a nitro group). As for the radically polymerizable groups, any radically polymerizable groups having a carbon-carbon double bond can be used. Suitable radically polymerizable groups include 1-substituted ethylene groups and 1,1-substituted ethylene groups, which are mentioned below.

(1) Suitable 1-substituted ethylene groups include functional groups having the following formula:

$$CH_2{=}CH{-}X^2{-}$$

wherein $X^2$ represents an arylene group (such as a phenylene group and a naphthylene group), which optionally has a substituent, a substituted or unsubstituted alkenylene group, a —CO— group, a —COO— group, a —CON($R^{10}$)— group ($R^{10}$ represents a hydrogen atom, an alkyl group (e.g., a methyl group, and an ethyl group), an aralkyl group (e.g., a benzyl group, a naphthylmethyl group and a phenetyl group), or an aryl group (e.g., a phenyl group and a naphthyl group)) or a —S— group.

Specific examples of such 1-substituted ethylene groups include a vinyl group, a stylyl group, a 2-methyl-1,3-butadienyl group, a vinylcarbonyl group, an acryloyloxy group, an acryloylamide group, a vinyl thio ether group, etc.

(2) Suitable 1,1-substituted ethylene groups include functional groups having the following formula:

$$CH_2{=}C(Y){-}(X^3)_j{-}$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR^{11}$ group (wherein $R^{11}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR^{12}R^{13}$ group (wherein each of $R^{12}$ and $R^{13}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups)); $X^3$ represents a group selected from the groups mentioned above for use in $X^2$, and an alkylene group, wherein at least one of Y and $X^3$ is an oxycarbonyl group, a cyano group, an alkenylene group or an aromatic group; and j is 0 or 1.

Specific examples of the 1,1-substituted ethylene groups include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X^2$, $X^3$ and Y include halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

Among these radically polymerizable tri- or more-functional groups, acryloyloxy groups and methacryloyloxy groups having three or more functional groups are preferably used. Compounds having three or more (meth)acryloyloxy groups can be prepared by subjecting (meth)acrylic acid (salts), (meth)acrylhalides and (meth)acrylates, which have three or more hydroxyl groups in a molecule thereof, to an ester reaction or an ester exchange reaction. The three or more radically polymerizable groups included in each of the radically polymerizable tri- or more-functional monomers (A') are the same as or different from the others.

Specific examples of the radically polymerizable tri- or more-functional monomers (A) having no charge transport function include, but are not limited thereto, trimethylolpropane triacrylate (TMPTA), trimethylolpropane trimethacylate, trimethylolpropane triacrylate modified with an alkylene group, trimethylolpropane triacrylate modified with ethylene oxide (EO), trimethylolpropane triacrylate modified with propyleneoxide (PO), trimethylolpropane triacrylate modified with caprolactone, trimethylolpropane trimethacrylate modified with an alkylene group; pentaerythritol triacrylate, pentaerythritol tetraacrylate (PETTA), glycerol triacrylate, glycerol triacrylate modified with epichlorohydrin (ECH), glycerol triacrylate modified with ethyleneoxide (EO), glycerol triacrylate modified with propyleneoxide (PO), tris(acryloxyethyl)isocyanurate, dipentaerythritol hexaacrylate (DPHA), caprolactone-modified dipentaerythritol hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerhythritol ethoxytetracrylate, ethyleneoxy-modified triacryl phosphate, 2,2,5,5-tetrahydroxymethylcyclopentanone tetraacrylate, etc. These monomers are used alone or in combination.

The content of the unit obtained from the tri- or more-functional radically polymerizable monomers (A') having no charge transport structure in the outermost layer is generally from 20 to 80% by weight, and preferably from 30 to 70% by weight based on the total weight of the crosslinked charge transport layer. When the content is less than 20% by weight, the three dimensional crosslinking density of the outermost layer decreases, and thereby dramatically improved abrasion resistance cannot be imparted to the outermost layer. In contrast, when the content is greater than 80% by weight, the content of the charge transport compound decreases, and thereby the electric properties of the layer are deteriorated. Although the targets of the electric properties and the abrasion resistance change depending on the processes for which the photoreceptor is used, the content of the unit obtained from the radically polymerizable tri- or more-functional monomers (A') in the outermost layer is preferably from 30 to 70% by weight to balance the two properties of the layer.

In any cases where a radically polymerizable monofunctional monomer or a radically polymerizable difunctional monomer, which has a charge transport structure, is used as a radically polymerizable monomer (B') in combination of a radically polymerizable tri- or more-functional monomer (A') having no charge transport structure, the preferable weight ratio (B'/A') of the radically polymerizable monomer (B') having a charge transport structure to the radically polymerizable tri- or more-functional monomer (A') having no charge transport structure is almost the same although the properties of the resultant layer slightly change.

Suitable radically polymerizable monomers (B') having a charge transport structure for use in preparing the outermost layer include compounds having at least one radically polymerizable functional group and a charge transport structure such as positive hole transport groups (e.g., triarylamine, hydrazone, pyrazoline and carbazole groups) and electron transport groups (e.g., electron accepting aromatic groups such as condensed polycyclic quinine, diphenoquinone, cyano and nitro groups). Specific examples of the radically polymerizable functional groups of the monomers (B') includes the groups mentioned above for use in the radically polymerizable tri- or more-functional monomers (A'). As the functional group of the radically polymerizable monomers, acryloyloxy and methacryloyloxy groups are preferably used.

As mentioned above, radically polymerizable monomers having one or more functional groups can be used for the radically polymerizable monomers (B') having a charge transport structure. However, in view of the layer property of the resultant layer itself and the electrostatic properties of the layer, radically polymerizable monofunctional monomers are preferably used. The reason therefor is as follows. When a di- or more-functional monomer is used as the radically polymerizable monofunctional monomer (B'), the unit obtained from the monomer is fixed to the crosslinked network with plural bonds. Since the charge transport structure is bulky, the resultant crosslinked resin has a strain, resulting in increase of the internal stress in the outermost layer. Therefore, cracks or scratches are easily formed in the layer, for example, when a particle of the carrier including in the developer is adhered thereto. When the thickness of the outermost layer is not greater than 5 μm, a serious problem (such as crack and scratch problems) does not occur. However, when the thickness is greater than 5 μm, the internal stress seriously increases in the outermost layer, and the crack problem tends to occur just after the crosslinking reaction. In addition, when a photoreceptor having such a thick outermost layer is repeatedly used for a long period of time, the peeling problem in that the outermost layer is peeled from the photosensitive layer on which the outermost layer is formed tends to easily occur.

When a radically polymerizable di- or more-functional charge transport monomer is used instead of a radically polymerizable mono-functional charge transport monomer, the charge transport group is fixed between two molecular chains of the crosslinked resin, and thereby an intermediate material (i.e., a cation radical) of the charge transport material cannot be stably maintained, resulting in deterioration of photosensitivity and increase of residual potential due to charge trapping. Therefore, the resultant images have low image density and poor reproducibility (i.e., the reproduced line or character images have a narrower width than the original images). Therefore, a radically polymerizable monofunctional monomer is preferably used as the radically polymerizable monomer (B'). In this case, the unit obtained from the monomer is fixed as a pendant of the crosslinked network, and therefore occurrence of the crack and scratch problems can be prevented while imparting good electrostatic properties to the photoreceptor.

Among the charge transport groups of the radically polymerizable monomer (B'), triarylamine groups are preferably used. Among the monomers having a triarylamine group, monomers having the following formula (1) or (2) are preferably used because of having good electric properties such as high photosensitivity and low residual potential.

Formula (1)

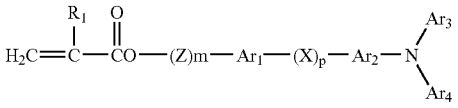

Formula (2)

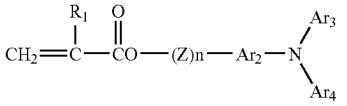

In formulae (1) and (2), $R_1$ represents a hydrogen atom, a halogen atom, a substituted or unsubstituted alkyl group, a substituted or unsubstituted aralkyl group, a substituted or unsubstituted aryl group, a cyano group, a nitro group, an alkoxy group, a —$COOR^7$ group (wherein $R^7$ represents a hydrogen atom, a substituted or unsubstituted alkyl group, a substituted or unsubstituted aralkyl group or a substituted or unsubstituted aryl group), a halogenated carbonyl group or a —$CONR^8R^9$ (wherein each of $R^8$ and $R^9$ represents a hydrogen atom, a substituted or unsubstituted alkyl group, a substituted or unsubstituted aralkyl group or a substituted or unsubstituted aryl group); each of $Ar_1$ and $Ar_2$ represents a substituted or unsubstituted arylene group; each of $Ar_3$ and $Ar_4$ represents a substituted or unsubstituted arylene group; X represents a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group, or a substituted or unsubstituted divalent alkyleneoxy carbonyl group; each of m and n is 0 or an integer of from 1 to 3; and p is 0 or 1.

In formulae (1) and (2), specific examples of the alkyl, aryl, aralkyl, and alkoxy groups for use as the substituents of $R_1$ include alkyl groups such as methyl, ethyl, propyl and butyl groups; aryl groups such as phenyl, and naphthyl groups; aralkyl groups such as benzyl, phenethyl and naphthylmethyl groups; and alkoxyl groups such as methoxy, ethoxy and propoxy groups.

These groups may be substituted with a halogen atom, a nitro group, a cyano group, an alkyl group (such as methyl and ethyl groups), an alkoxy group (such as methoxy and ethoxy groups), an aryloxy group (such as a phenoxy group), an aryl group (such as phenyl and naphthyl groups), an aralkyl group (such as benzyl and phenethyl groups), etc.

Among the groups for use as $R_1$, a hydrogen atom or a methyl group is preferable.

Suitable substituted or unsubstituted aryl group for use as $Ar_3$ and $Ar_4$ include condensed polycyclic hydrocarbon groups, non-condensed cyclic hydrocarbon groups, and heterocyclic groups.

Specific examples of the condensed polycyclic hydrocarbon groups include compounds in which 18 or less carbon atoms constitute one or more rings, such as pentanyl, indecenyl, naphthyl, azulenyl, heptalenyl, biphenilenyl, as-indacenyl, s-indacenyl, fluorenyl, acenaphthylenyl, preiadenyl, acenaphthenyl, phenarenyl, phenanthoryl, anthoryl, fluorantenyl, acephenanthorylenyl, aceanthorylenyl, triphenylenyl, pyrenyl, chrysenyl, naphthasenyl groups, etc.

Specific examples of the non-condensed cyclic hydrocarbon groups include monovalent groups of non-condensed cyclic hydrocarbons such as benzene, diphenyl ether, polyethylene diphenyl ether, diphenyl thioether, and diphenyl sulfone; monovalent groups of non-condensed polycyclic hydrocarbon groups such as biphenyl, polyphenyl, diphenyl alkans, diphenylalkenes, diphenyl alkyne, triphenyl methane, distyryl benzene, 1,1-diphenylcycloalkanes, polyphenyl alkans, polyphenyl alkenes; and monovalent groups of ring aggregation hydrocarbons such as 9,9-diphenyl fluorenone.

Specific examples of the heterocyclic groups include monovalent groups of carbazole, dibenzofuran, dibenzothiophene, oxadiazole, and thiadiazole.

The aryl groups for use as $Ar_3$ and $Ar_4$ may be substituted with the following groups.

(1) Halogen atoms, and cyano and nitro groups.

(2) Linear or branched alkyl groups which preferably have from 1 to 12 carbon atoms, more preferably from 1 to 8 carbon atoms and even more preferably from 1 to 4 carbon atoms. These alkyl groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkyl groups include methyl, ethyl, n-propyl, iso-propyl, n-butyl, sec-butyl, t-butyl, trifluoromethyl, 2-hydroxyethyl, 2-ethoxyethyl, 2-cyanoethyl, 2-methoxyethyl, benzyl, 4-chlorobenzyl, 4-methylbenzyl and 4-phenylbenzyl groups.

(3) Alkoxy groups (i.e., —$OR^2$). $R^2$ represents one of the alkyl groups defined above in paragraph (2). Specific examples of the alkoxy groups include methoxy, ethoxy, n-propoxy, iso-propoxy, t-butoxy, n-butoxy, s-butoxy, iso-butoxy, 2-hydroxyethoxy, benzyloxy and trifluoromethoxy groups.

(4) Aryloxy groups. Specific examples of the aryl group of the acryloxy groups include phenyl and naphthyl groups. The aryloxy groups may be substituted with an alkoxy group having from 1 to 4 carbon atoms, an alkyl group having from 1 to 4 carbon atoms, or a halogen atom. Specific examples of the groups include phenoxy, 1-naphthyloxy, 2-naphthyloxy, 4-methoxyphenoxy, and 4-methylphenoxy groups.

(5) Alkylmercapto or arylmercapto groups. Specific examples of the groups include methylthio, ethylthio, phenylthio, and p-methylphenylthio groups.

(6) Groups having the following formula.

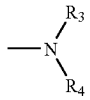

In the formula, each of $R_3$ and $R_4$ represents a hydrogen atom, one of the alkyl groups defined in paragraph (2) or an aryl group (such as phenyl, biphenyl, and naphthyl groups). These groups may be substituted with another group such as an alkoxy group having from 1 to 4 carbon atoms, an alkyl group having from 1 to 4 carbon atoms, and a halogen atom. In addition, $R_3$ and $R_4$ optionally share bond connectivity to form a ring.

Specific examples of the groups having the above-mentioned formula include amino, diethylamino, N-methyl-N-phenylamino, N,N-diphenylamino, N,N-di(tolyl)amino, dibenzylamino, piperidino, morpholino, and pyrrolidino groups.

(7) Alkylenedioxy or alkylenedithio groups such as methylenedioxy and methylenedithio groups.

(8) Substituted or unsubstituted styryl groups, substituted or unsubstituted β-phenylstyryl groups, diphenylaminophenyl groups, and ditolylaminophenyl groups.

As the arylene groups for use in $Ar_1$ and $Ar_2$, divalent groups delivered from the aryl groups mentioned above for use in $Ar_3$ and $Ar_4$ can be used.

The group X is a substituted or unsubstituted alkylene group, a substituted or unsubstituted cycloalkylene group, a substituted or unsubstituted alkylene ether, an oxygen atom, a sulfur atom, and a vinylene group.

Suitable groups for use as the substituted or unsubstituted alkylene group include linear or branched alkylene groups which preferably have from 1 to 12 carbon atoms, more preferably from 1 to 8 carbon atoms and even more preferably from 1 to 4 carbon atoms. These alkylene groups can be further substituted with another group such as a fluorine atom, a hydroxyl group, a cyano group, an alkoxy group having 1 to 4 carbon atoms, and a phenyl group, which may be further substituted with a halogen atom, an alkyl group having 1 to 4 carbon atoms, or an alkoxy group having 1 to 4 carbon atoms. Specific examples of the alkylene groups include methylene, ethylene, n-propylene, iso-propylene, n-butylene, sec-butylene, t-butylene, trifluoromethylene, 2-hydroxyethylene, 2-ethoxyethylene, 2-cyanoethylene, 2-methoxyethylene, benzylidene, phenylethylene, 4-chlorophenylethylene, 4-methylphenylethylene and 4-biphenylethylene groups.

Suitable groups for use in the substituted or unsubstituted cycloalkylene groups include cyclic alkylene groups having from 5 to 7 carbon atoms, which may be substituted with a fluorine atom or another group such as a hydroxyl group, alkyl groups having from 1 to 4 carbon atoms, and alkoxy groups having 1 to 4 carbon atoms. Specific examples of the substituted or unsubstituted cycloalkylene groups include cyclohexylidene, cyclohexylene, and 3,3-dimethylcyclohexylidene groups.

Specific examples of the substituted or unsubstituted alkylene ether groups include ethyleneoxy, propyleneoxy, ethylene glycol, propylene glycol, diethylene glycol, tetraethylene glycol, and tripropylene glycol groups. The alkylene group of the alkylene ether groups may be substituted with another group such as hydroxyl, methyl and ethyl groups.

As the vinylene group, groups having one of the following formulae can be preferably used.

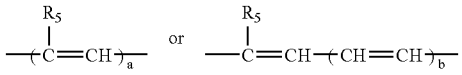

In the above-mentioned formulae, $R_5$ represents a hydrogen atom, one of the alkyl groups mentioned above for use in paragraph (2), or one of the aryl groups mentioned above for use in $Ar_3$ and $Ar_4$, wherein a is 1 or 2, and b is 1, 2 or 3.

In formulae (1) and (2), Z represents a substituted or unsubstituted alkylene group, a substituted or unsubstituted divalent alkylene ether group, or a divalent alkyleneoxycarbonyl group. Specific examples of the substituted or unsubstituted alkylene group include the alkylene groups mentioned above for use as the group X. Specific examples of the substituted or unsubstituted alkylene ether group include the divalent alkylene ether groups mentioned above for use as the group X. Specific examples of the divalent alkyleneoxycarbonyl group include divalent groups modified by caprolactone.

More preferably, monomers having the following formula (3) are used as the radically polymerizable monomer (B') having a charge transport structure.

formula (3)

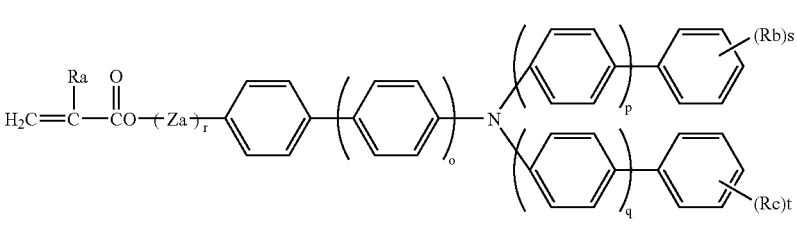

In formula (3), each of o, p and q is 0 or 1; Ra represents a hydrogen atom, or a methyl group; each of Rb and Rc represents an alkyl group having from 1 to 6 carbon atoms, wherein each of Rb and Rc can include plural groups which are the same as or different from each other; each of s and t is 0, 1, 2 or 3; r is 0 or 1; and Za represents a methylene group, an ethylene group or a group having one of the following formulae:

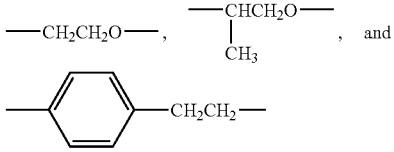

In formula (3), each of Rb and Rc is preferably a methyl group or an ethyl group.

The charge transport materials having a radically polymerizable monofunctional group having formula (1) or (2) (preferably formula (3)) (i.e., radically polymerizable monofunctional monomers (B')) have the following property. Specifically, such a monofunctional charge transport material is polymerized while the double bond of a molecule is connected with the double bonds of other molecules. Therefore, the charge transport material is incorporated in a polymer chain, i.e., in a main chain or a side chain of the crosslinked polymer chain which is formed by the charge transport material and a radically polymerizable monomer having no charge transport structure. The side chain of the unit obtained from the monofunctional charge transport material is present between two main polymer chains which are connected by crosslinked chains. In this regard, the crosslinked chains are classified into intermolecular crosslinked chains and intramolecular crosslinked chains.

In any of these case, the triarylamine group which is a pendant of the main chain of the unit obtained from the monofunctional charge transport material is bulky (because of having three aryl groups) and is connected with the main chain with a carbonyl group therebetween while not being fixed (i.e., while being fairly free three-dimensionally). Therefore, the crosslinked polymer has little strain, and in addition the crosslinked outermost layer has good charge transport property.

Specific examples of the radically polymerizable monofunctional monomers (B') having a charge transport structure are as follows, but are not limited thereto.

No. 1

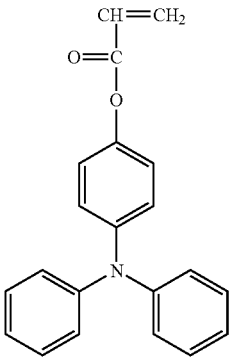

No. 2

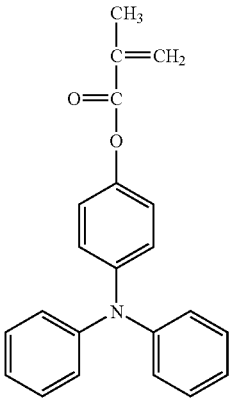

-continued

No. 3

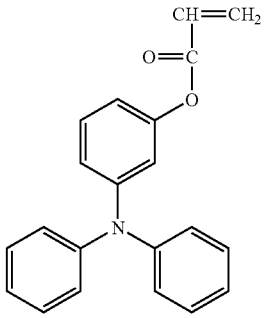

No. 4

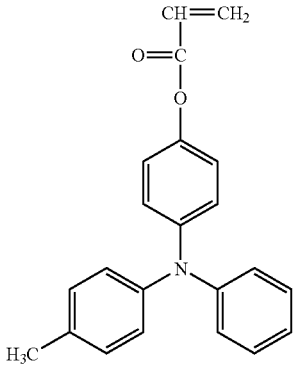

No. 5

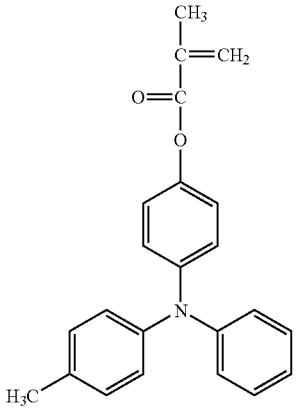

No. 6

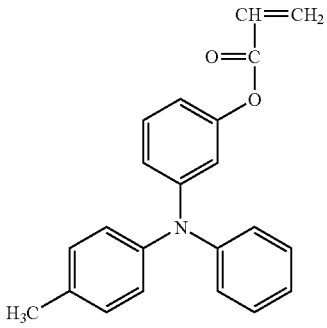

-continued
No. 7
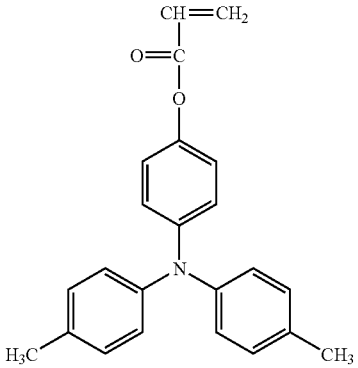
No. 8
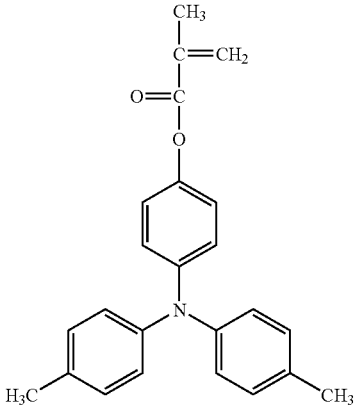
No. 9
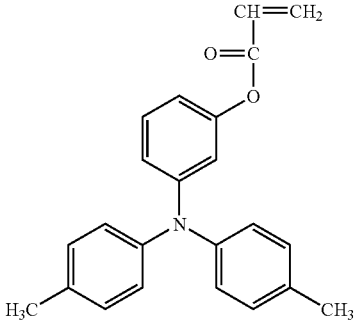
No. 10
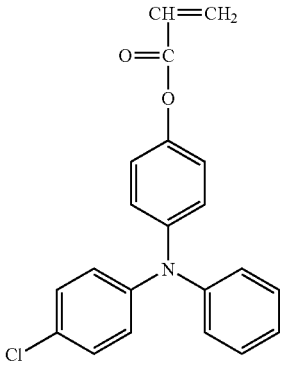
-continued
No. 11
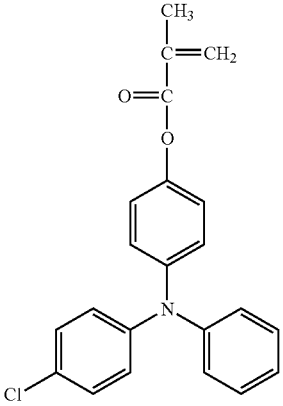
No. 12
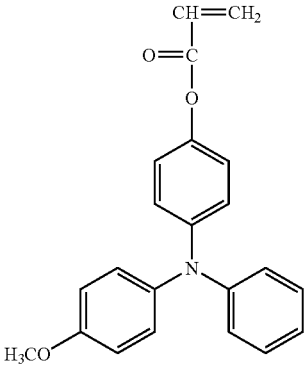
No. 13
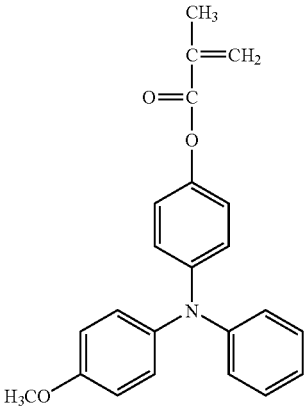
No. 14
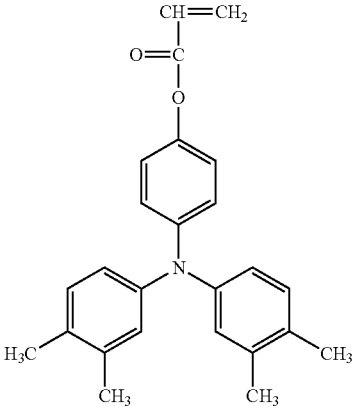

-continued
No. 15
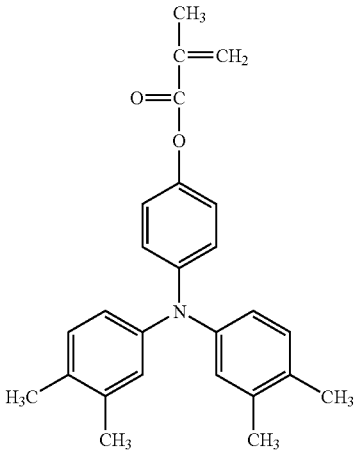
No. 16
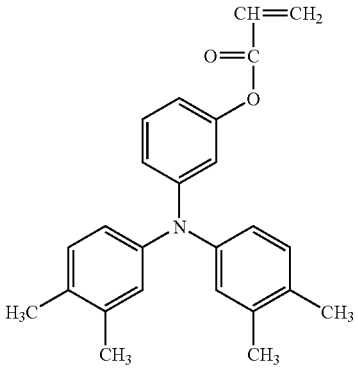
No. 17
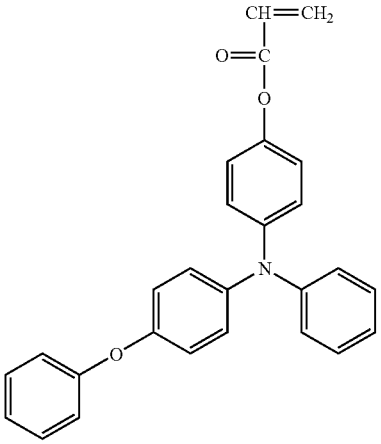
-continued
No. 18
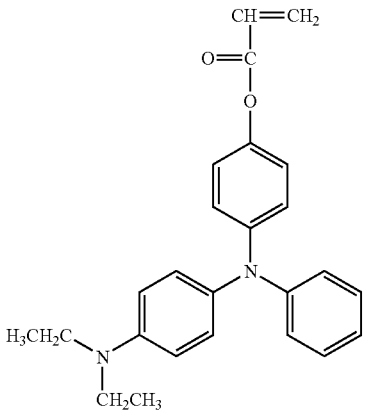
No. 19
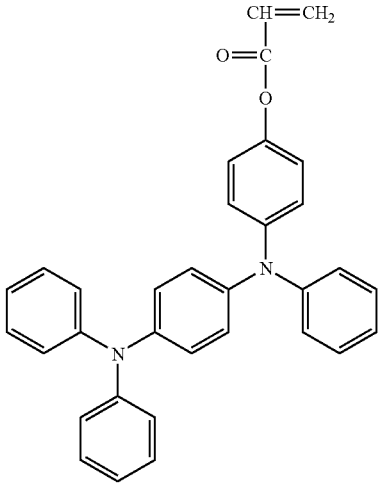
No. 20
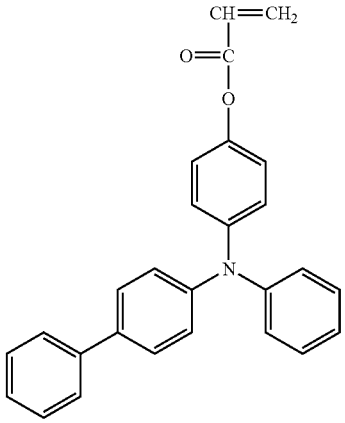

-continued
No. 21
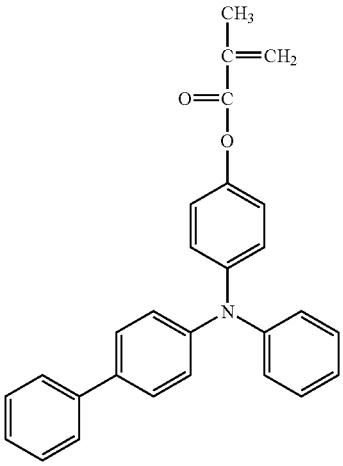
No. 22
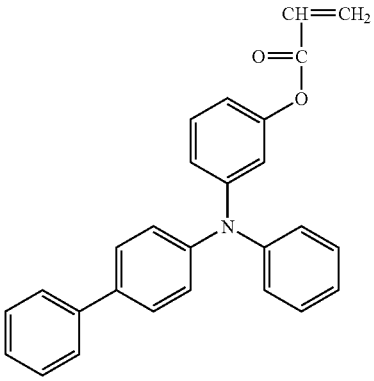
No. 23
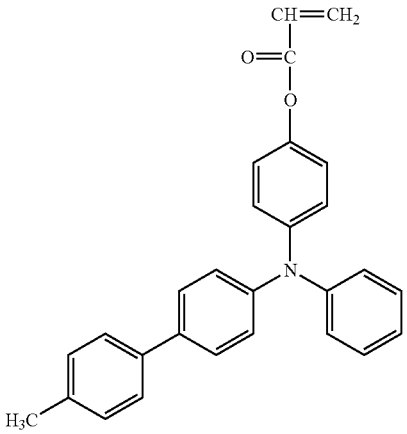
-continued
No. 24
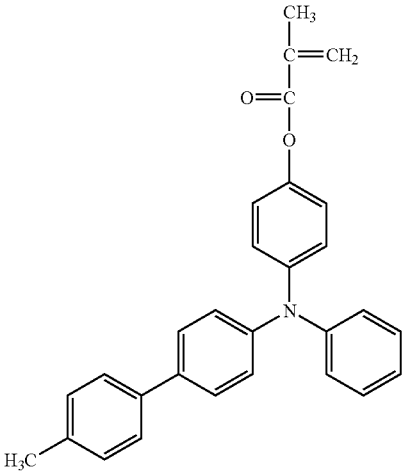
No. 25
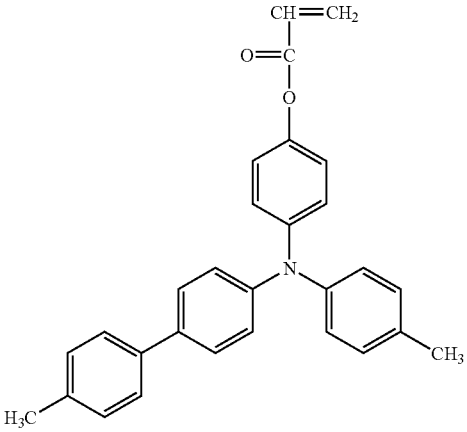
No. 26
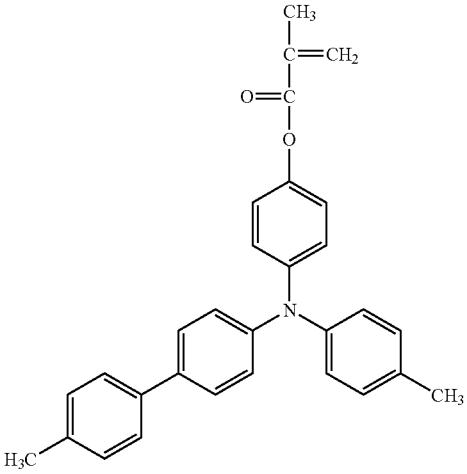

-continued
No. 27
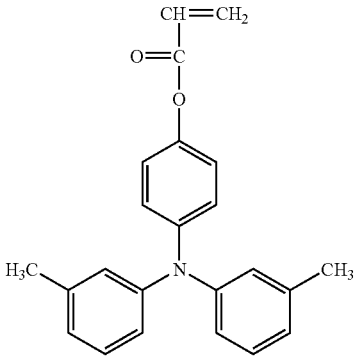
No. 28
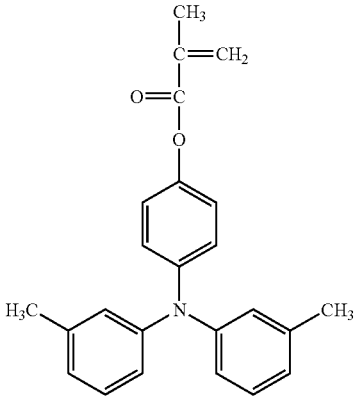
No. 29
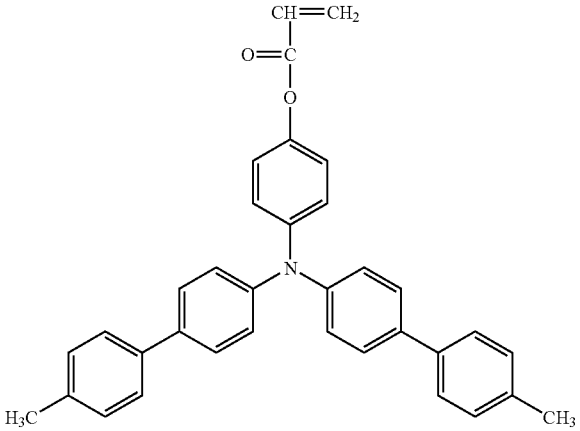
No. 30
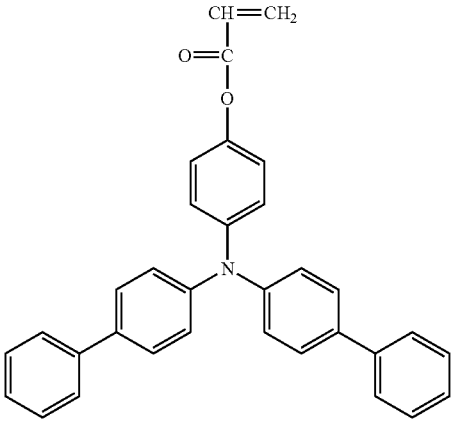
-continued
No. 31
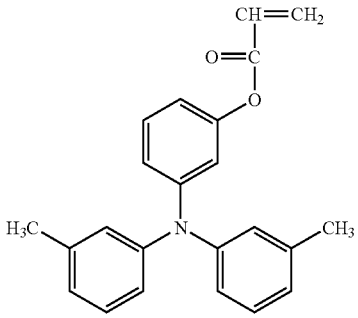
No. 32
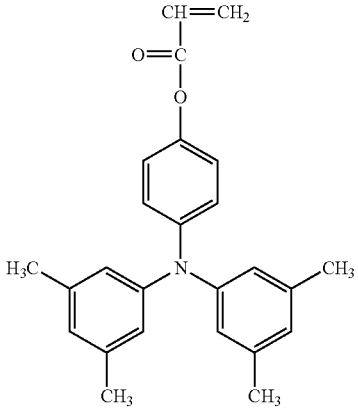
No. 33
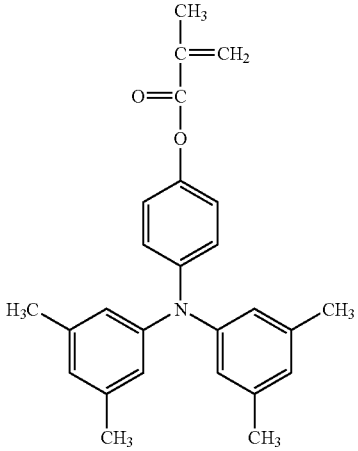
No. 34
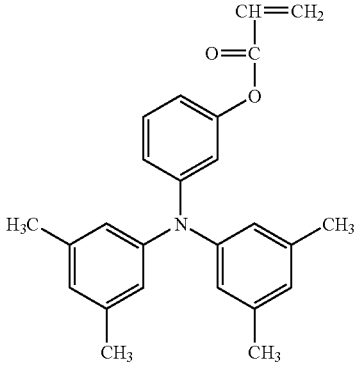

-continued
No. 35
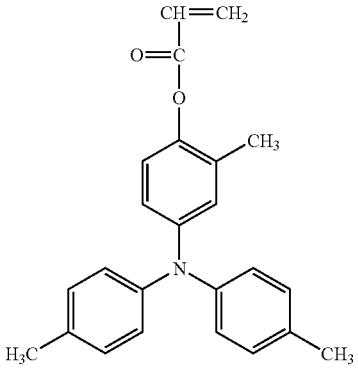
No. 36
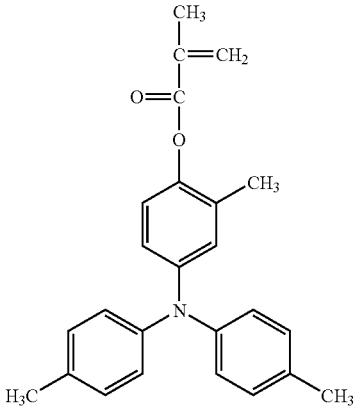
No. 37
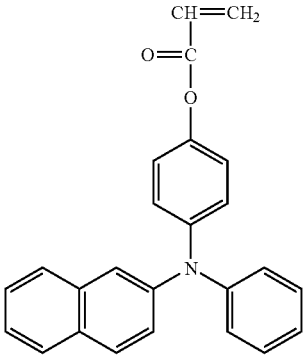
No. 38
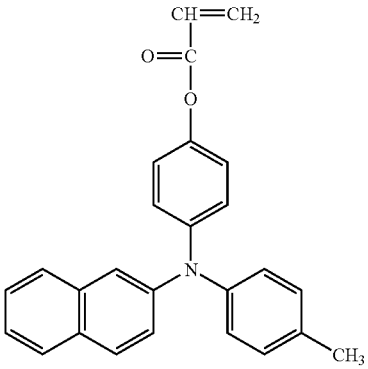
-continued
No. 39
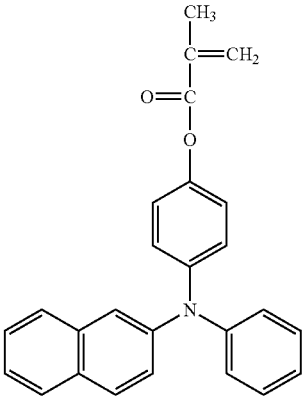
No. 40
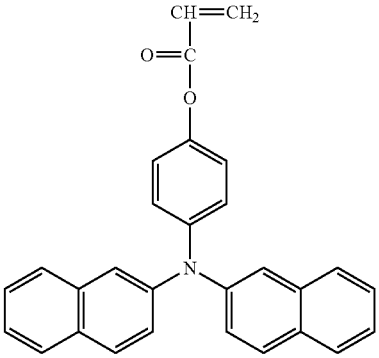
No. 41
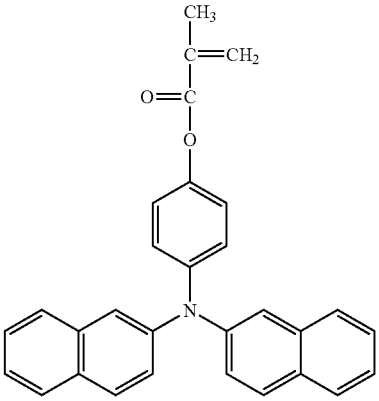
No. 42
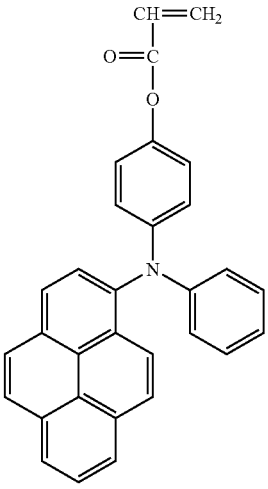

-continued
No. 43
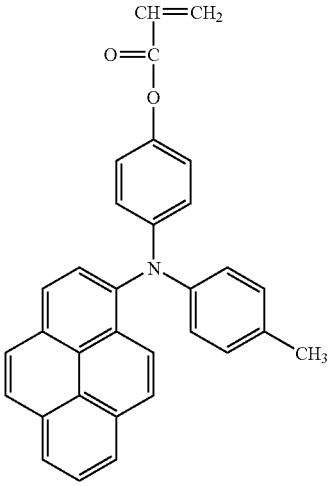
No. 44
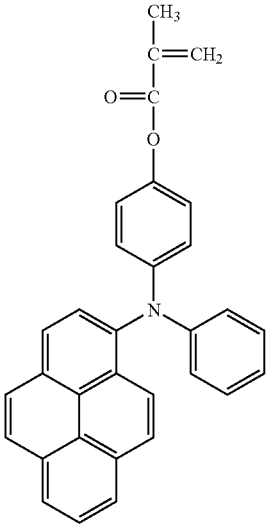
No. 45
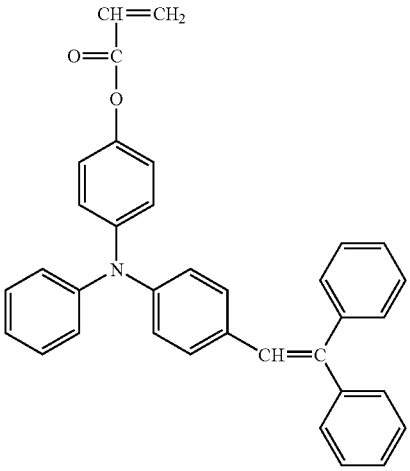
-continued
No. 46
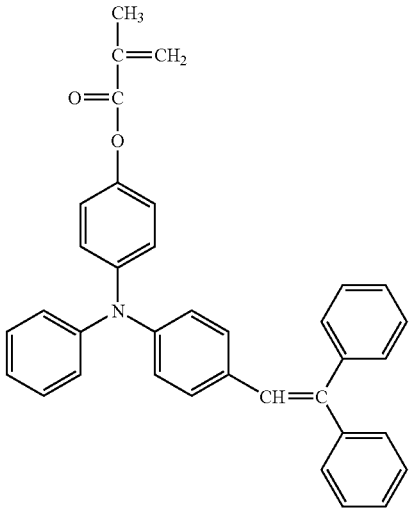
No. 47
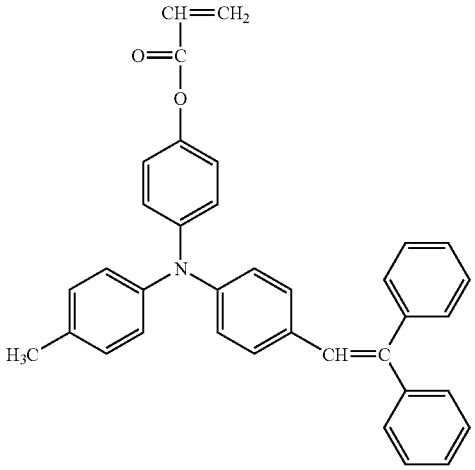
No. 48
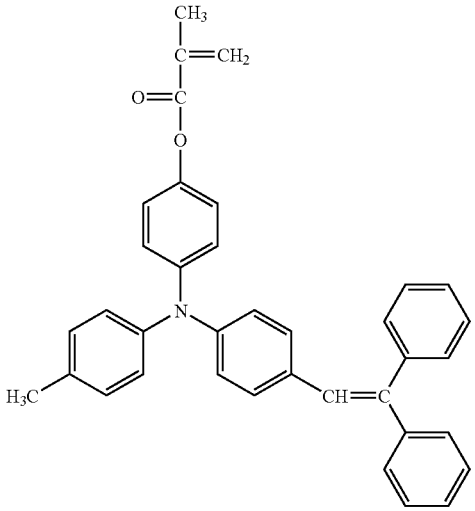

-continued
No. 49
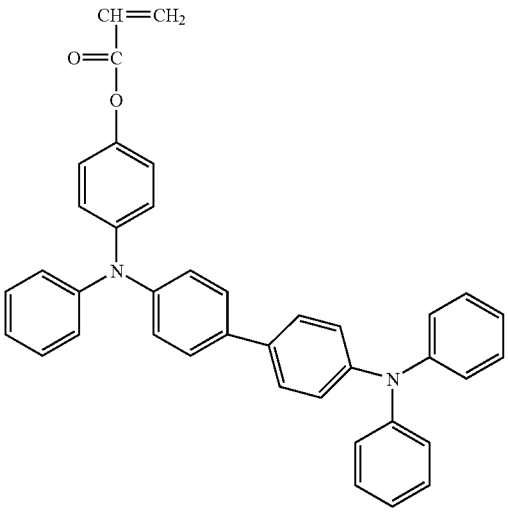
No. 50
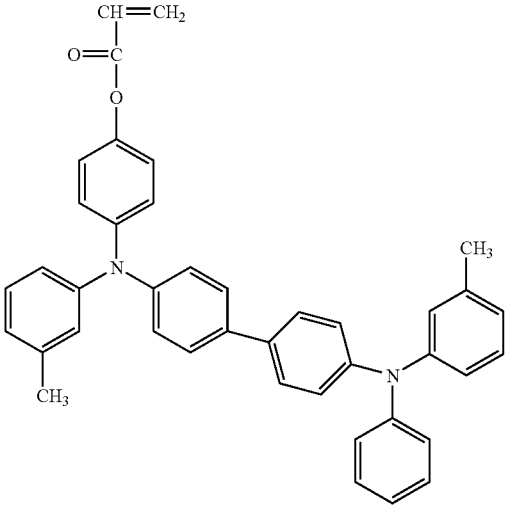
No. 51
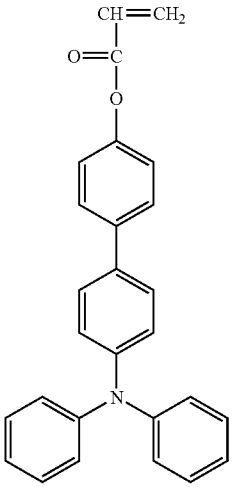
-continued
No. 52
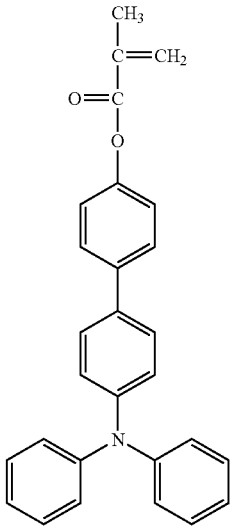
No. 53
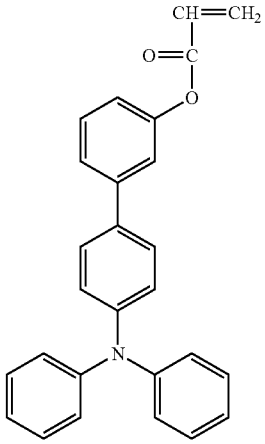
No. 54
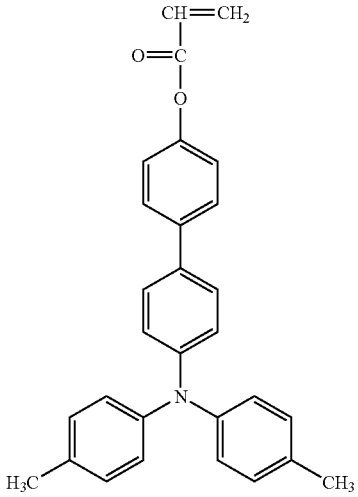

-continued
No. 55
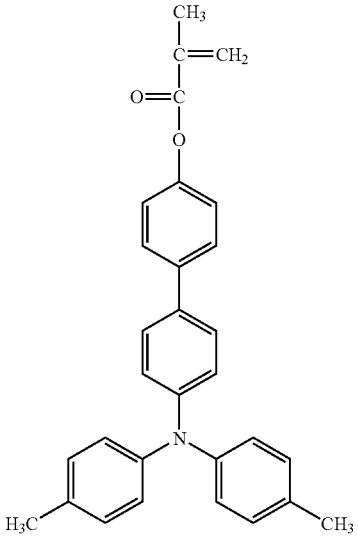
No. 56
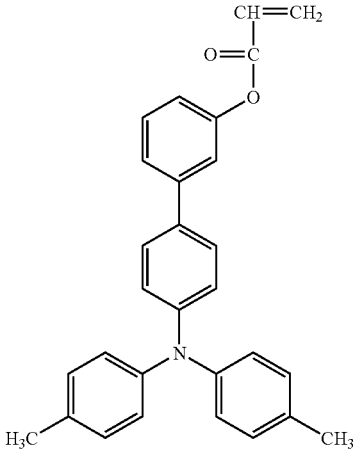
No. 57
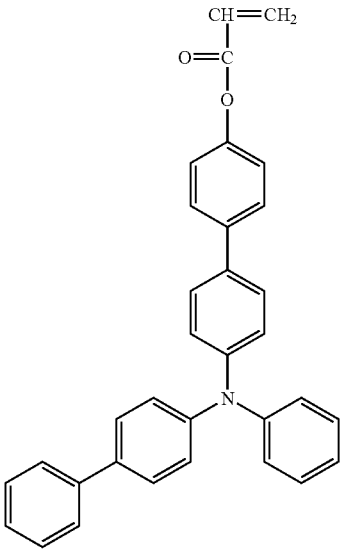
-continued
No. 58
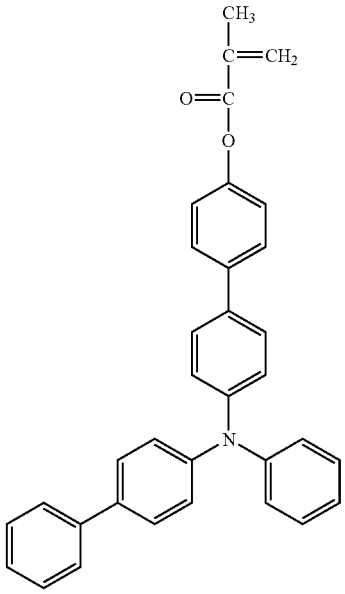
No. 59
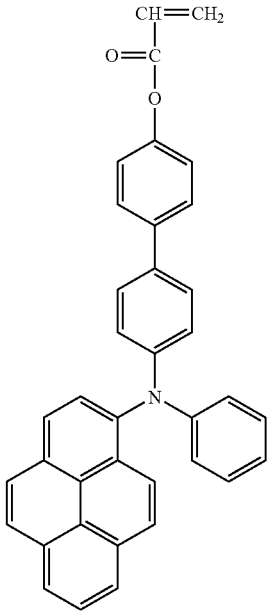

-continued
No. 60
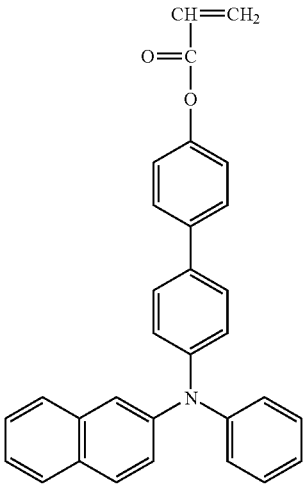
No. 61
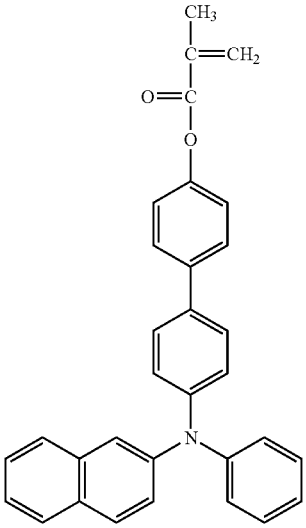
No. 62
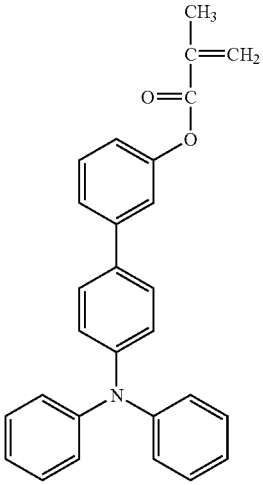
-continued
No. 63
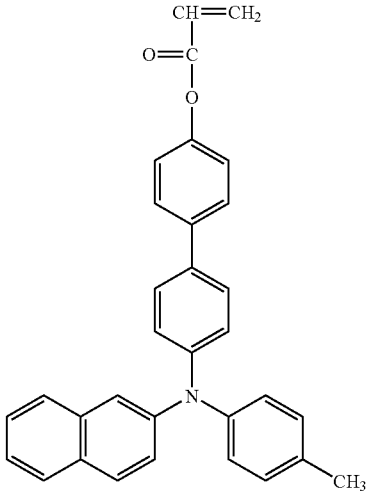
No. 64
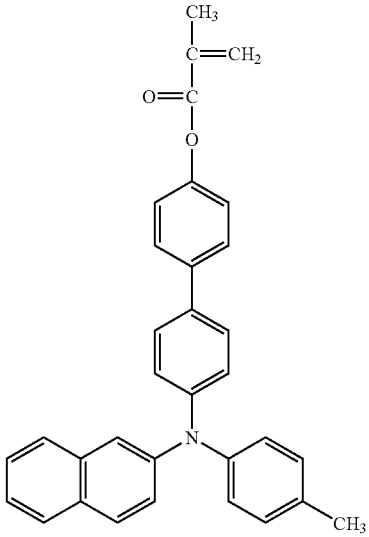
No. 65
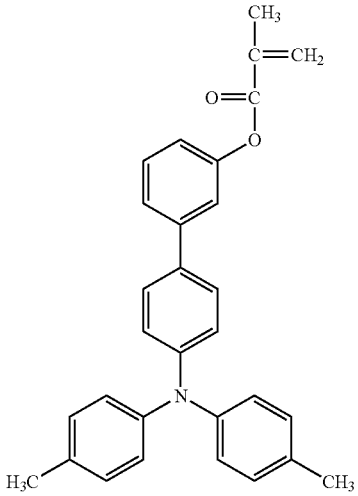

-continued
No. 66
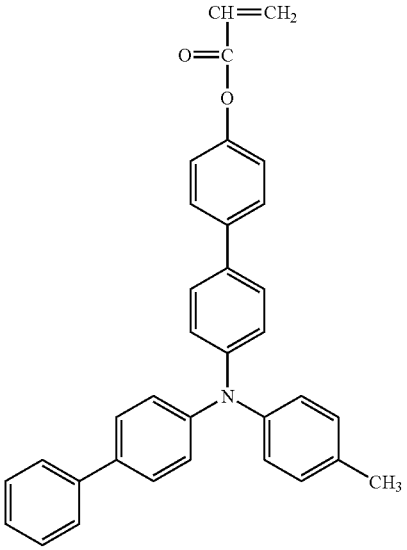
-continued
No. 68
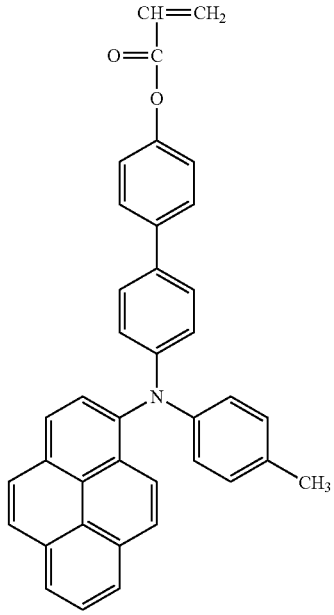
No. 67
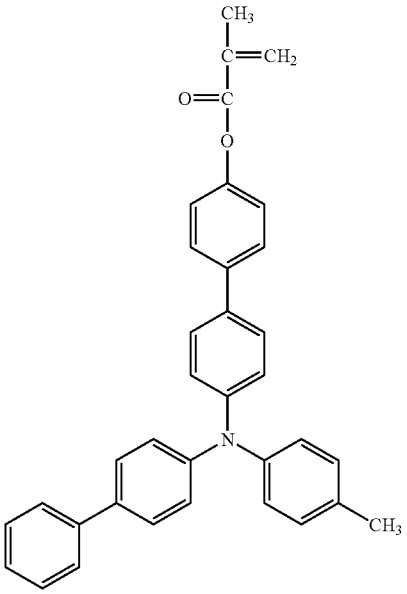
No. 69
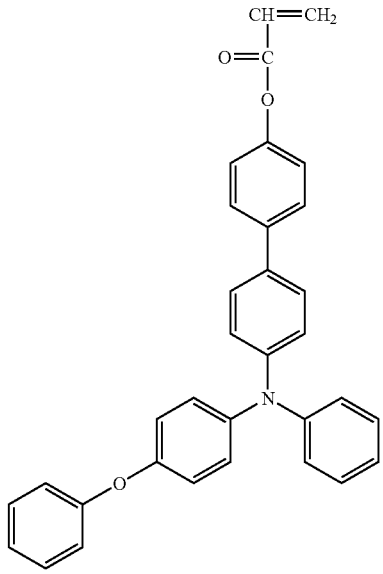

-continued
No. 70
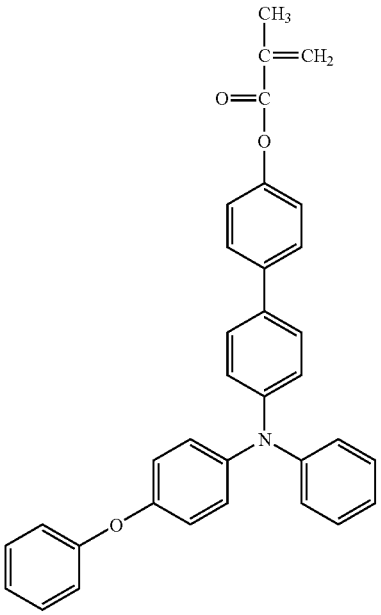
No. 71
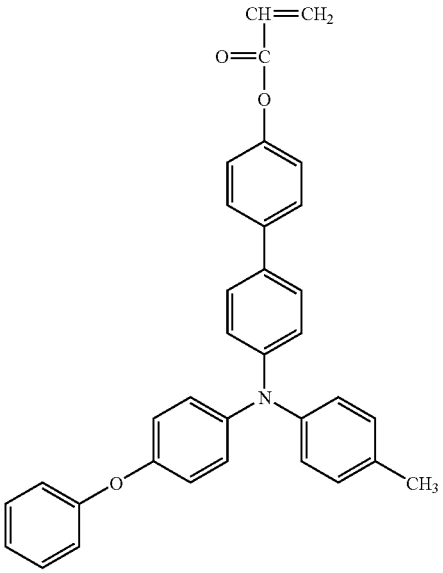
-continued
No. 72
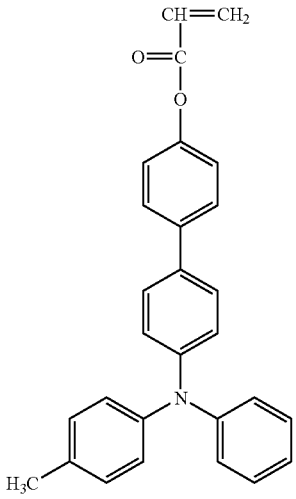
No. 73
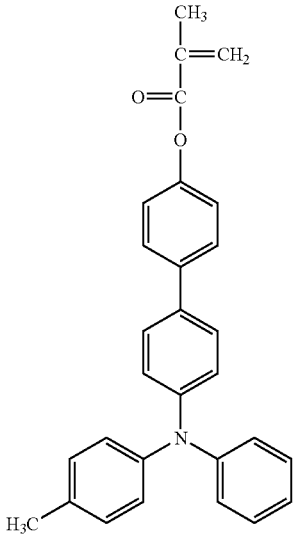
No. 74
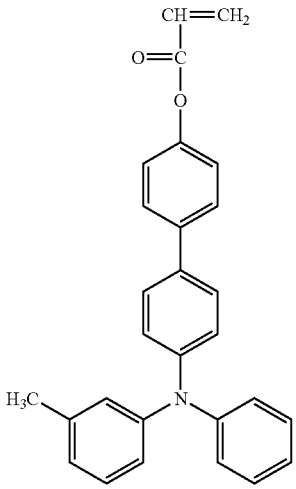

-continued
No. 75
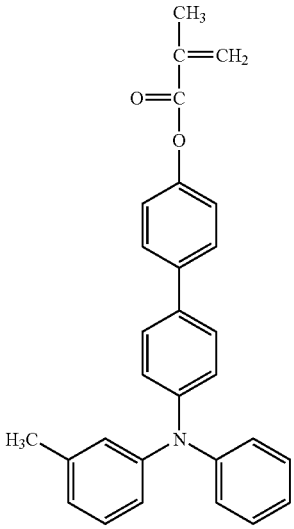
No. 76
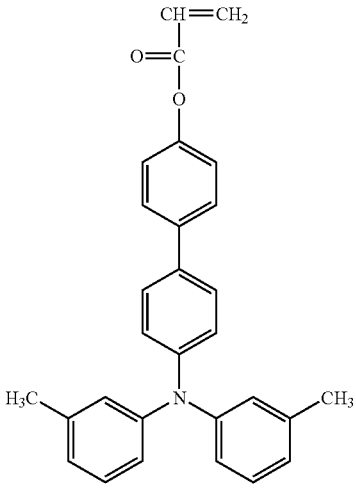
No. 77
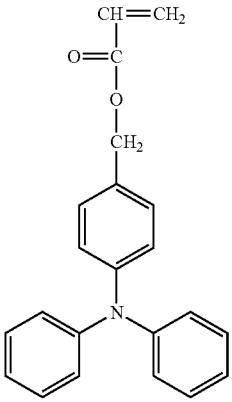
-continued
No. 78
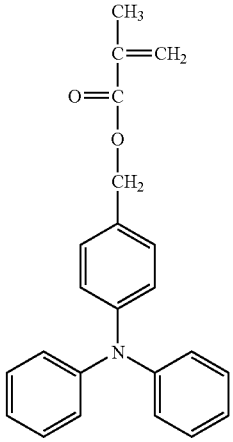
No. 79
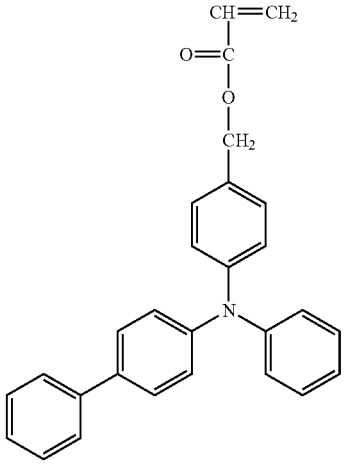
No. 80
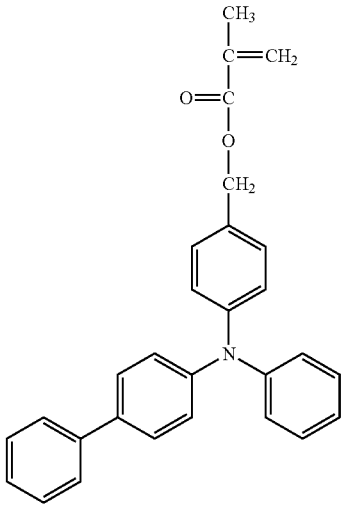

-continued
No. 81
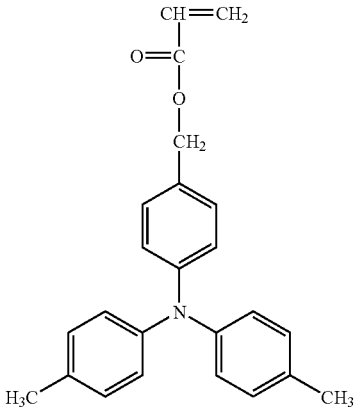
No. 82
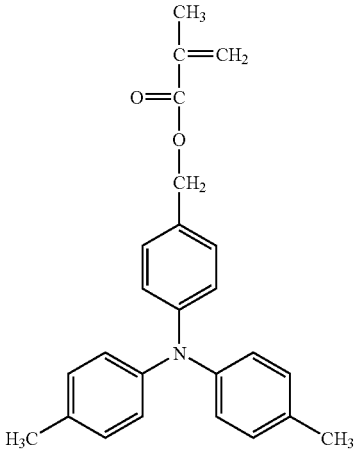
No. 83
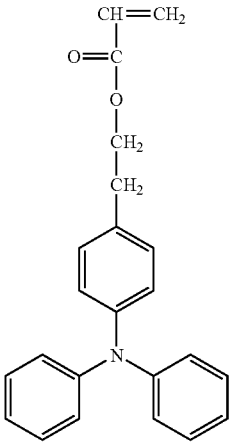
-continued
No. 84
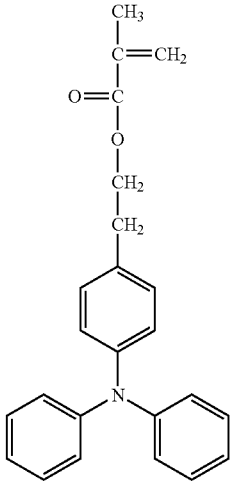
No. 85
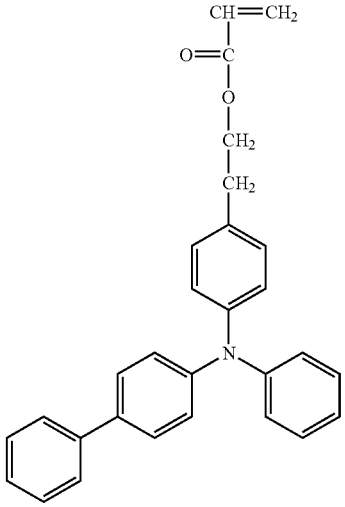
No. 86
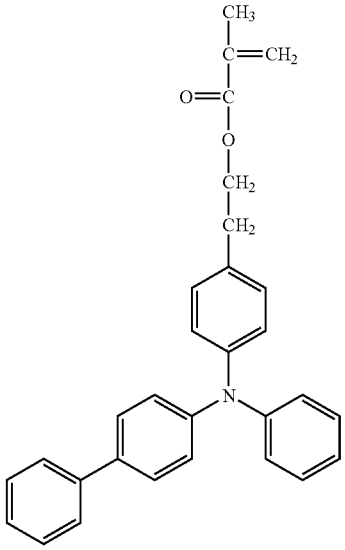

-continued
No. 87
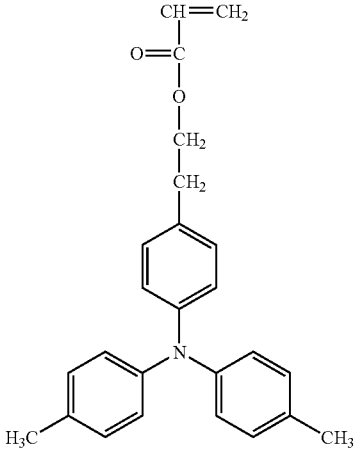
No. 88
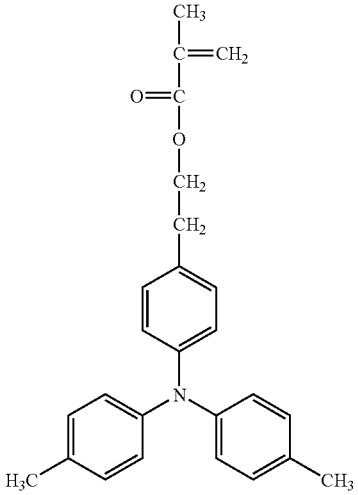
No. 89
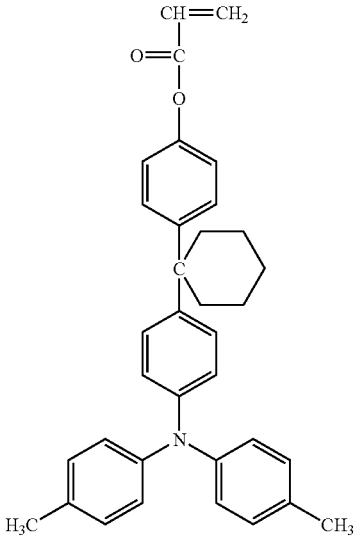
-continued
No. 90
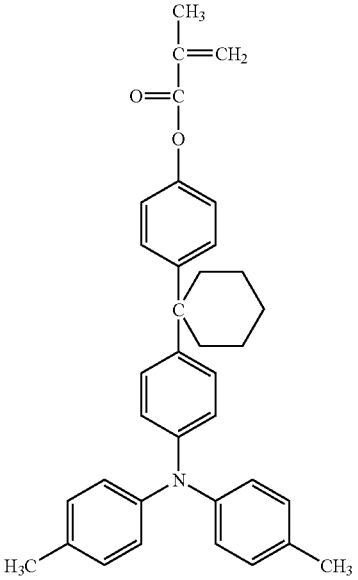
No. 91
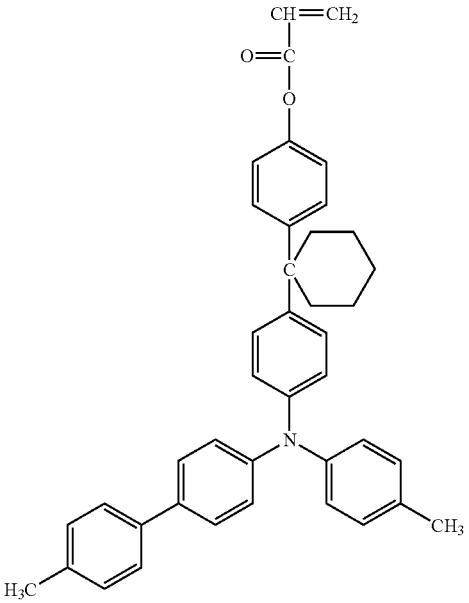

-continued
No. 92
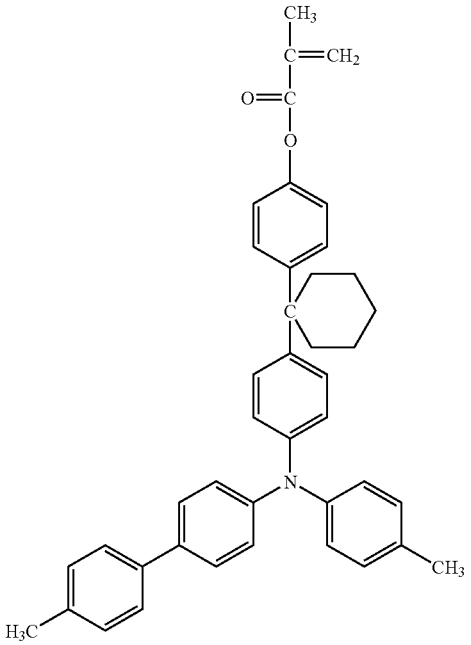
-continued
No. 94
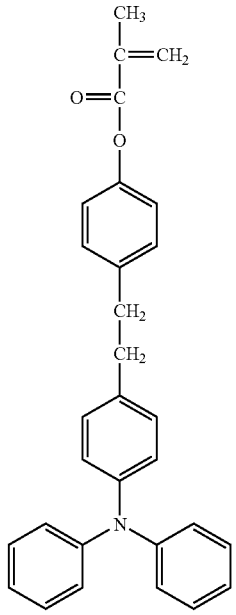
No. 93
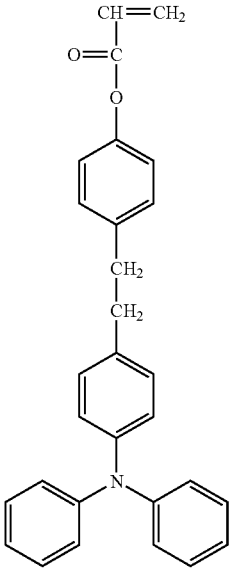
No. 95
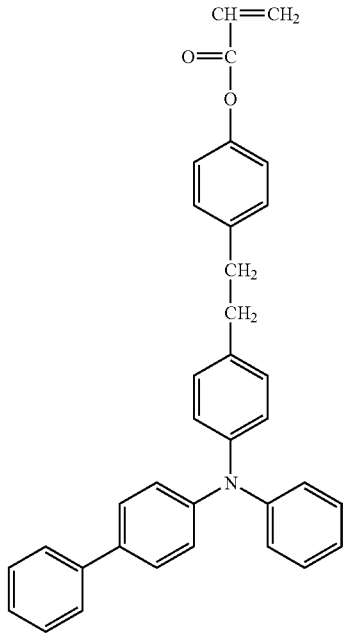

-continued
No. 96
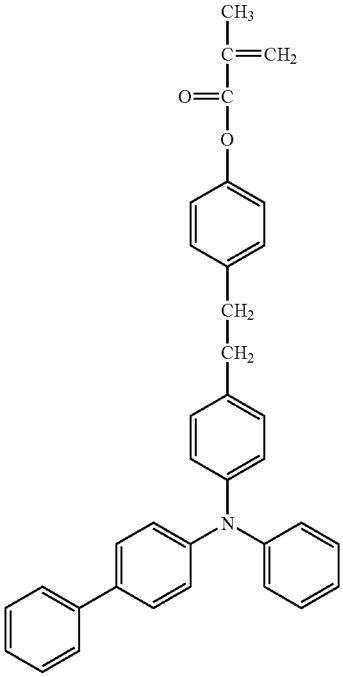
-continued
No. 98
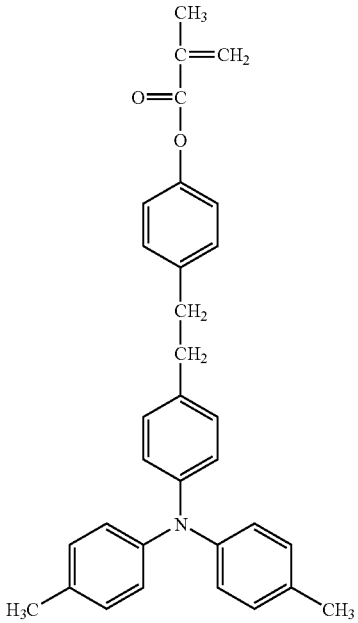
No. 97
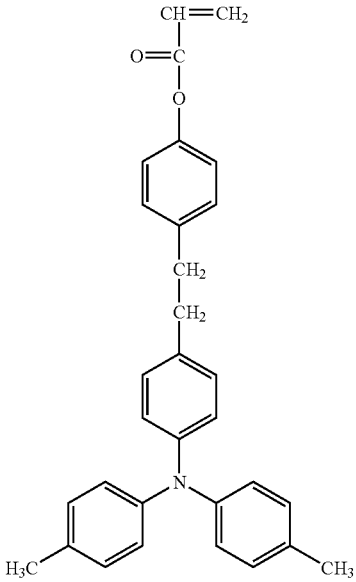
No. 99
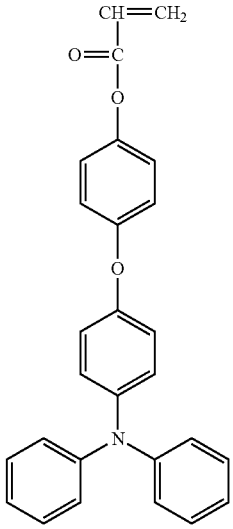

-continued
No. 100
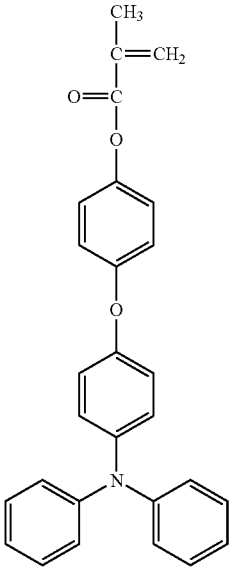
-continued
No. 102
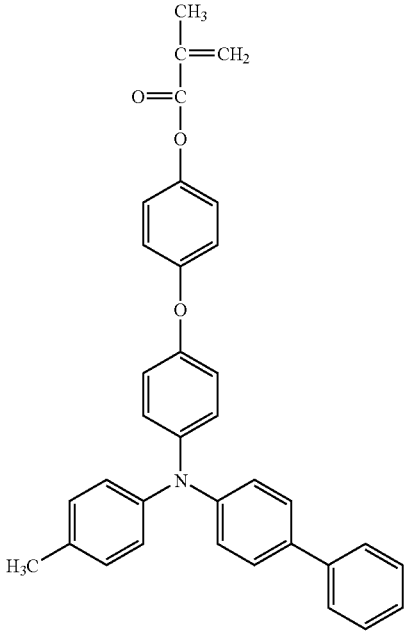
No. 101
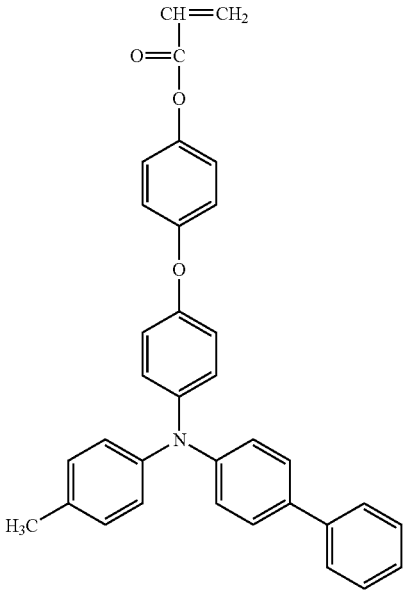
No. 103
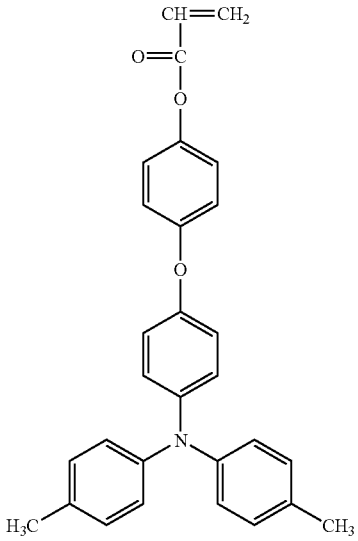

-continued
No. 104
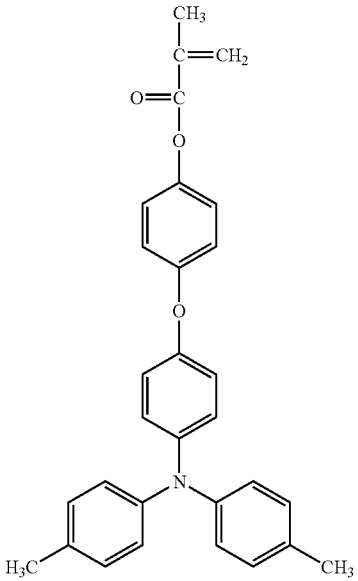
No. 105
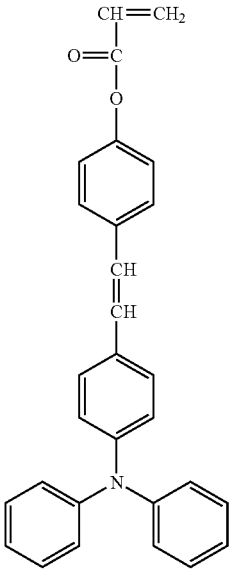
-continued
No. 106
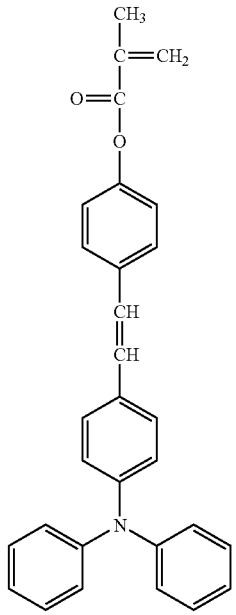
No. 107
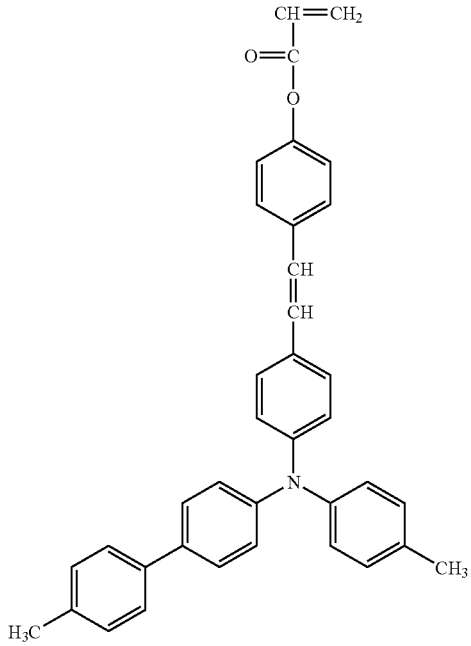

-continued
No. 108
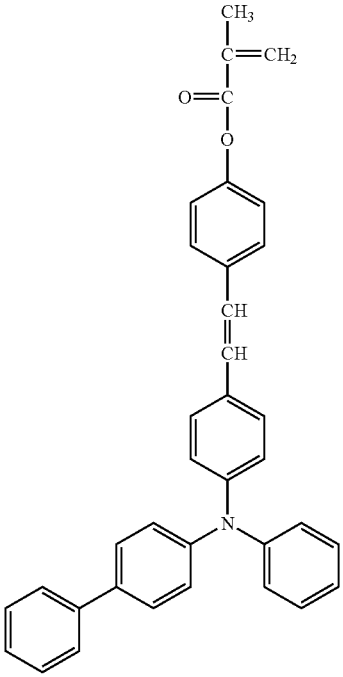
No. 109
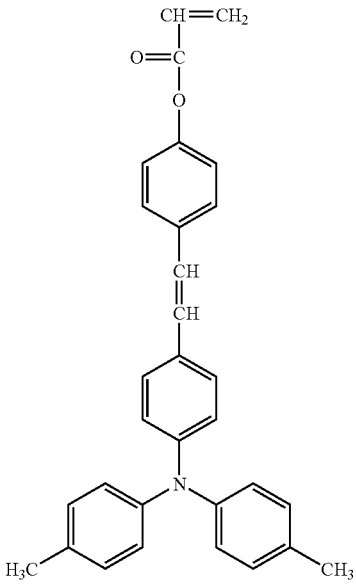
-continued
No. 110
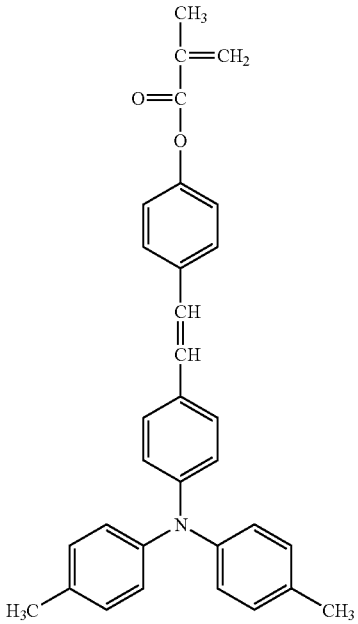
No. 111
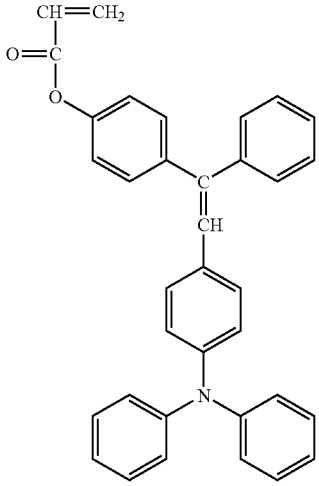
No. 112
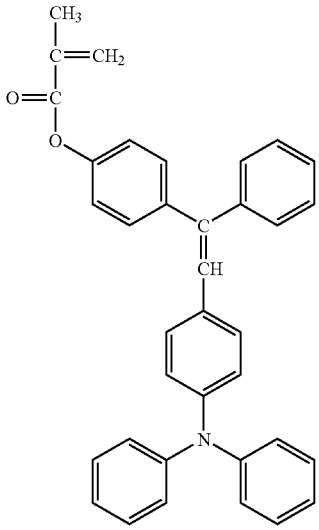

-continued
No. 113
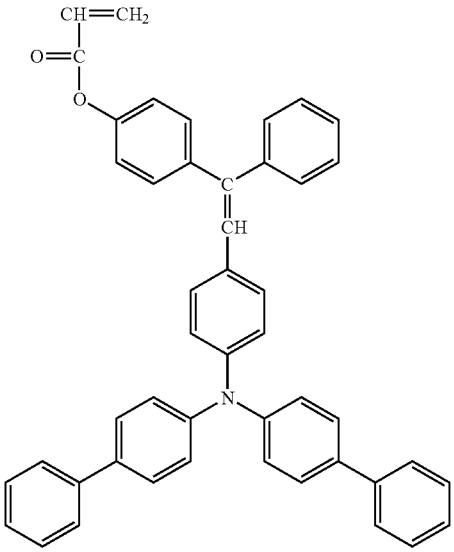
No. 114
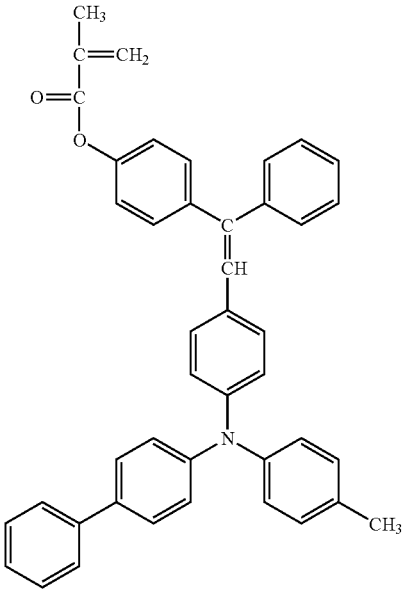
No. 115
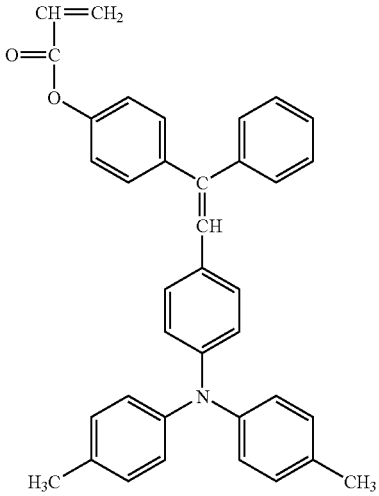
-continued
No. 116
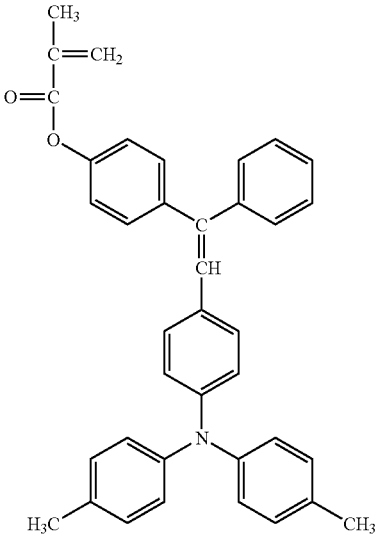
No. 117
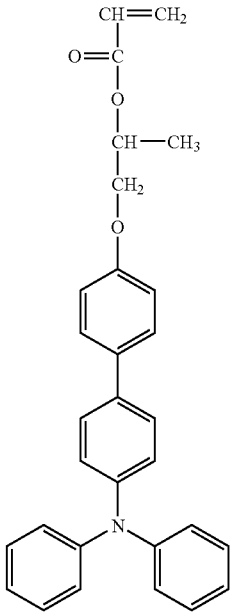

-continued
No. 118
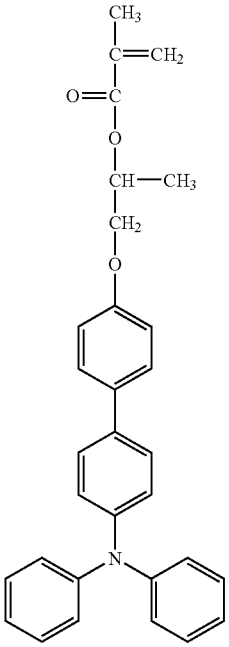
-continued
No. 120
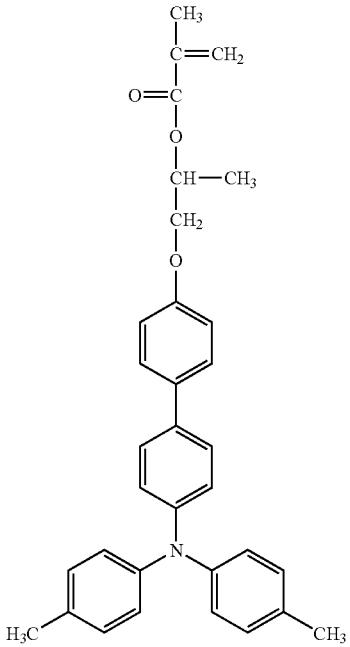
No. 119
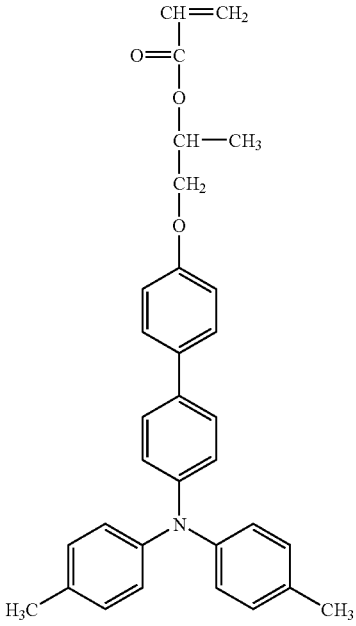
No. 121
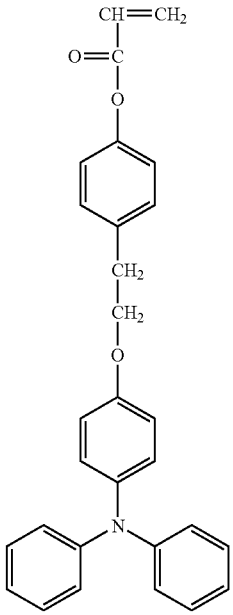

-continued
No. 122
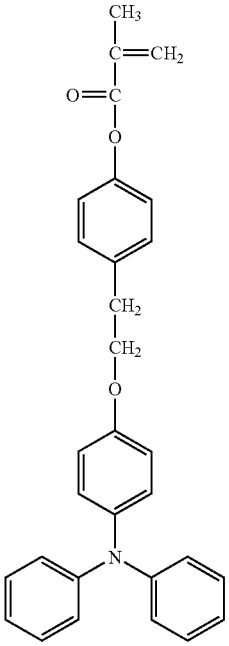
-continued
No. 124
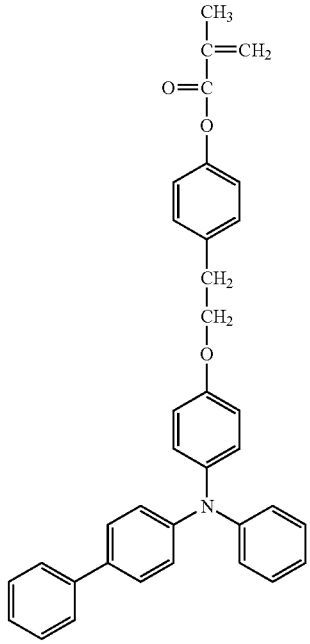
No. 123
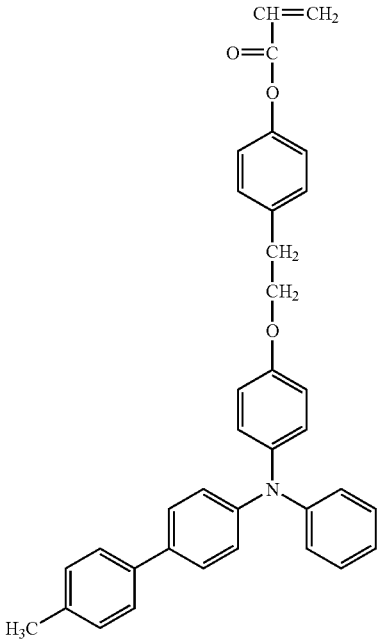
No. 125
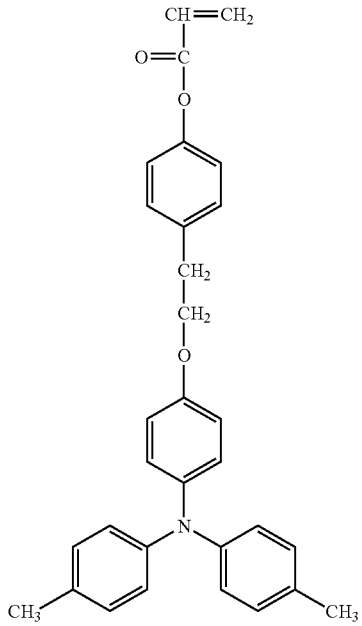

-continued
No. 126
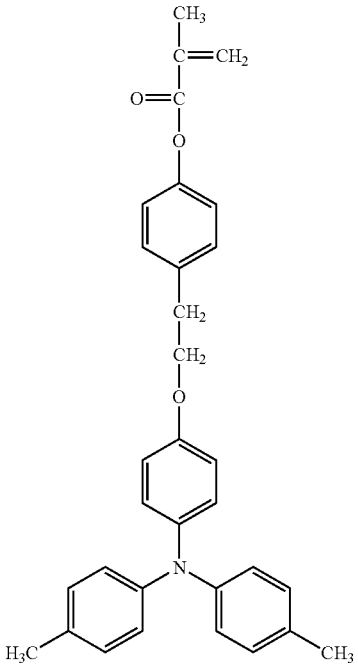
-continued
No. 128
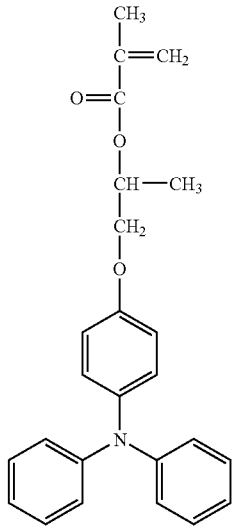
No. 127
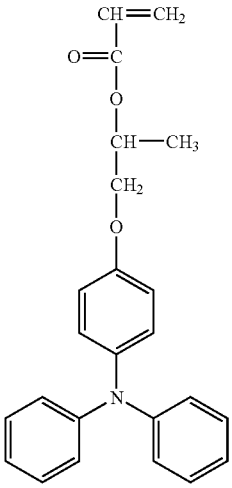
No. 129
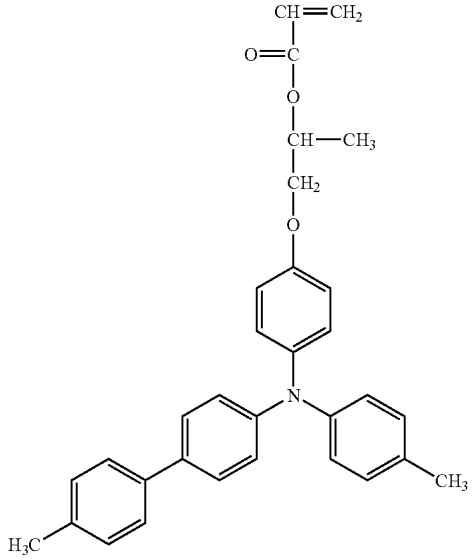

-continued
No. 130
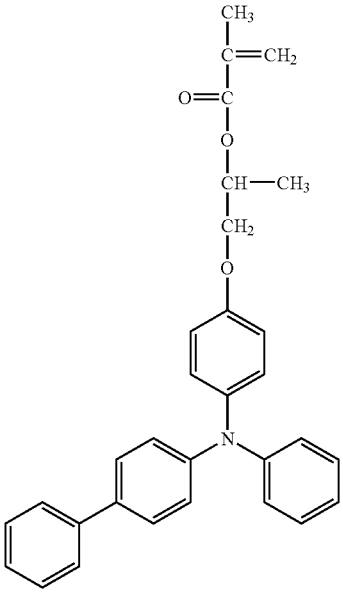
No. 131
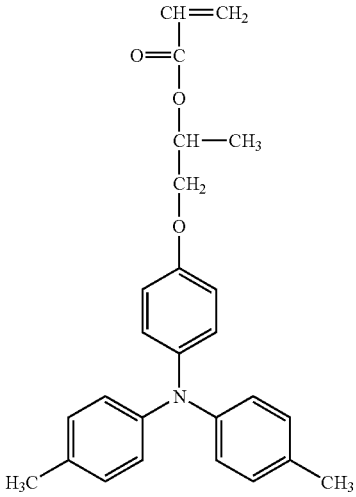
No. 132
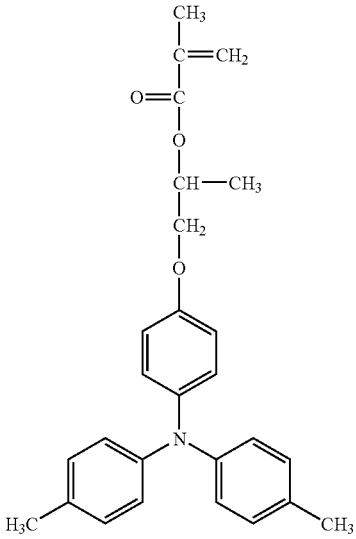
-continued
No. 133
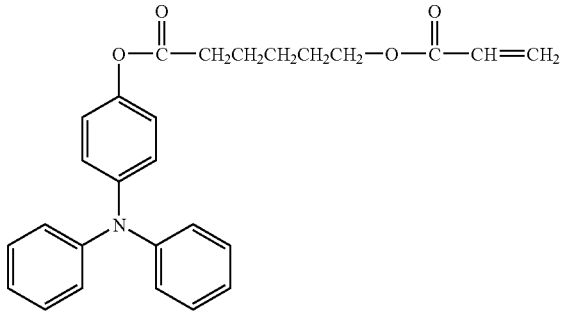
No. 134
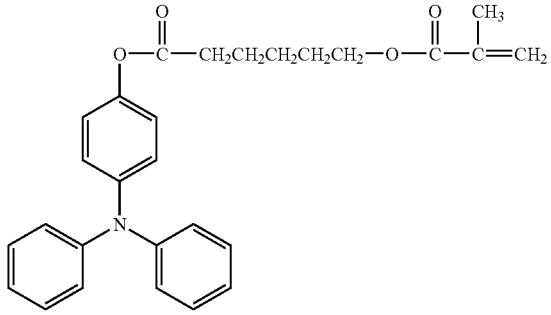
No. 135
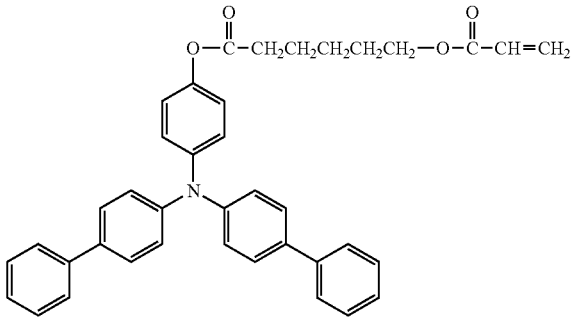
No. 136
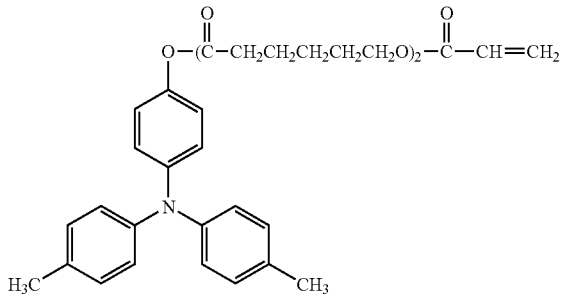

-continued
No. 137
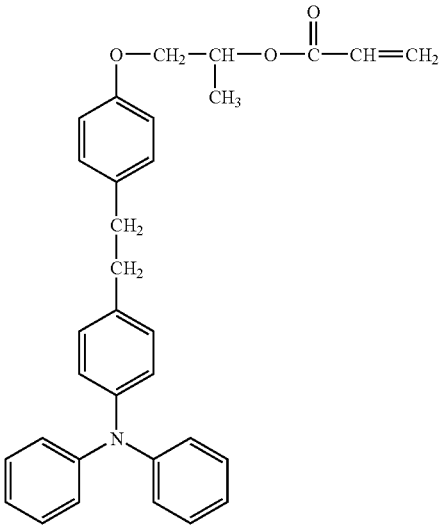
No. 138
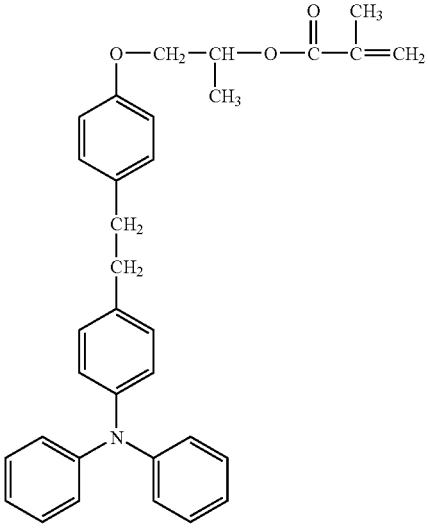
No. 139
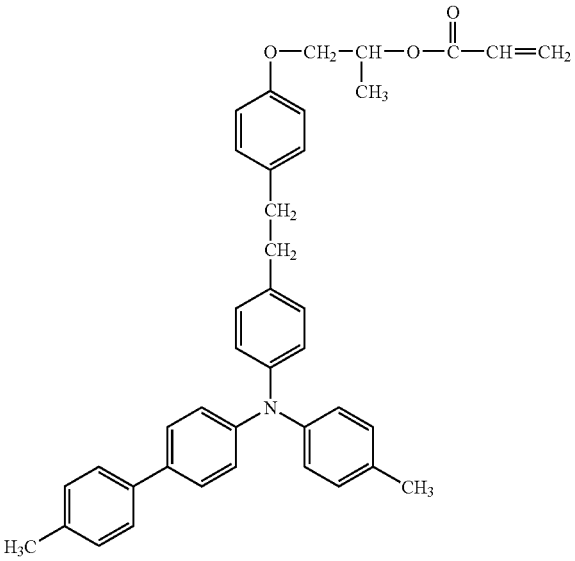
-continued
No. 140
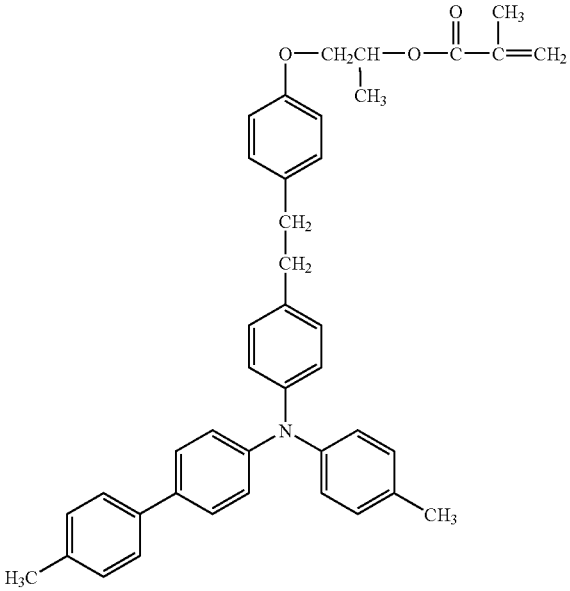
No. 141
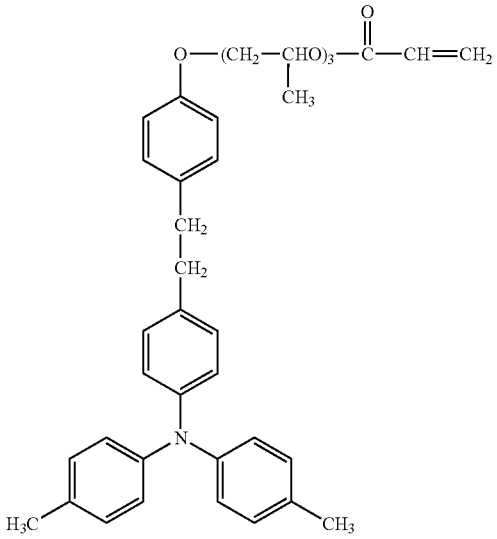

-continued
No. 142
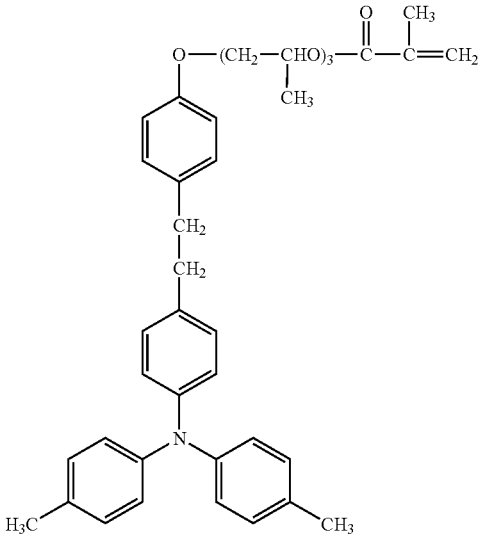
No. 143
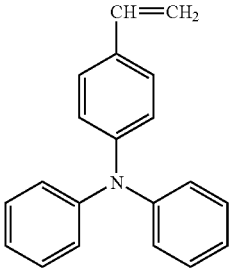
No. 144
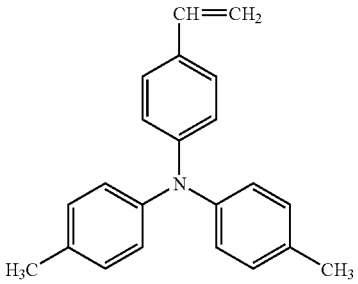
No. 145
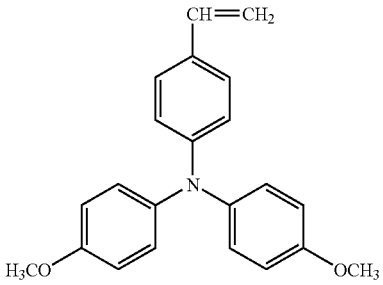
-continued
No. 146
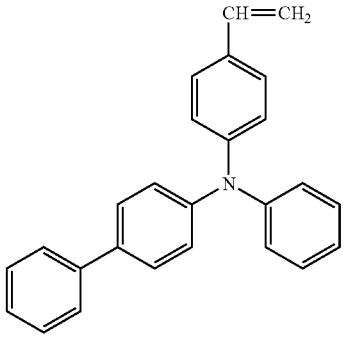
No. 147
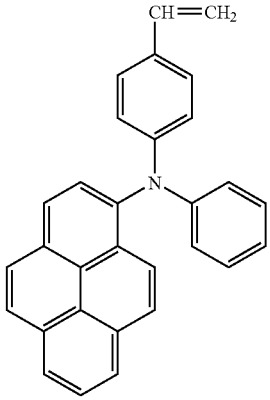
No. 148
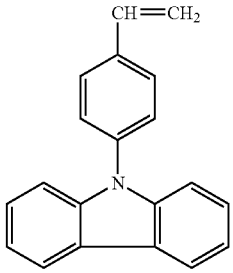
No. 149
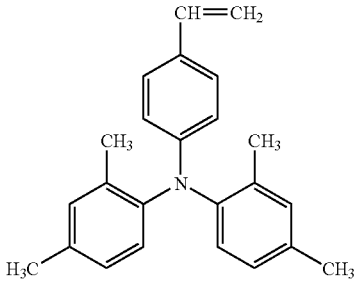
No. 150
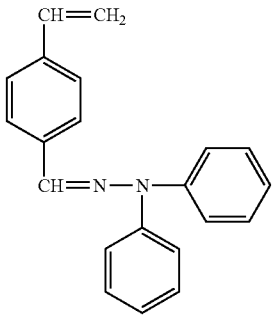

-continued
No. 151
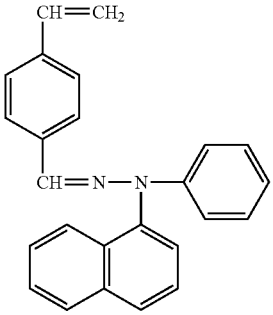
No. 152
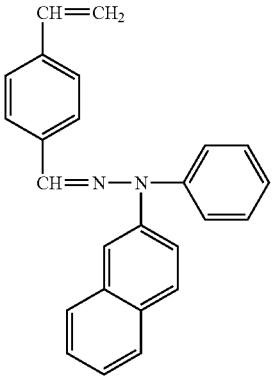
No. 153
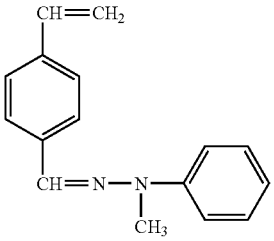
No. 154
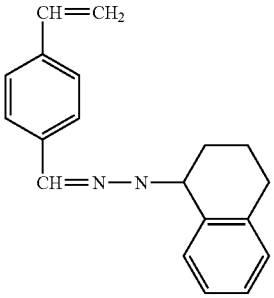
No. 155
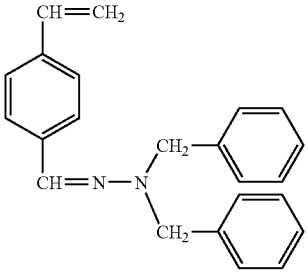
-continued
No. 156
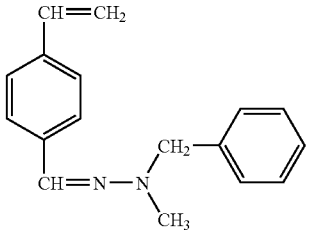
No. 157
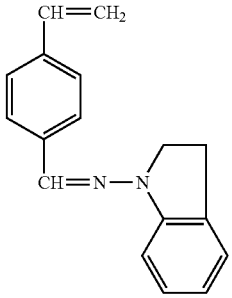
No. 158
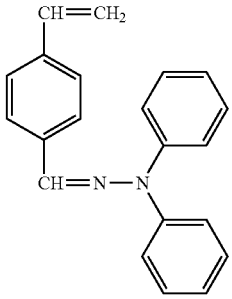
No. 159
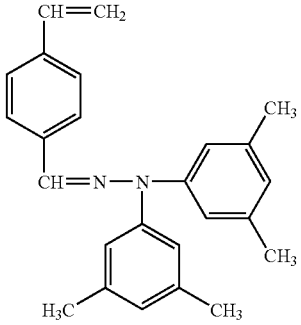
No. 160
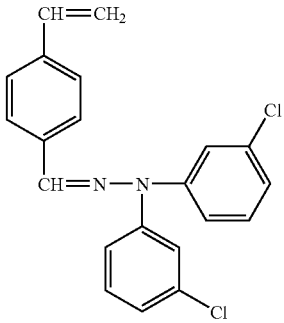
Specific examples of the radically polymerizable difunctional monomers (B') having a charge transport structure are as follows, but are not limited thereto.

No 161
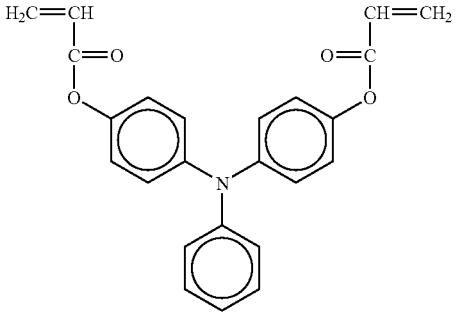
No 162
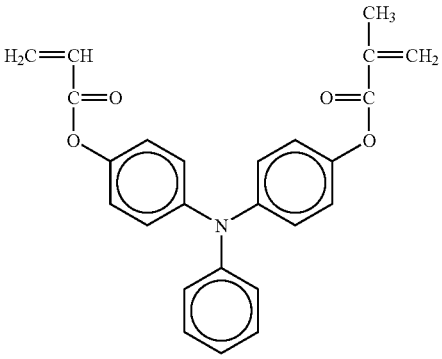
No 163
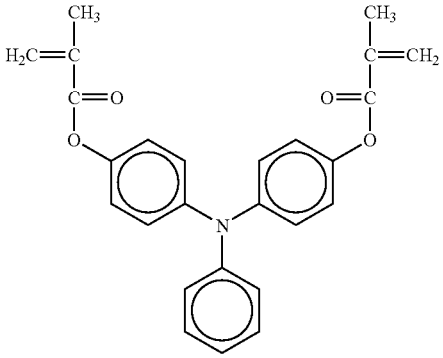
No 164
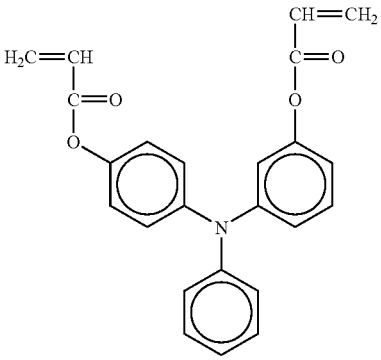
No 165
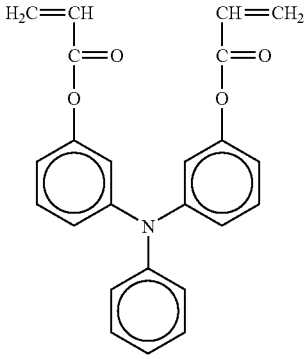
No 166
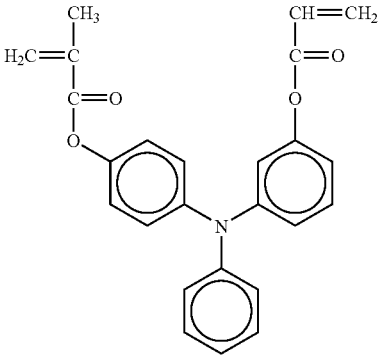
No 167
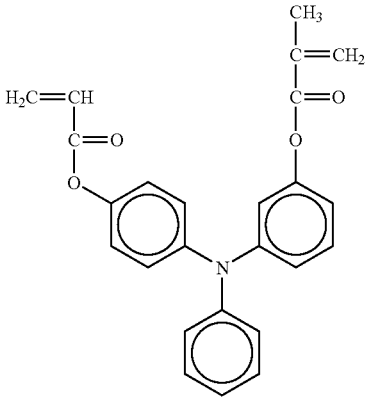
No 168
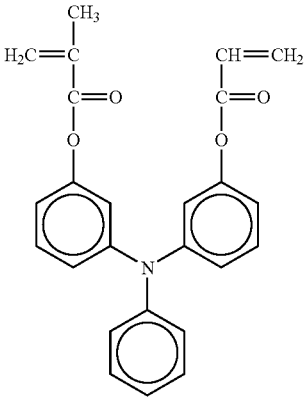

-continued
No 169
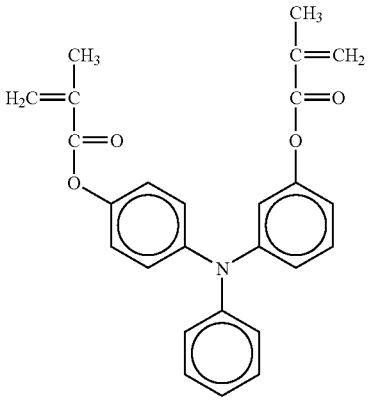
No 170
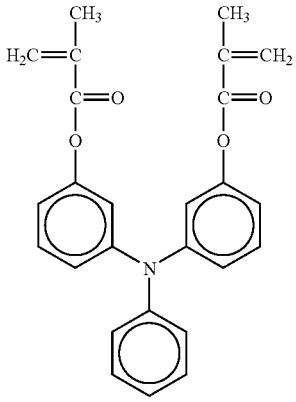
No 171
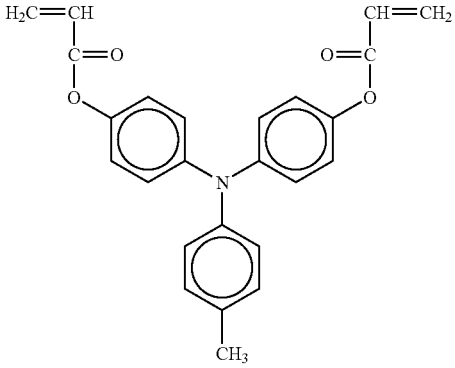
No 172
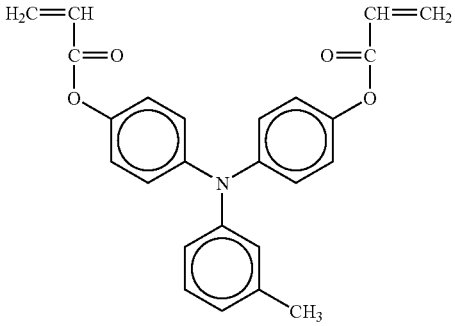
No 173
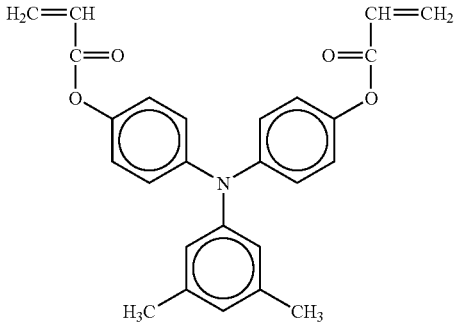
No 174
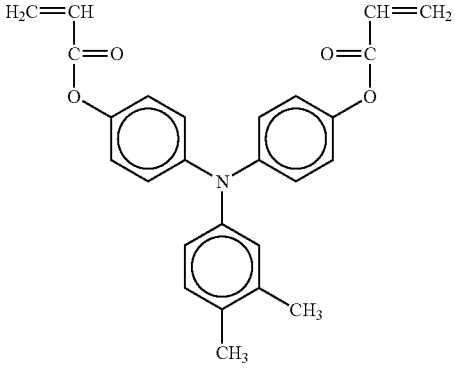
No 175
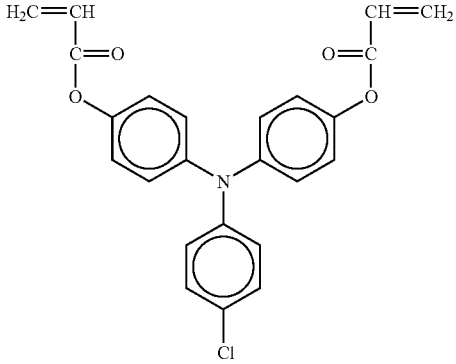

-continued
No 176
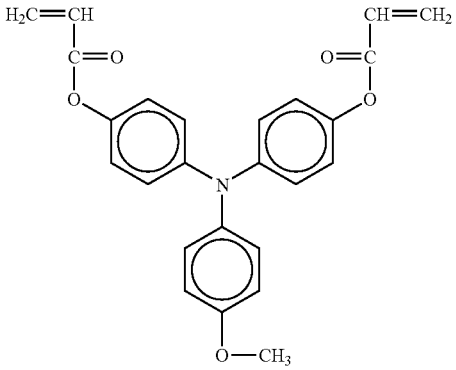
No 177
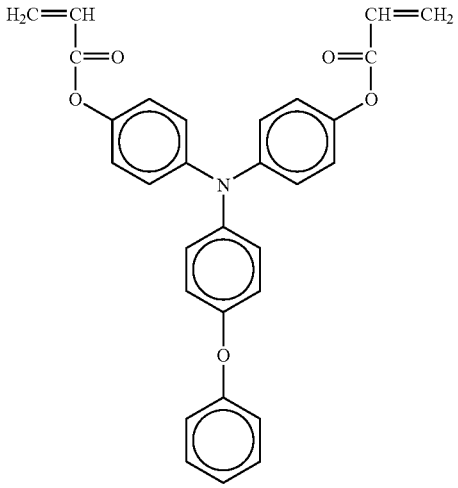
No 178
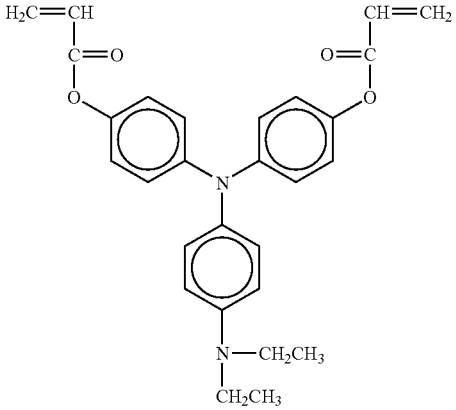
No 179
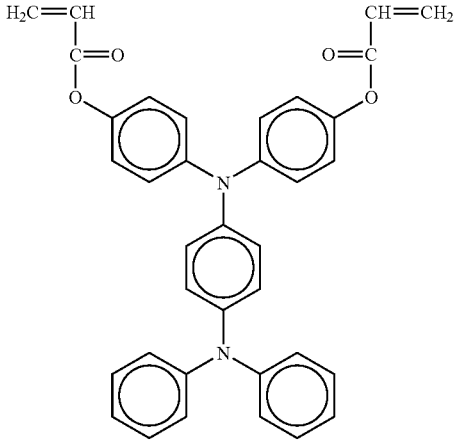
No 180
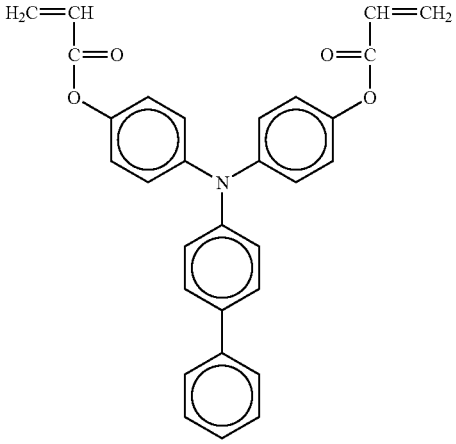
No 181
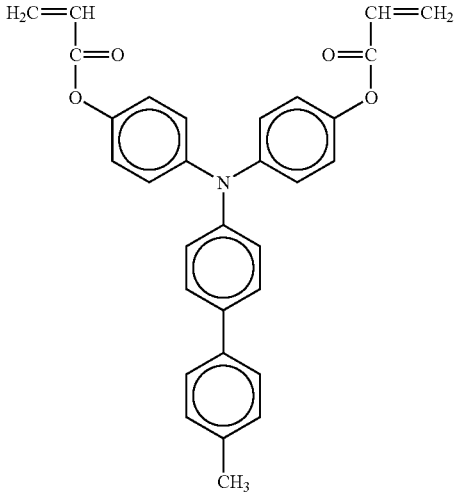

-continued
No 182
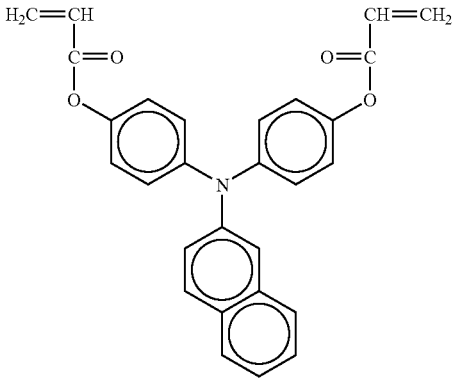
No 183
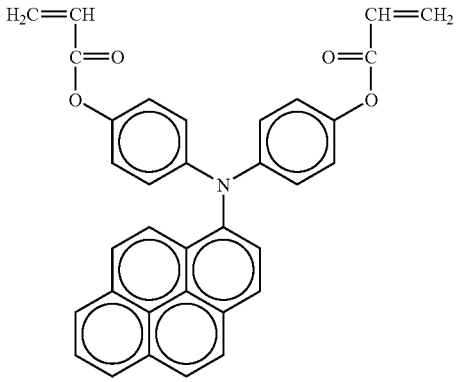
No 184
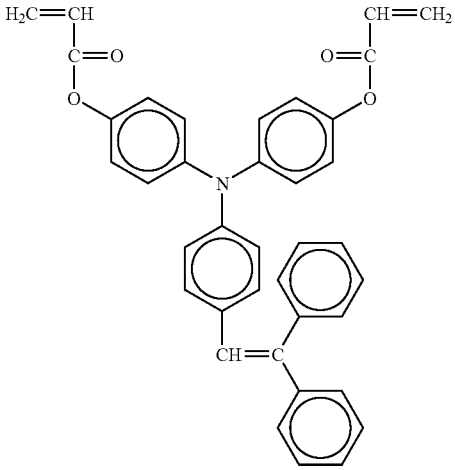
No 185
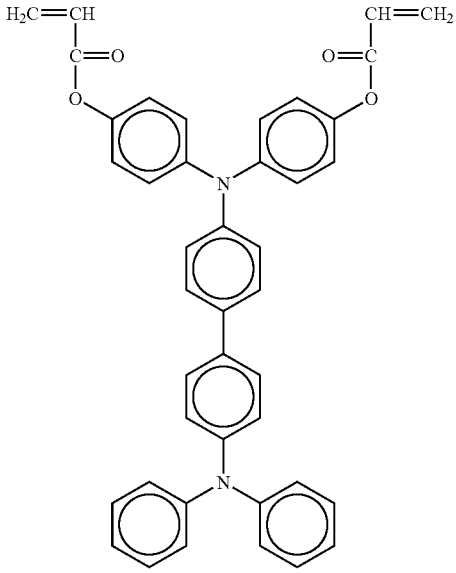
No 186
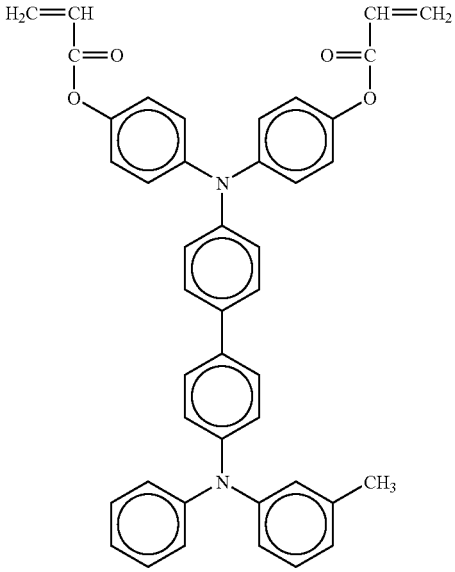
No 187
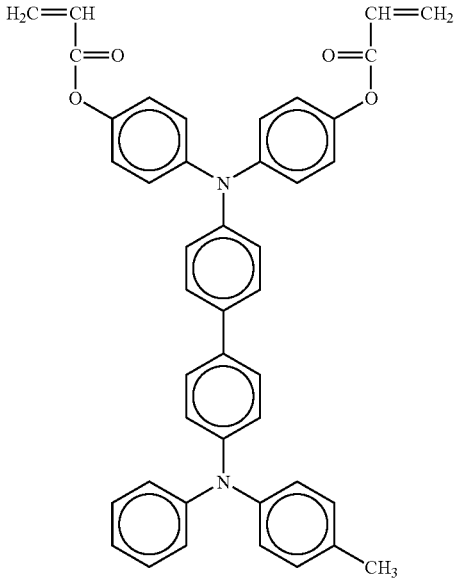

-continued
No 188
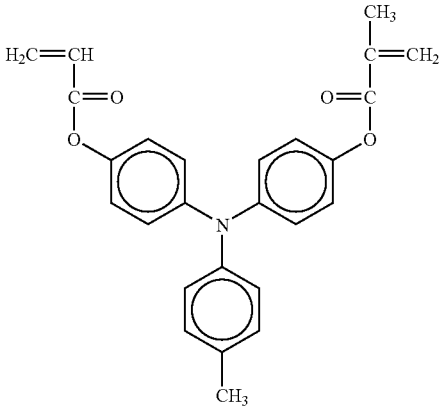
No 189
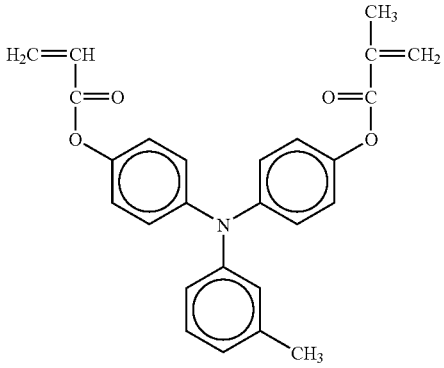
No 190
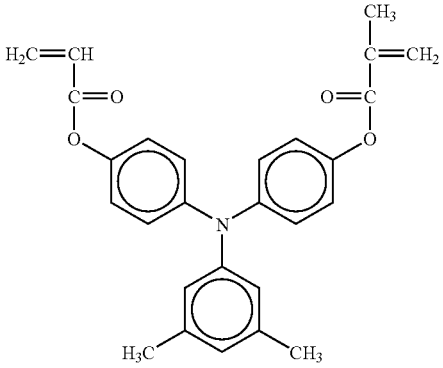
No 191
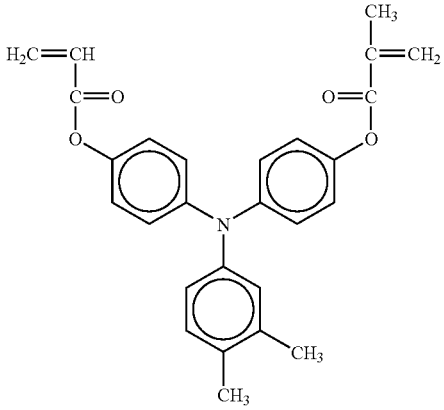
No 192
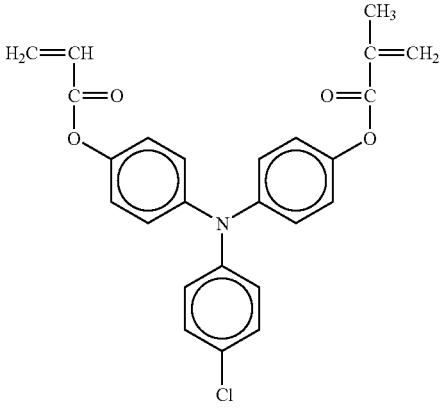
No 193
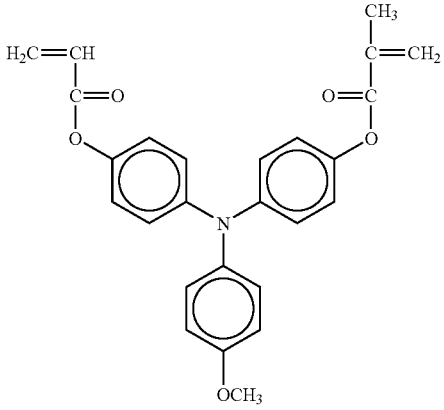

-continued
No 194
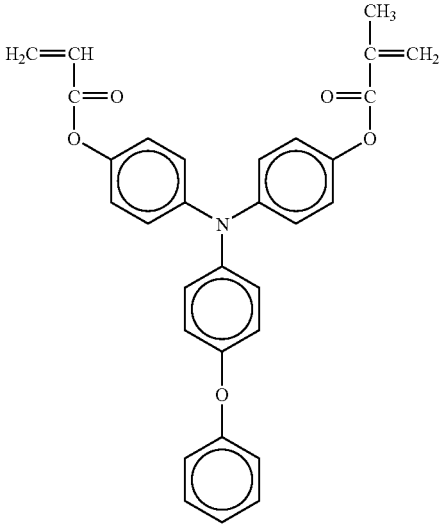
No 195
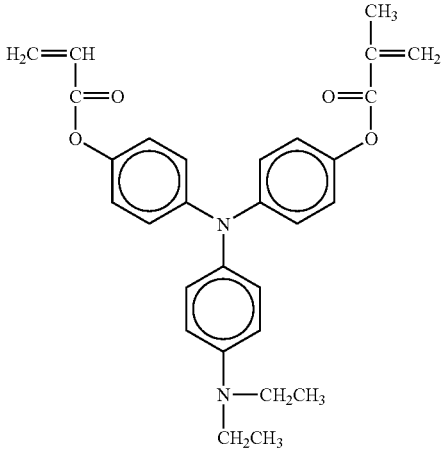
No 196
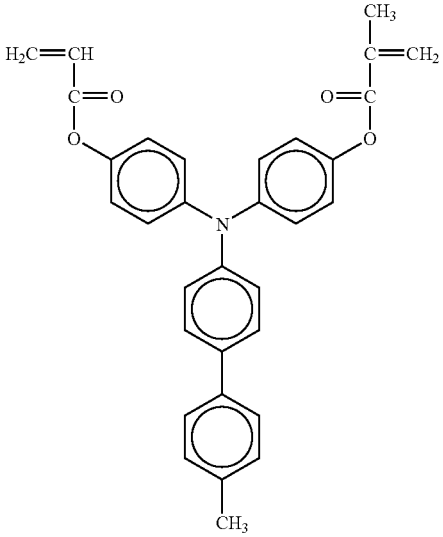
No 197
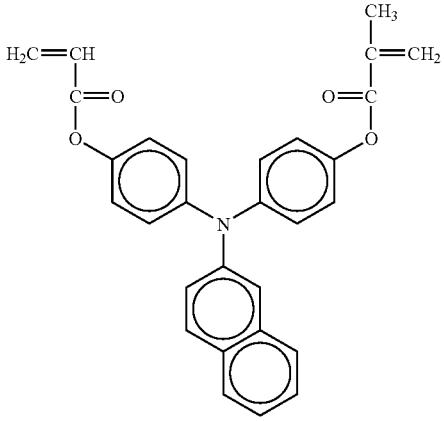
No 198
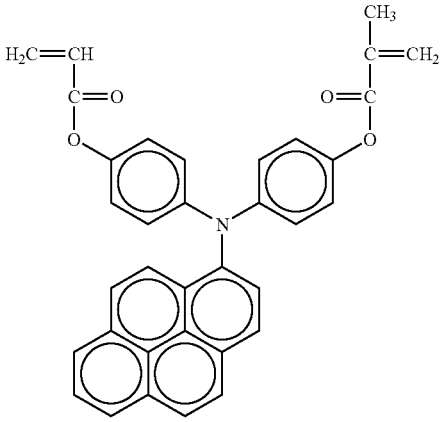
No 199
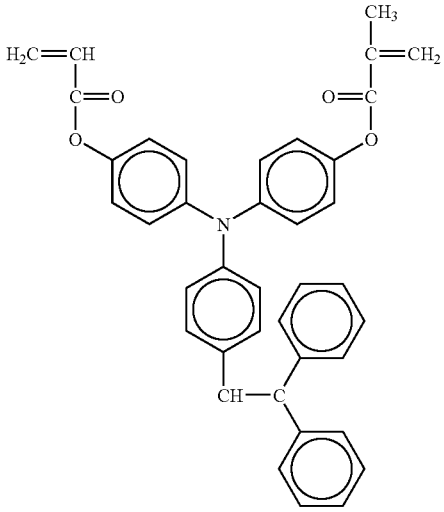

-continued
No 200
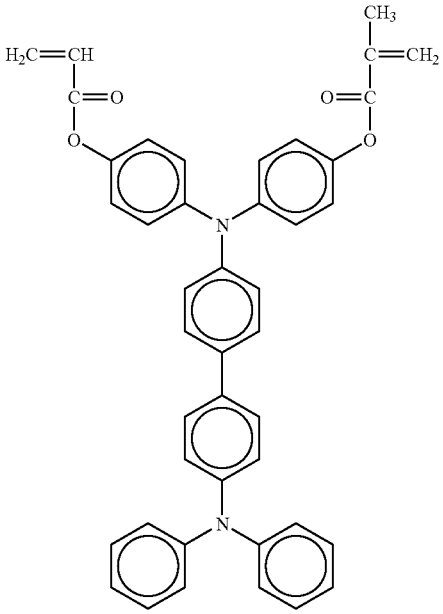
No 201
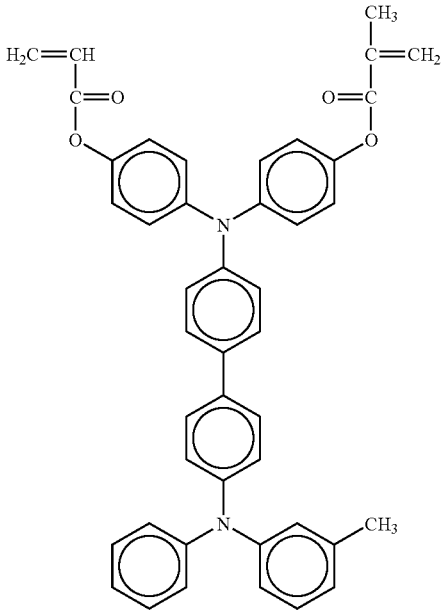
No 202
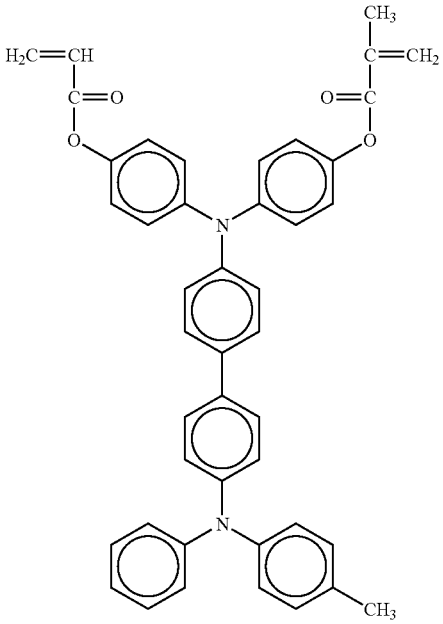
No 203
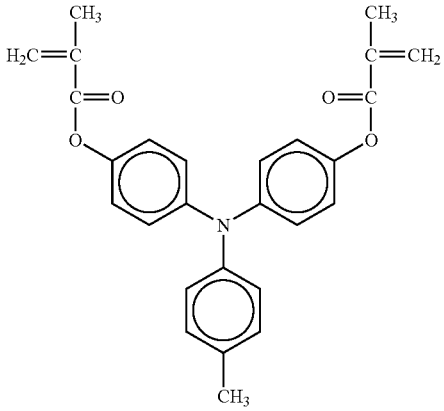
No 204
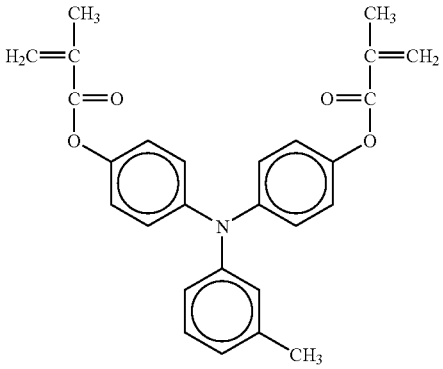
No 205
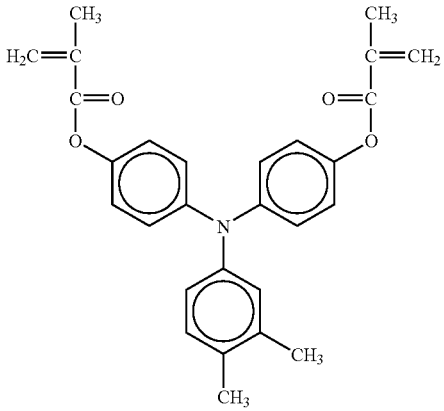

-continued
No 206
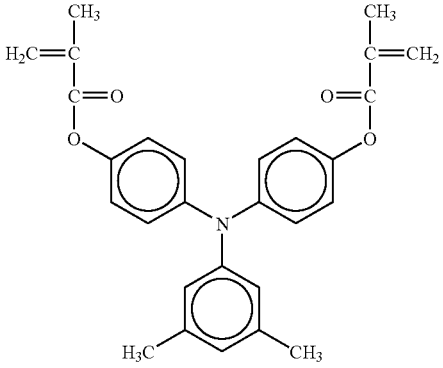
No 207
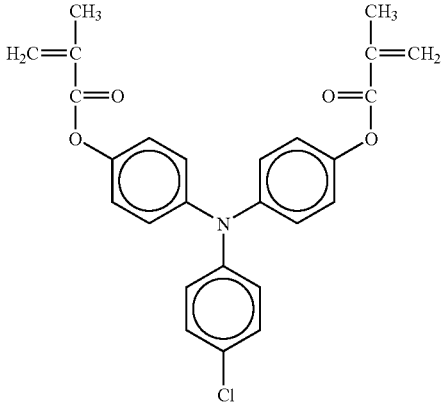
No 208
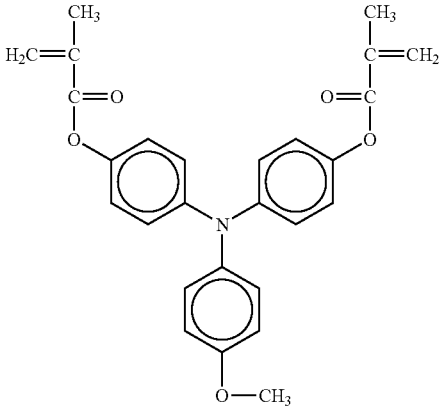
No 209
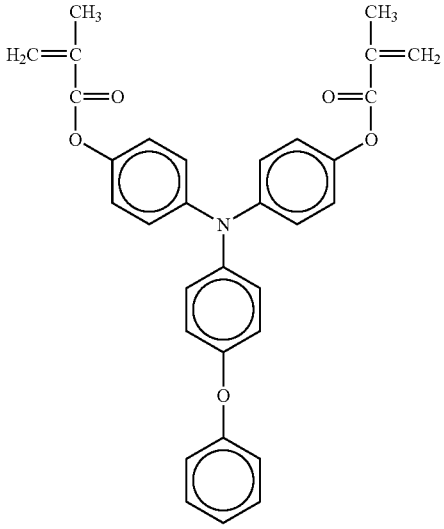
No 210
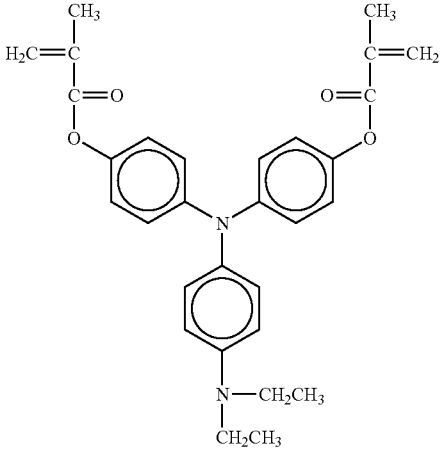
No 211
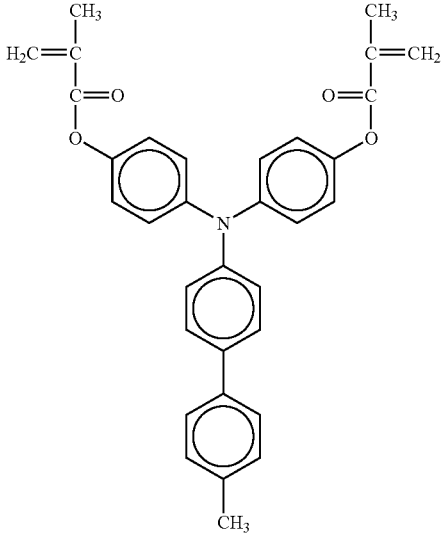

-continued
No 212
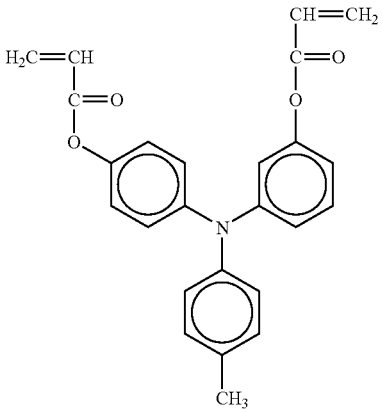
No 213
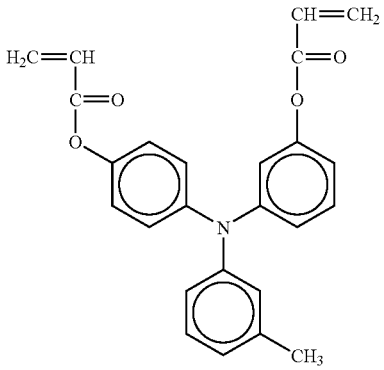
No 214
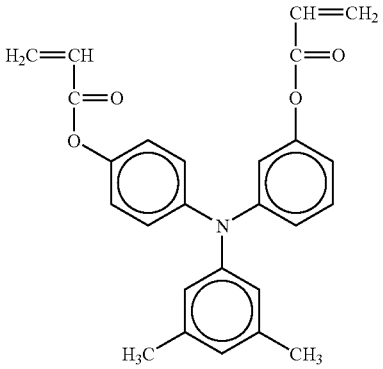
No 215
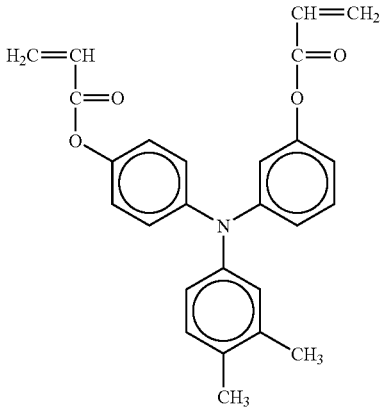
No 216
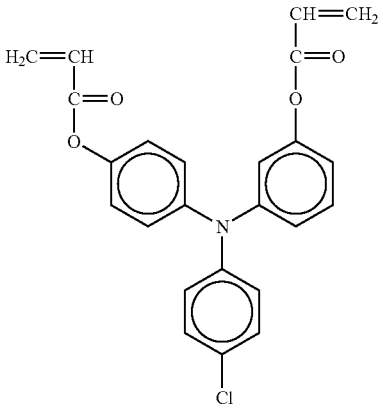
No 217
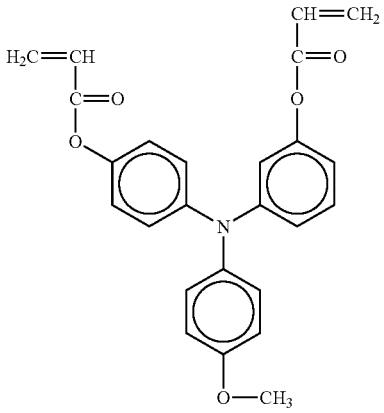

-continued
No 218
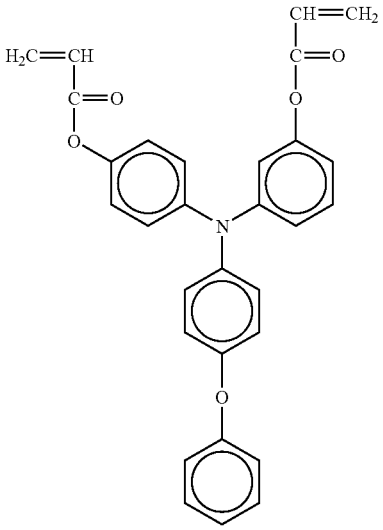
No 219
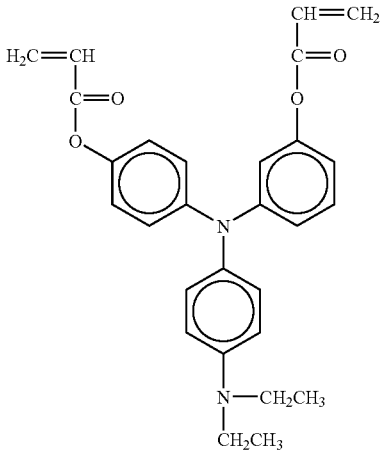
No 220
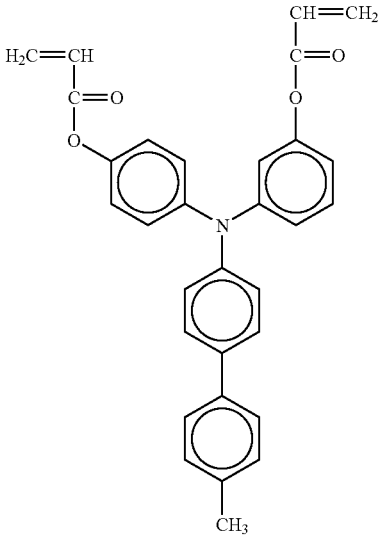
No 221
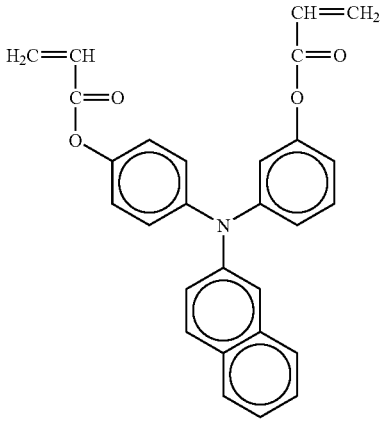
No 222
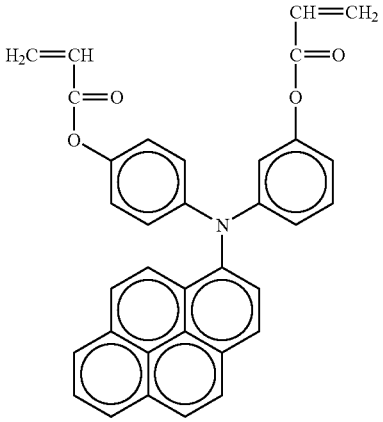
No 223
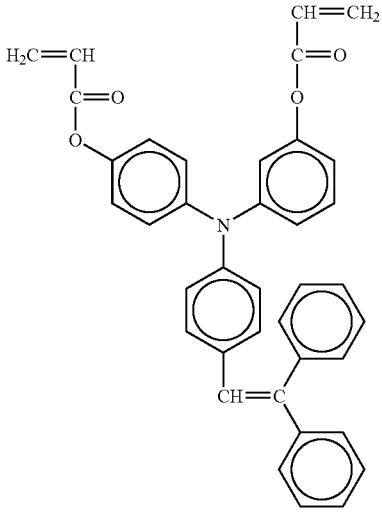

-continued
No 224
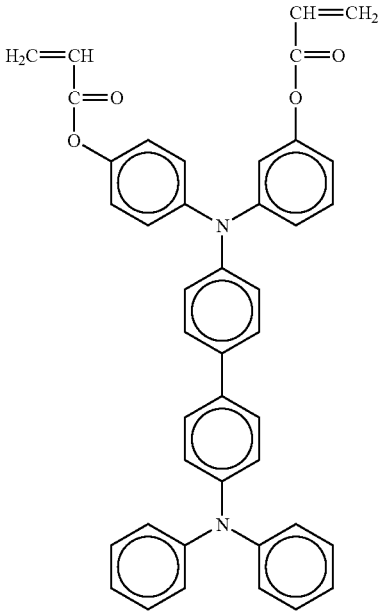
No 225
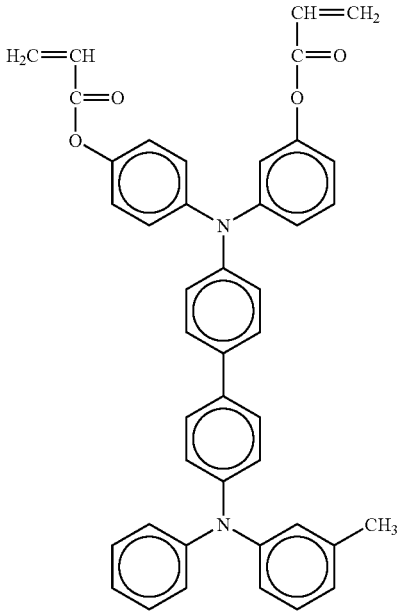
No 226
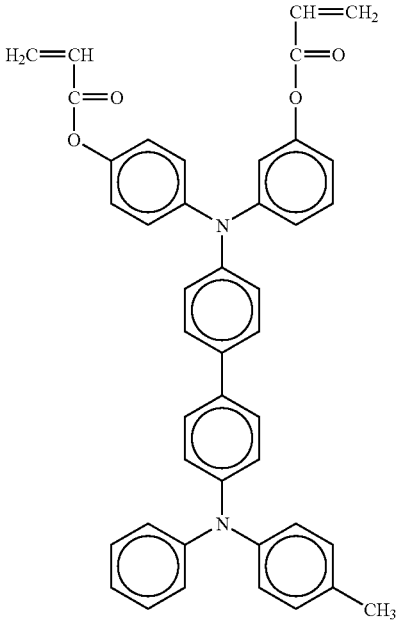
No 227
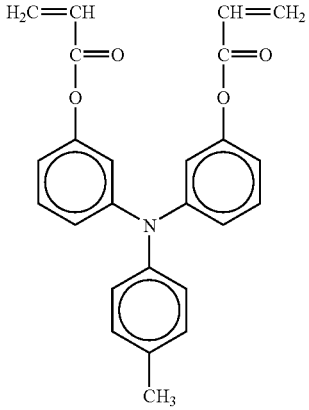
No 228
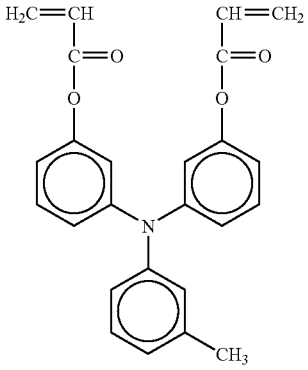
No 229
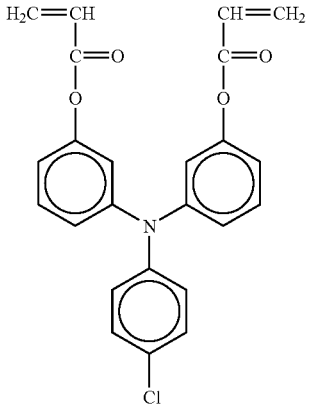

-continued
No 230
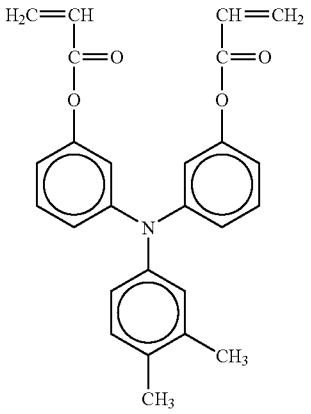
No 231
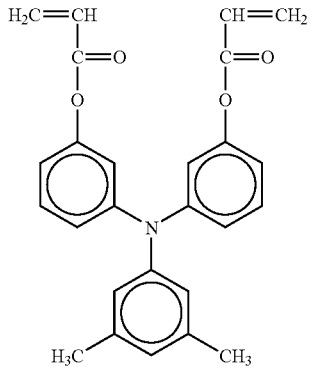
No 232
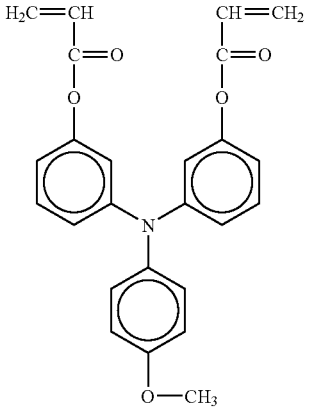
No 233
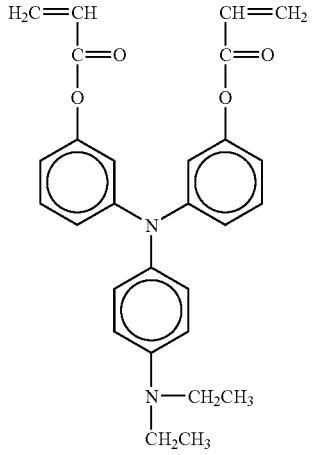
No 234
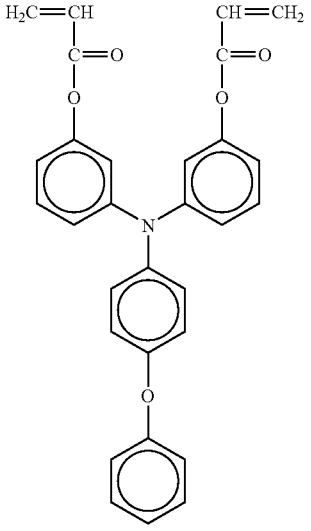
No 235
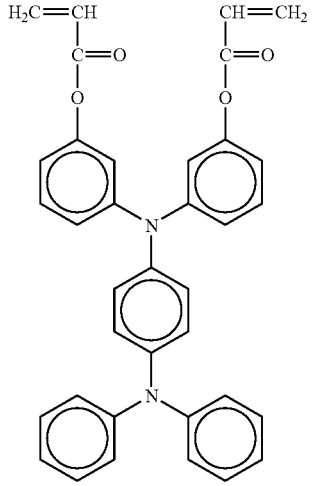

-continued
No 236
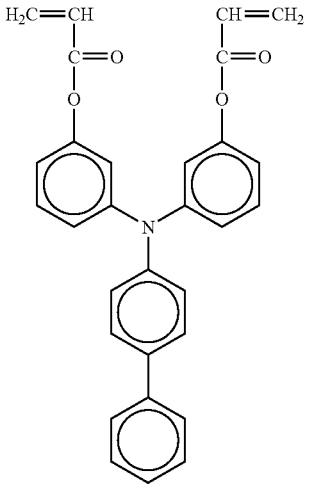
No 237
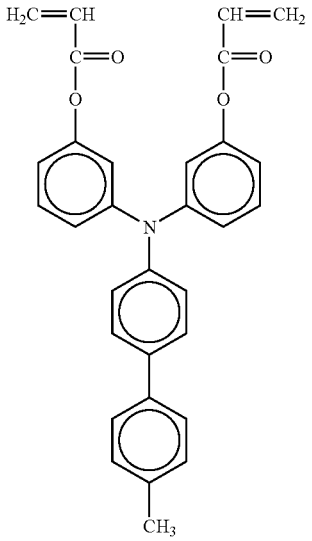
No 238
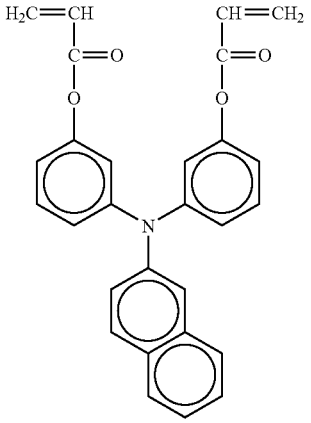
No 239
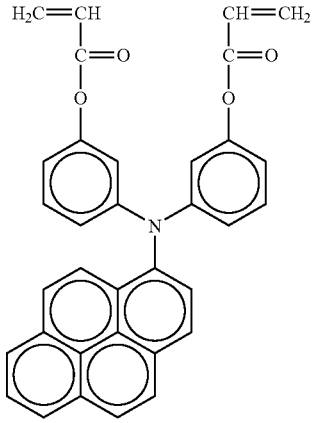
No 240
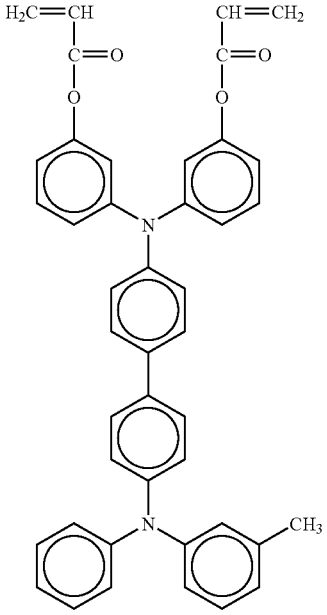
No 241
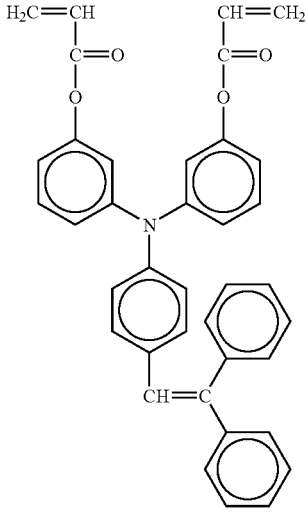

-continued
No 242
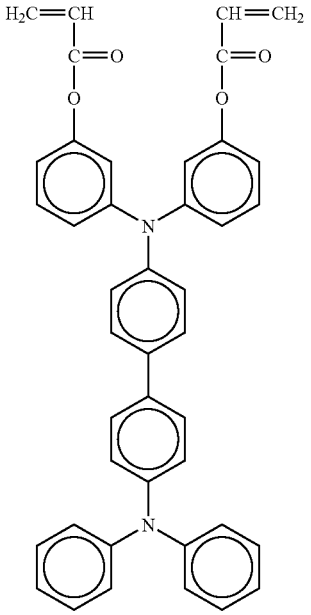
No 243
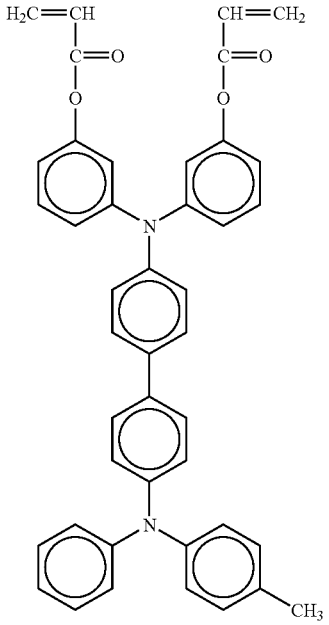
No 244
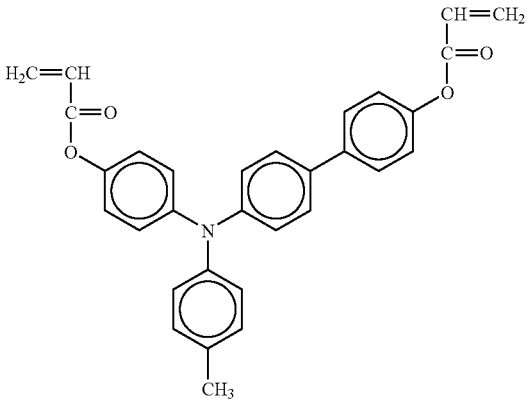
No 245
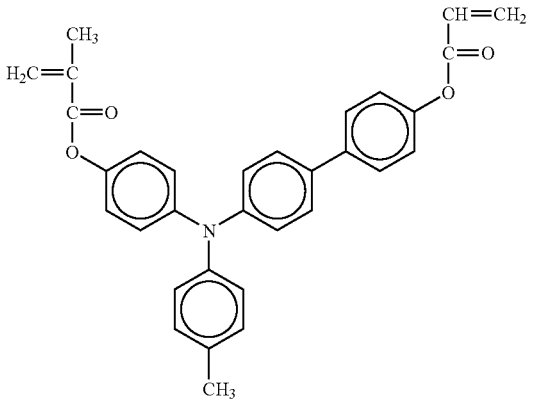
No 246
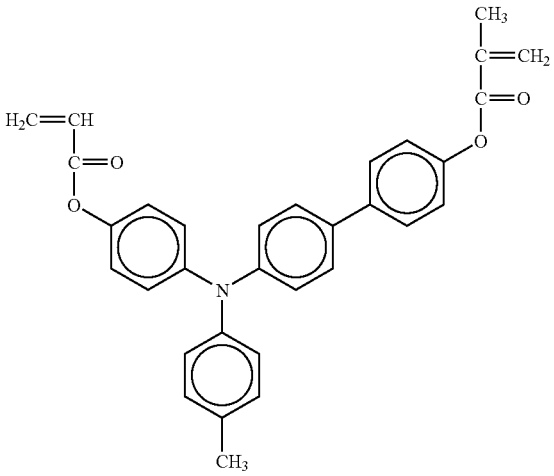
No 247
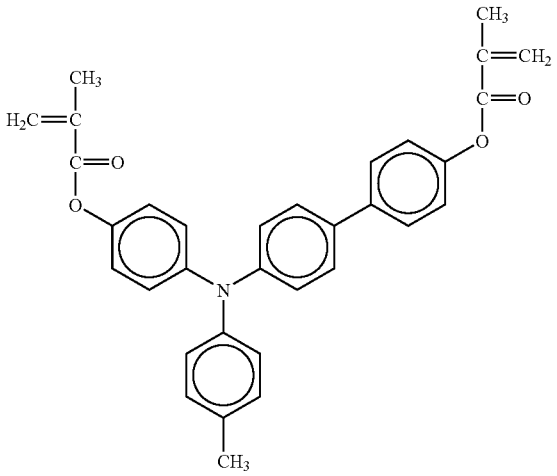

-continued
No 248
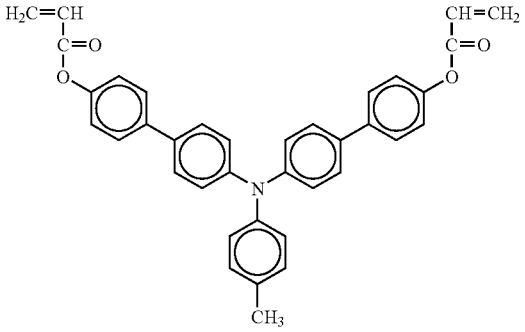
No 249
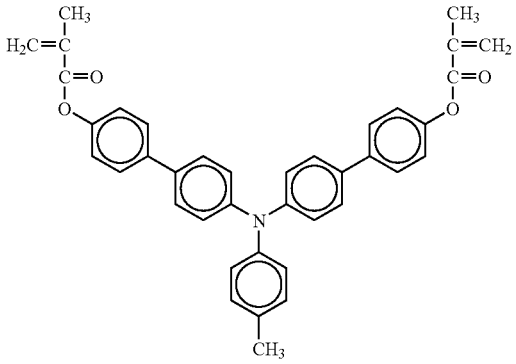
No 250
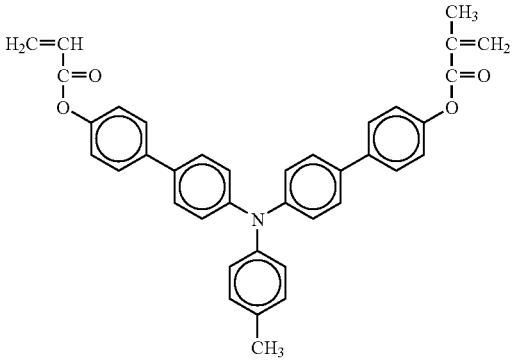
No 251
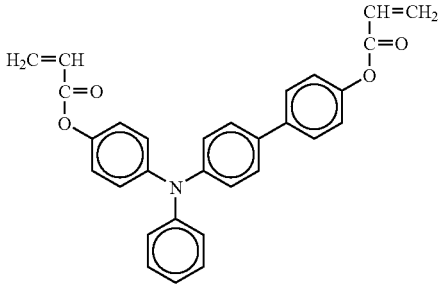
No 252
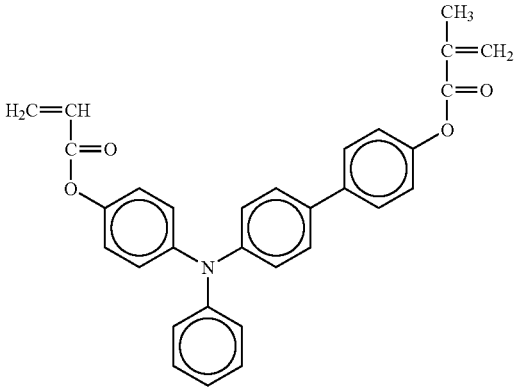
No 253
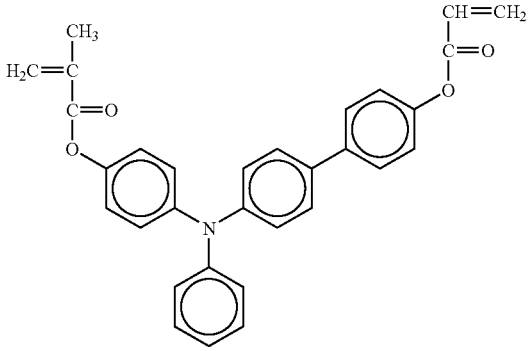
No 254
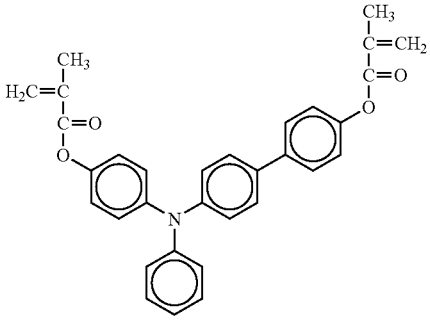
No 255
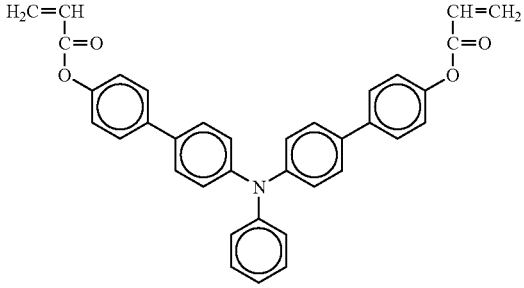

-continued
No 256
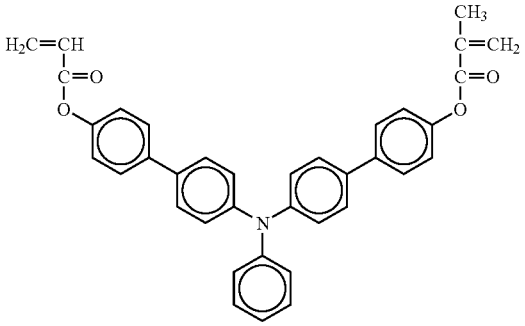
No 257
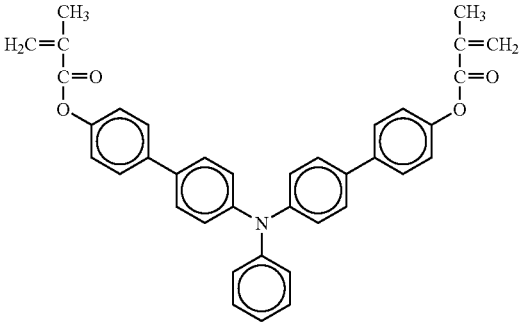
No 258
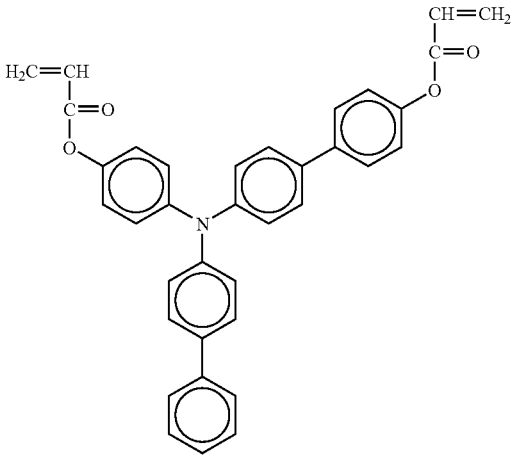
No 259
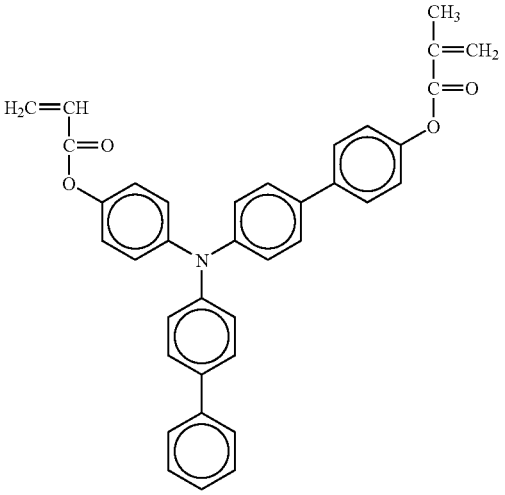
No 260
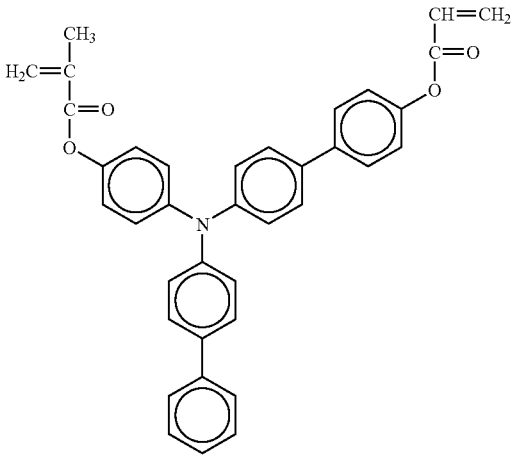
No 261
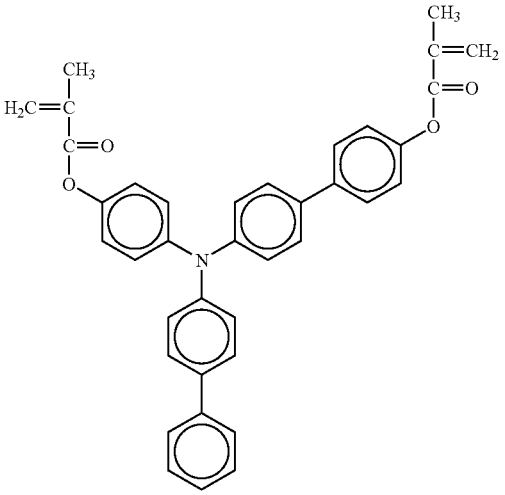

-continued
No 262
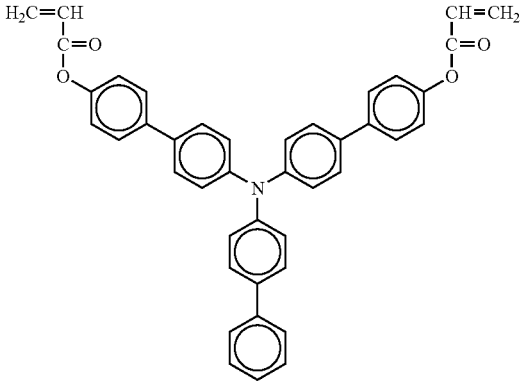
No 263
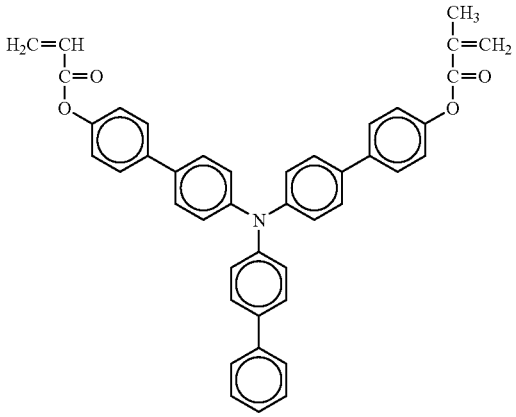
No 264
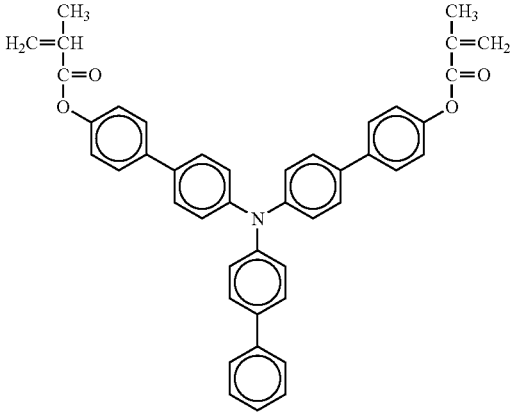
No 265
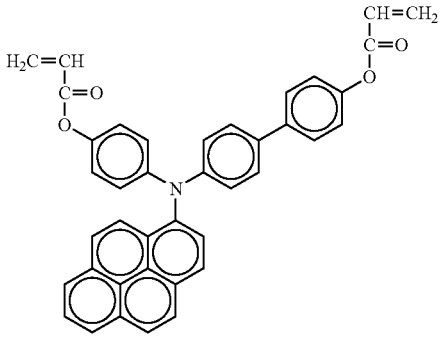
No 266
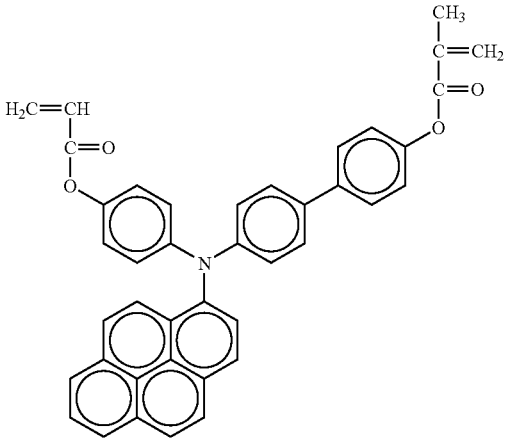
No 267
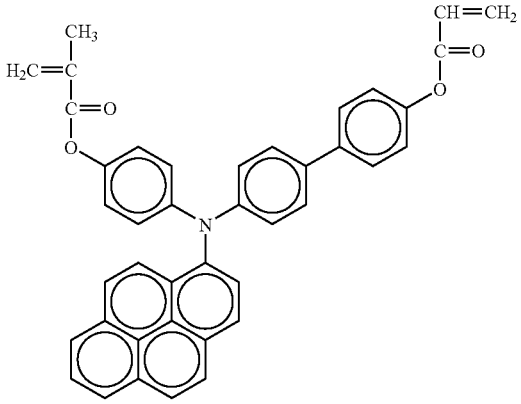

-continued
No 268
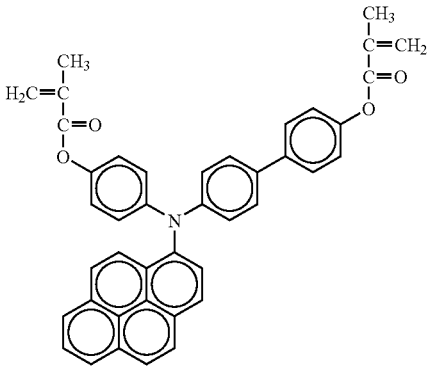
No 269
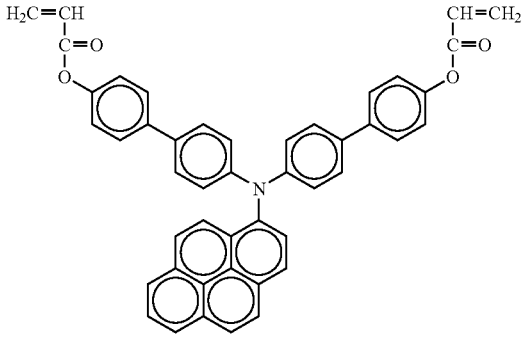
No 270
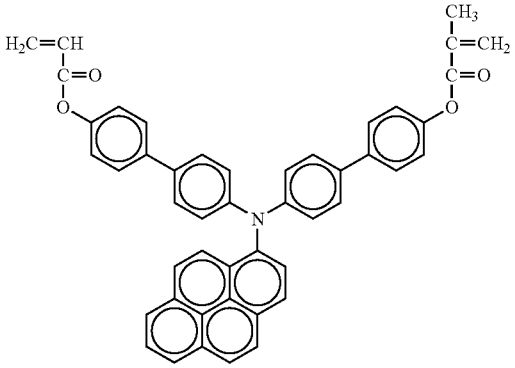
No 271
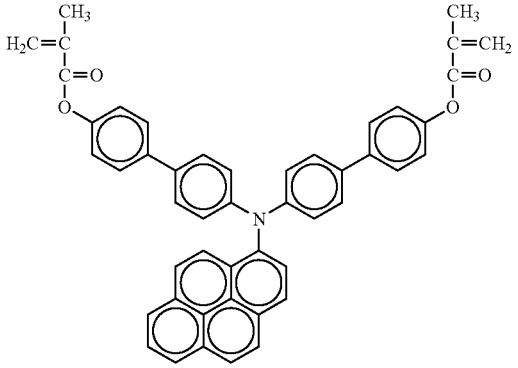
No 272
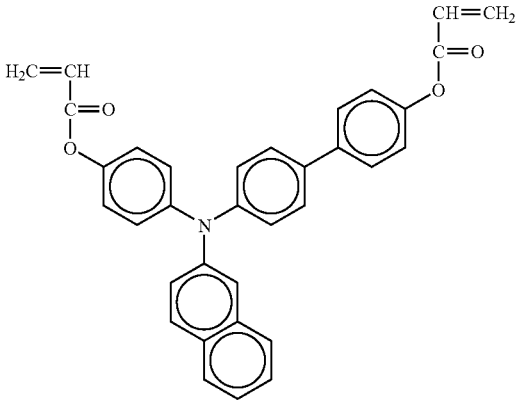
No 273
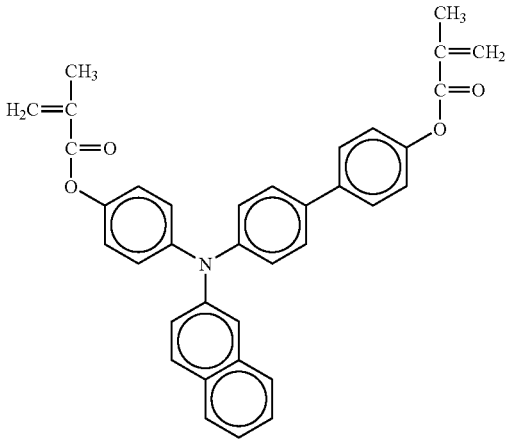

-continued
No 274
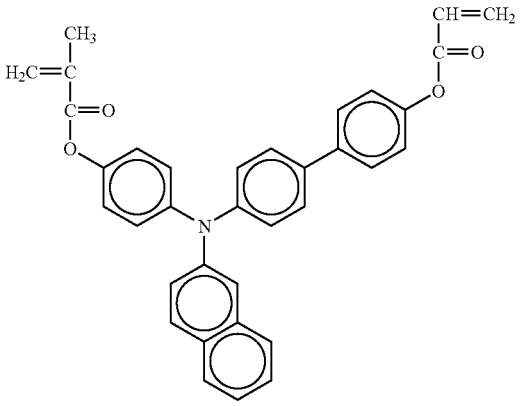
No 275
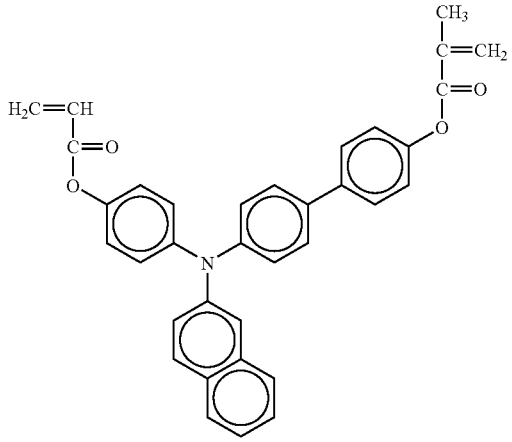
No 276
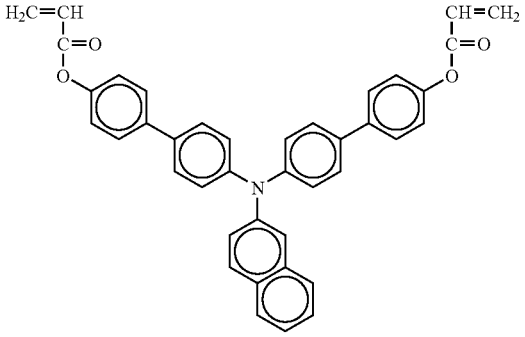
No 277
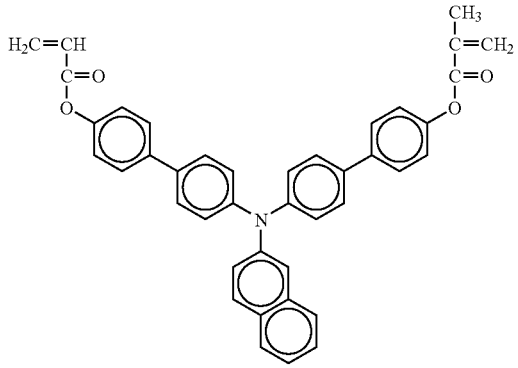
No 278
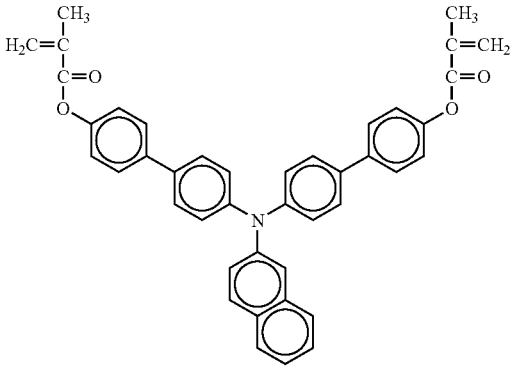
No 279
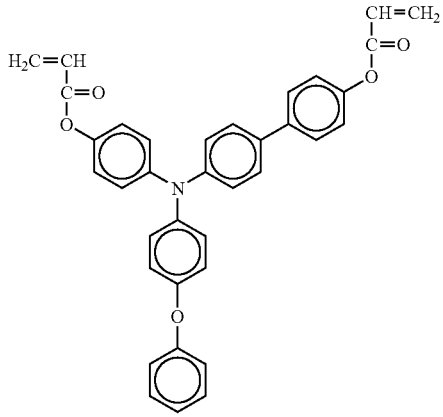

-continued
No 280
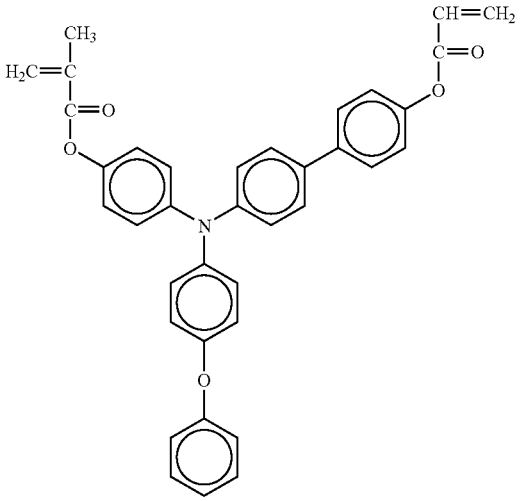
No 281
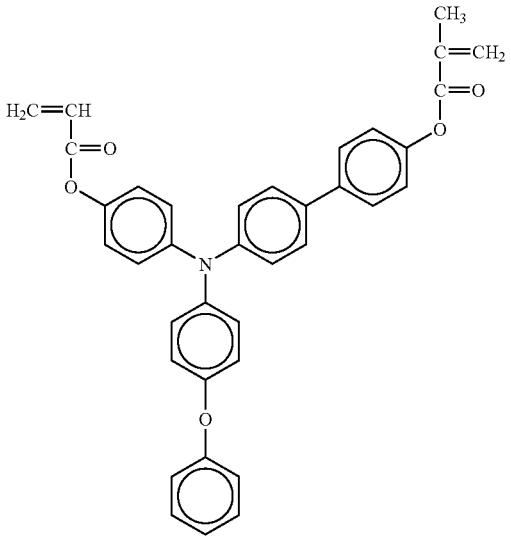
No 282
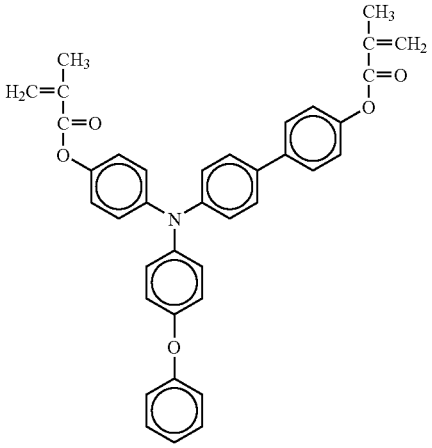
No 283
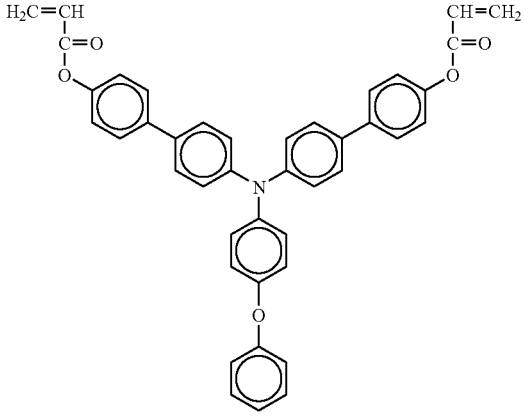
No 284
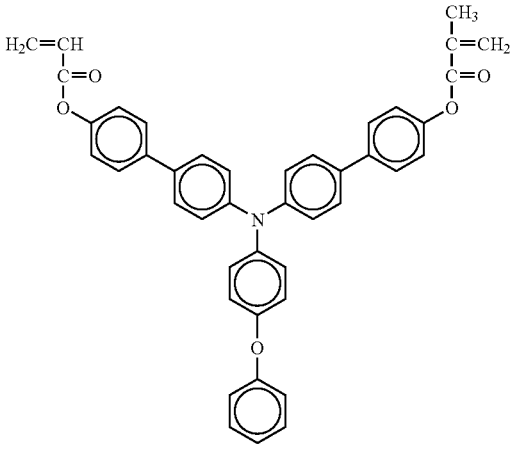
No 285
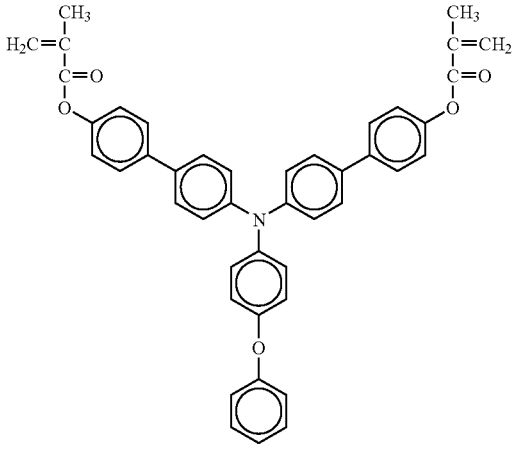

-continued
No 286
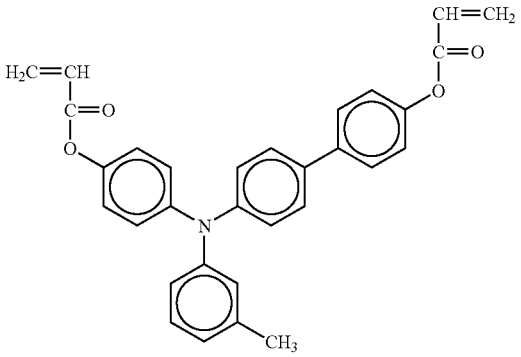
No 287
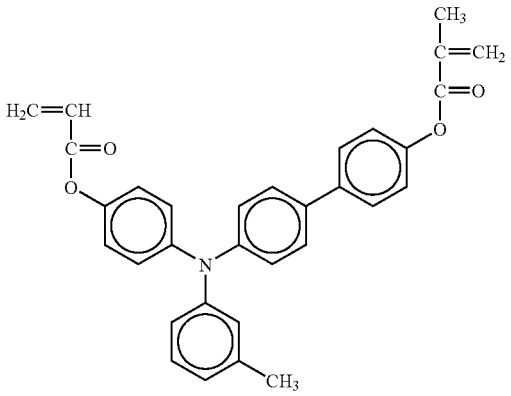
No 288
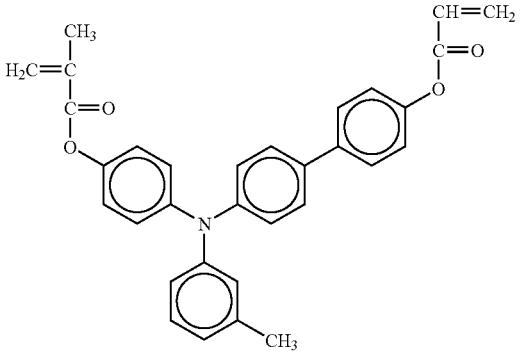
No 289
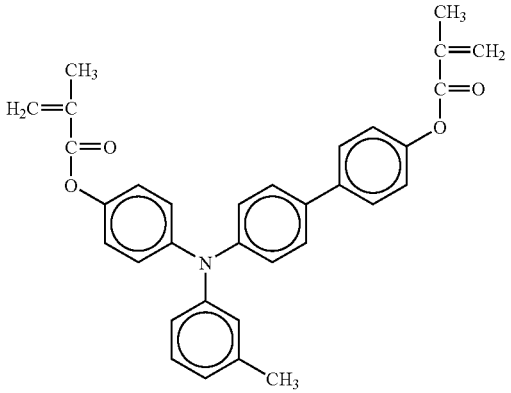
No 290
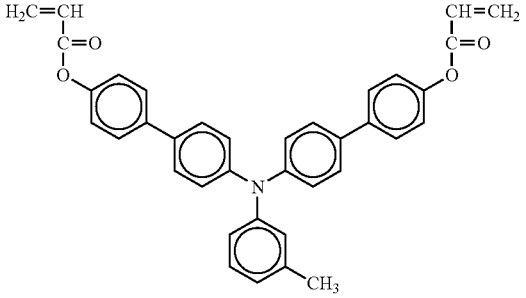
No 291
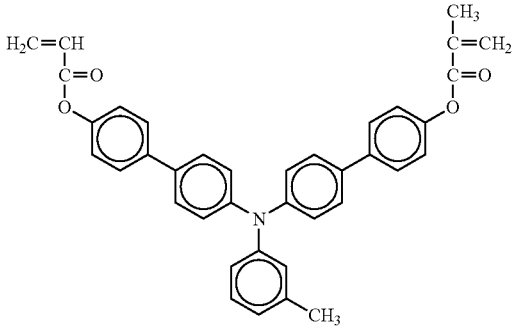
No 292
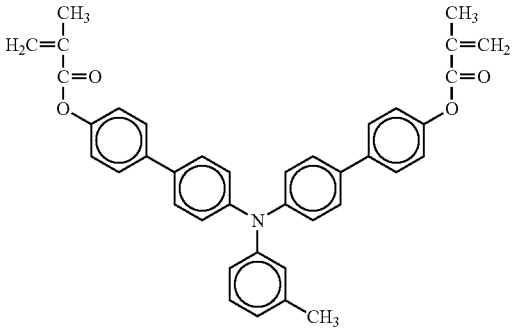
No 293
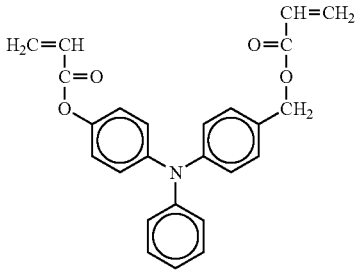

-continued
No 294
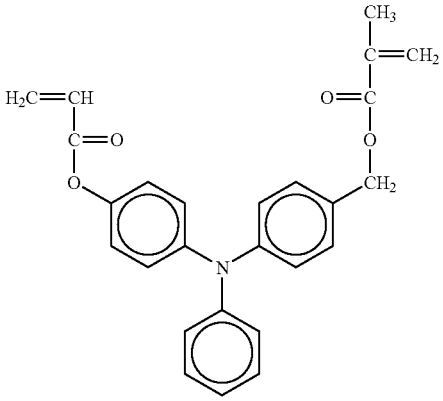
No 295
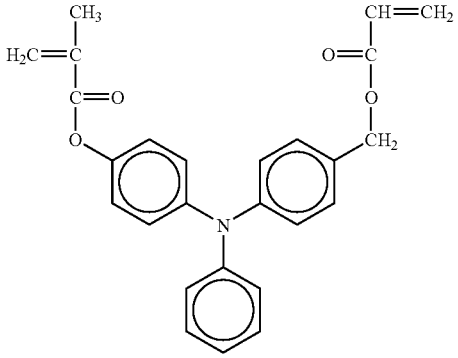
No 296
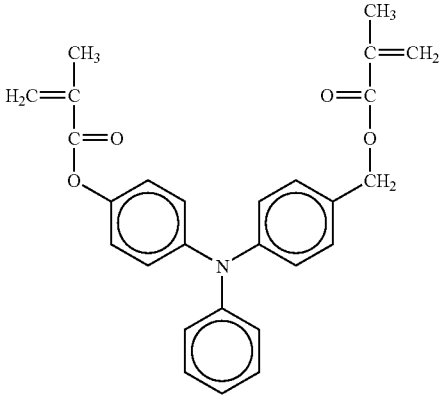
No 297
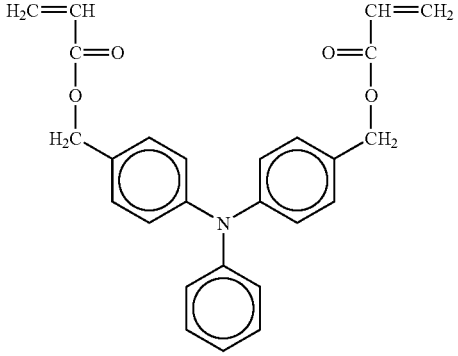
No 298
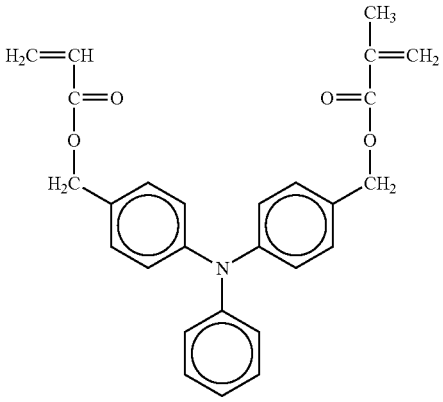
No 299
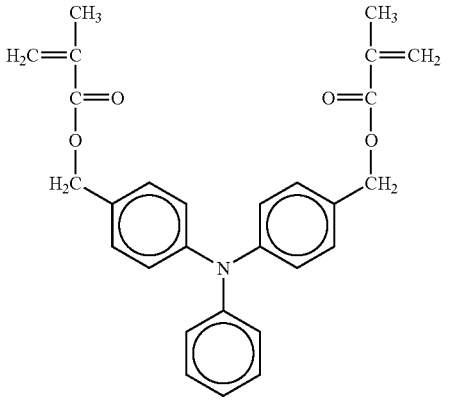
No 300
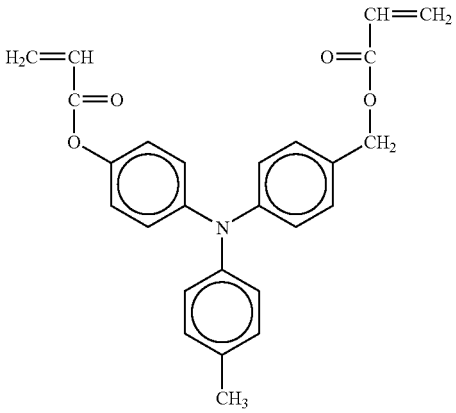
No 301
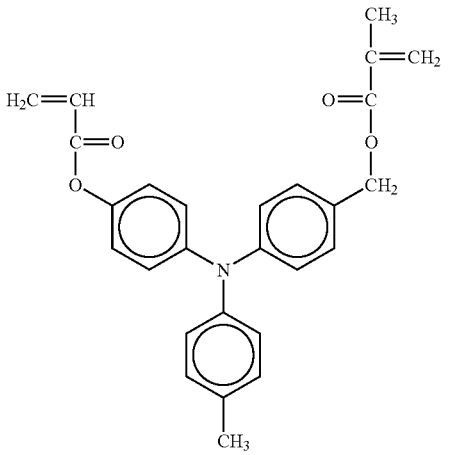

-continued
No 302
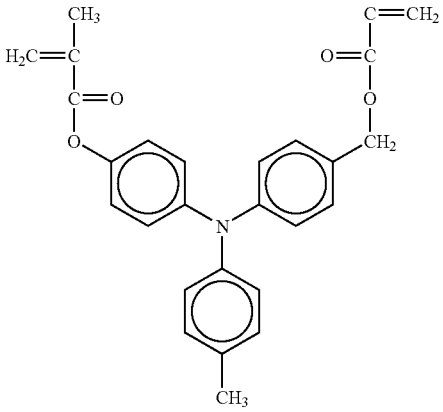
No 303
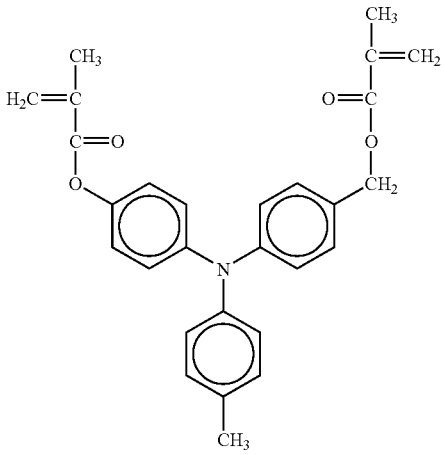
No 304
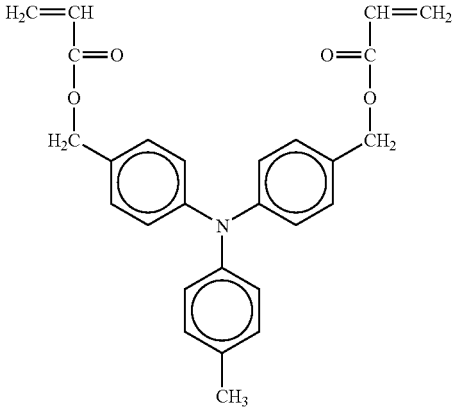
No 305
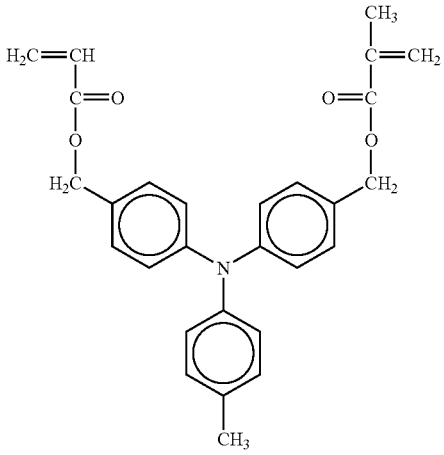
No 306
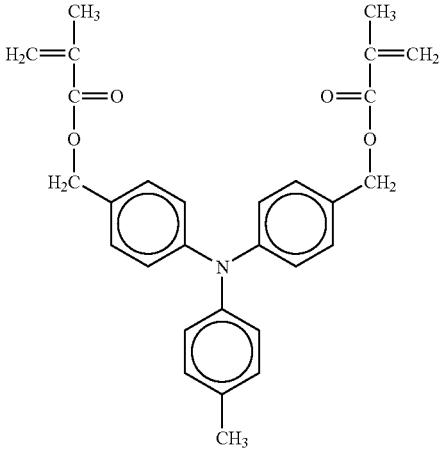
No 307
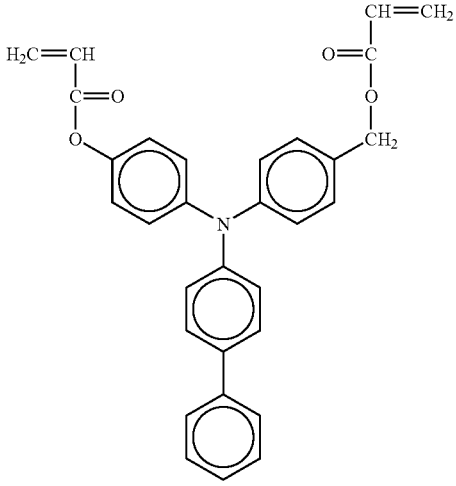

-continued
No 308
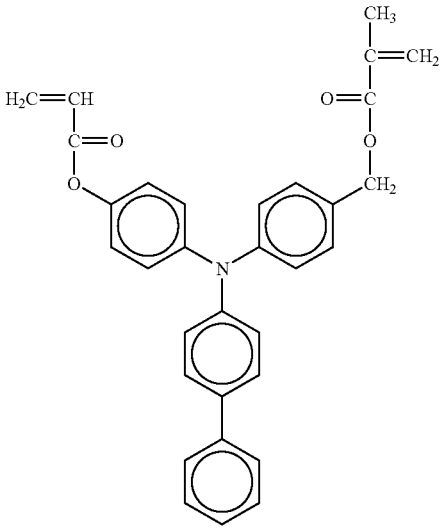
No 309
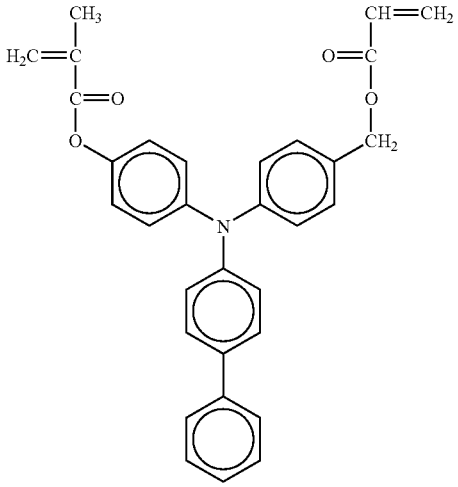
No 310
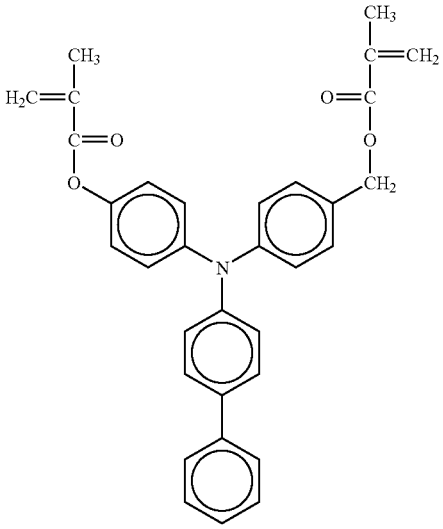
No 311
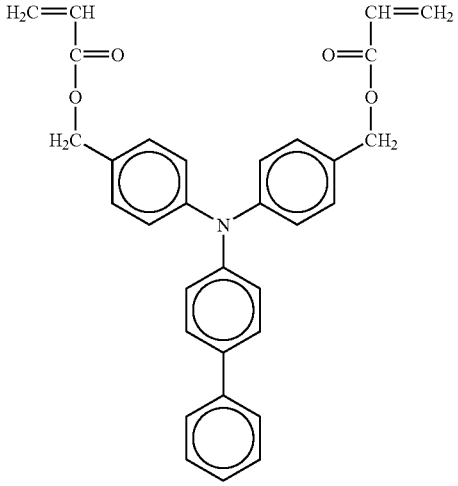
No 312
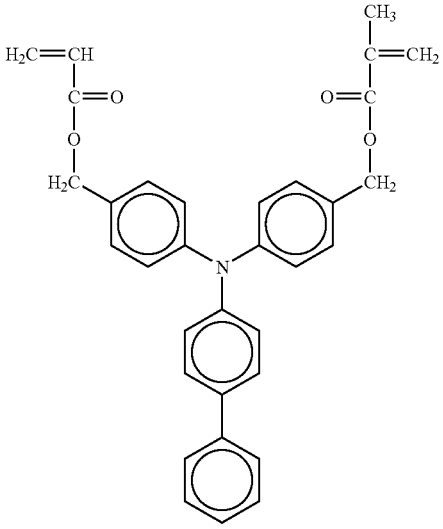
No 313
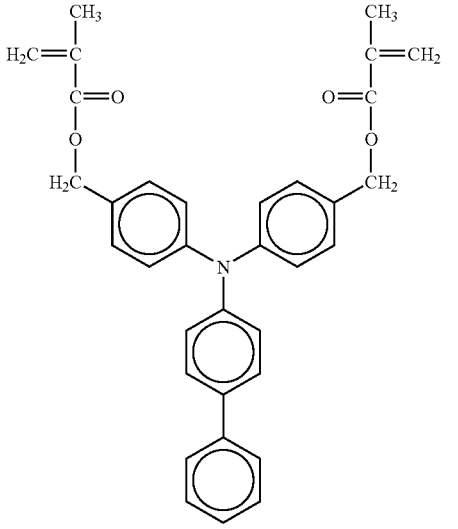

-continued
No 314
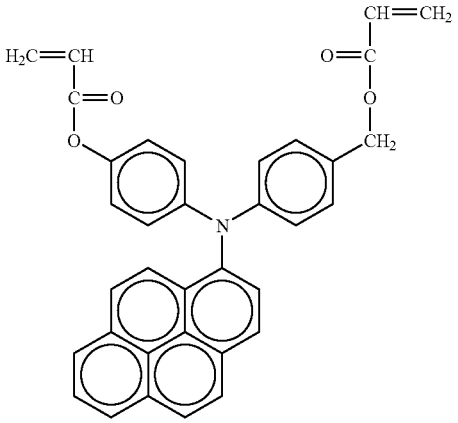
No 315
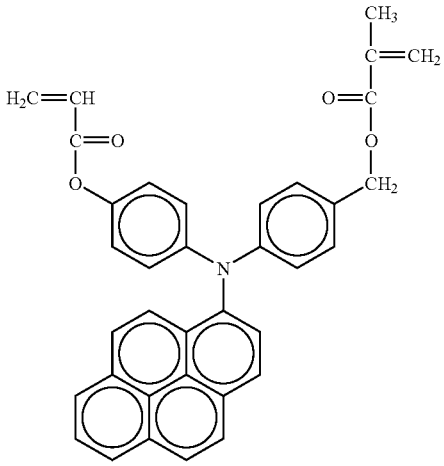
No 316
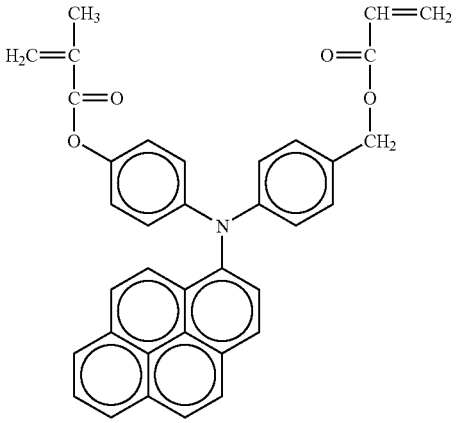
No 317
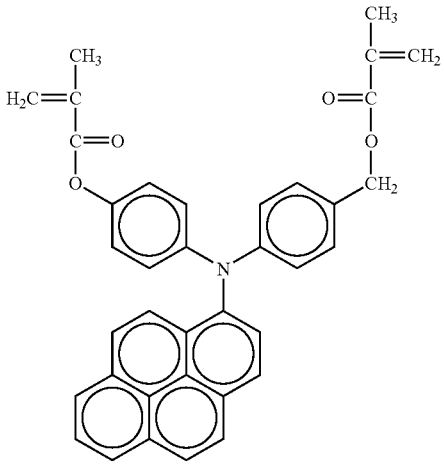
No 318
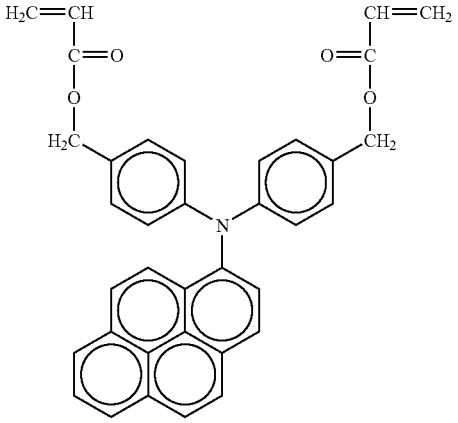
No 319
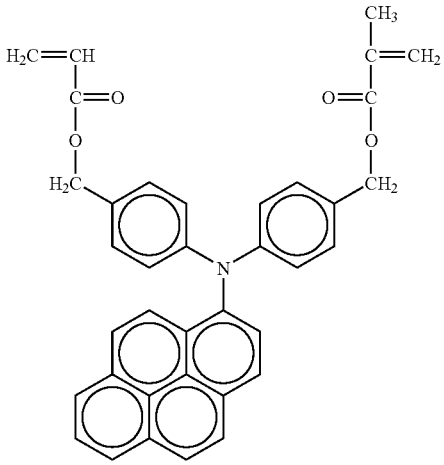

-continued
No 320
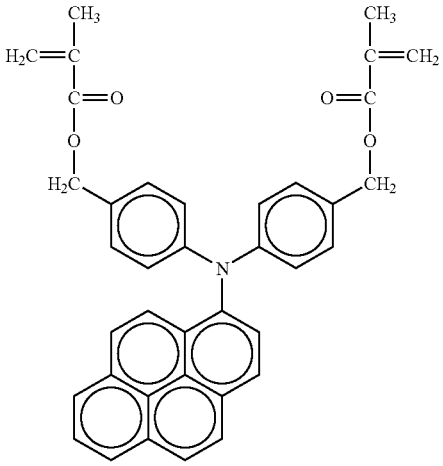
No 321
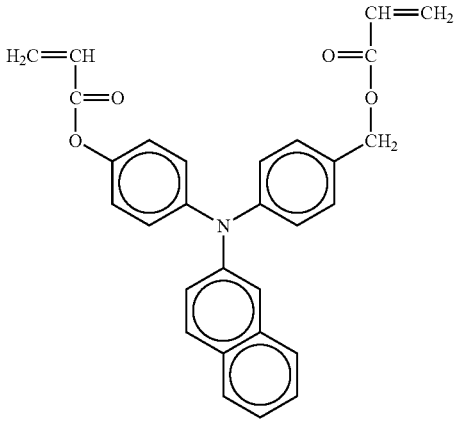
No 322
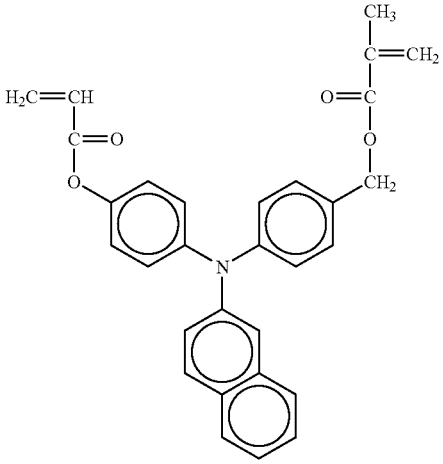
No 323
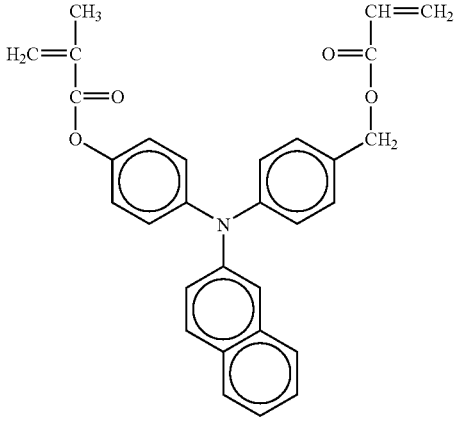
No 324
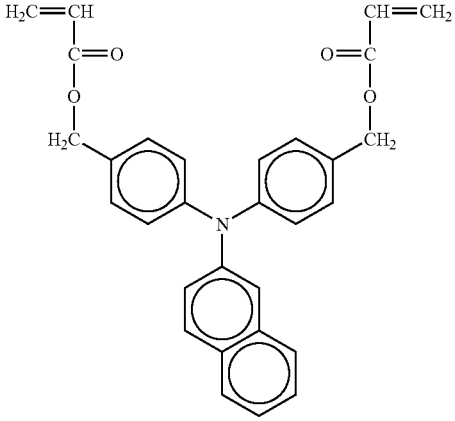
No 325
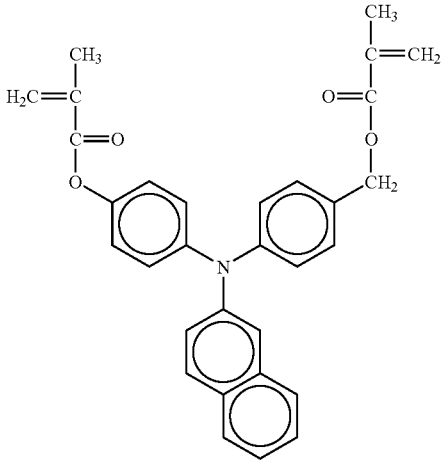

-continued
No 326
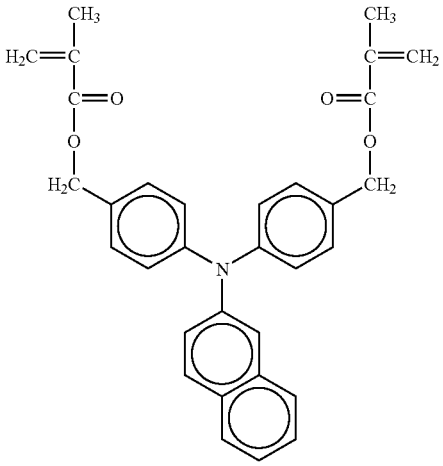
No 327
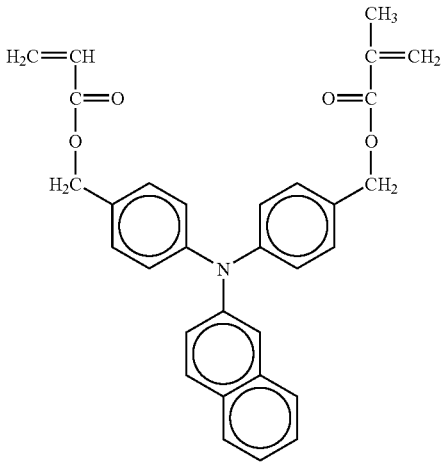
No 328
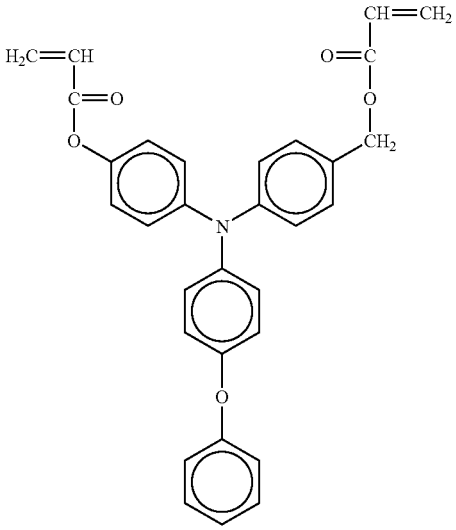
No 329
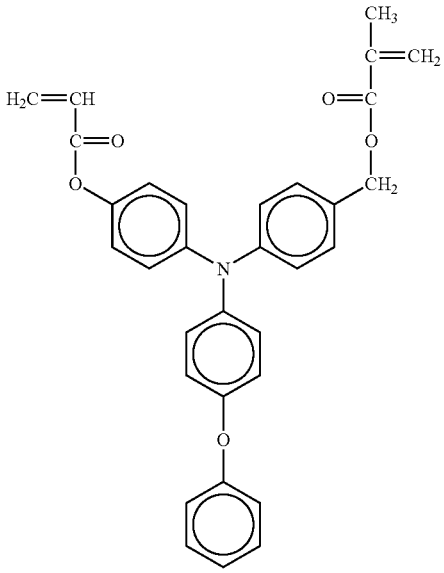
No 330
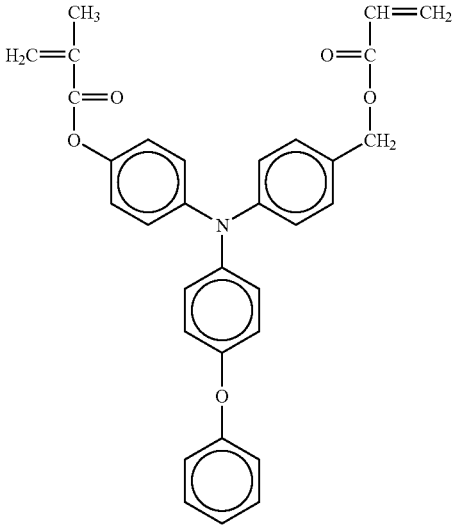
No 331
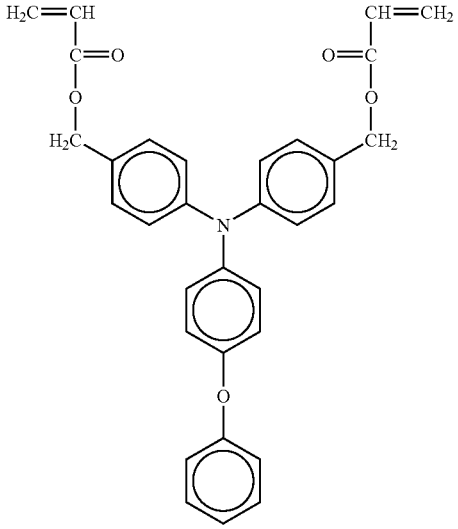

-continued
No 332
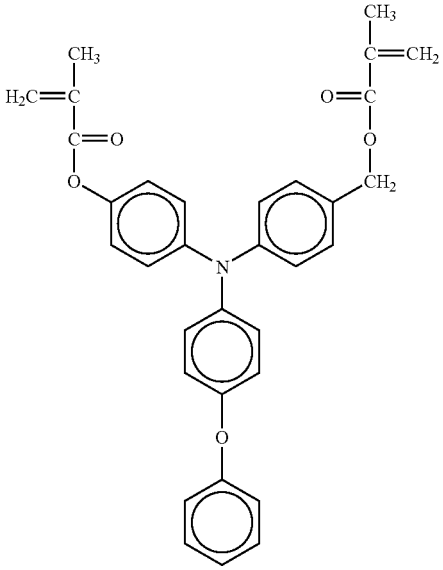
No 333
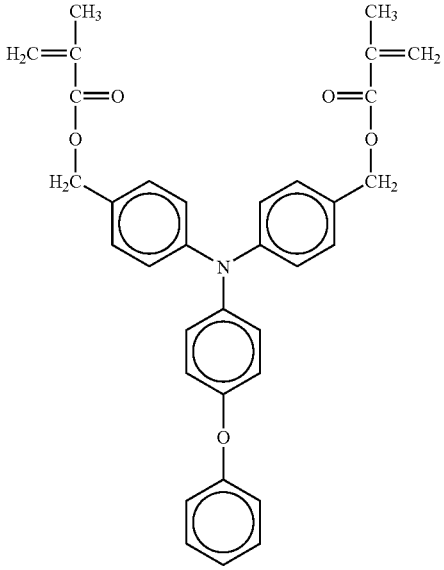
No 334
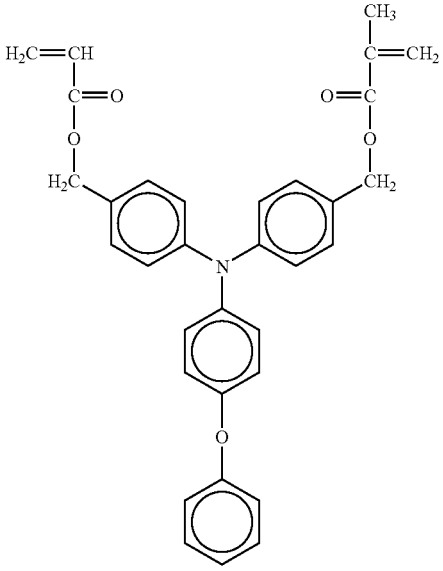
No 335
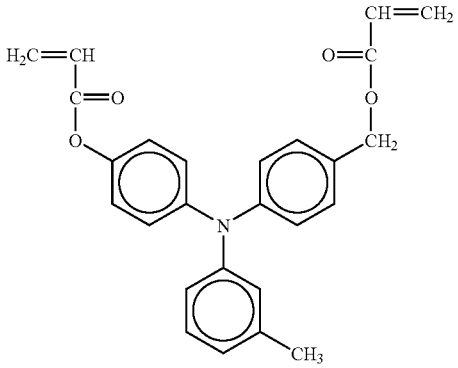
No 336
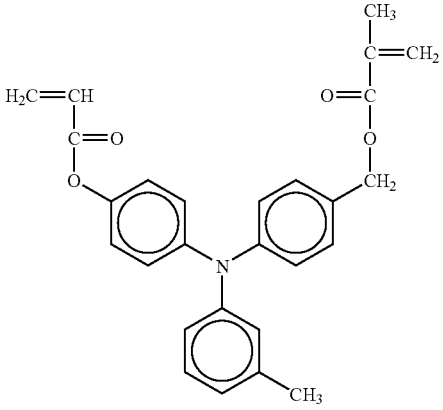
No 337
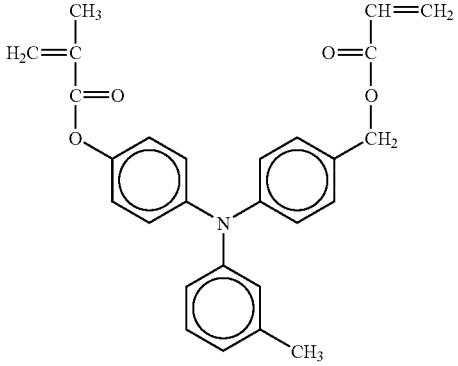

-continued
No 338
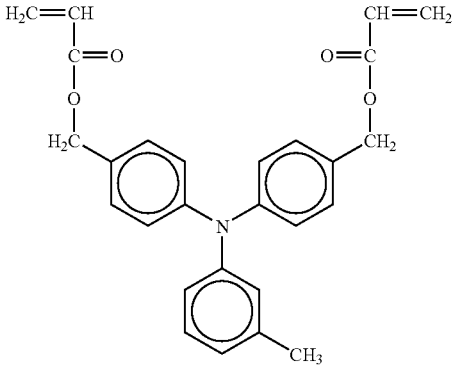
No 339
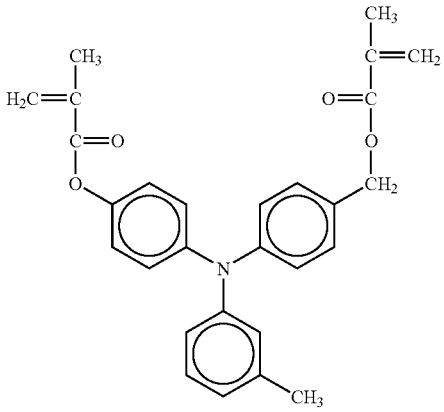
No 340
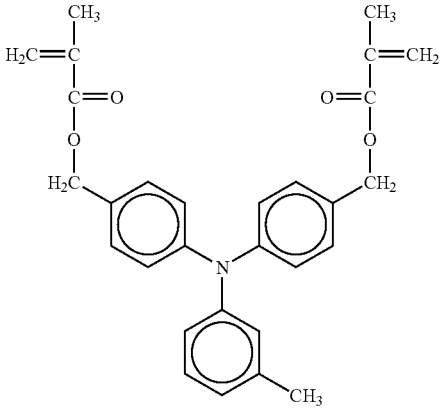
No 341
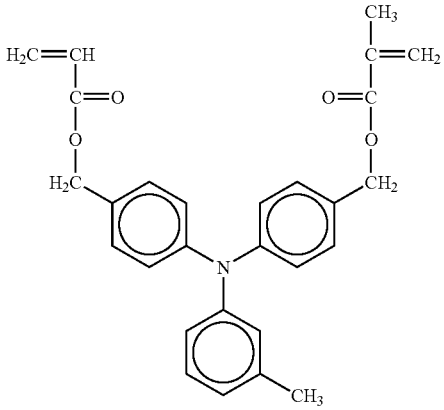
No 342
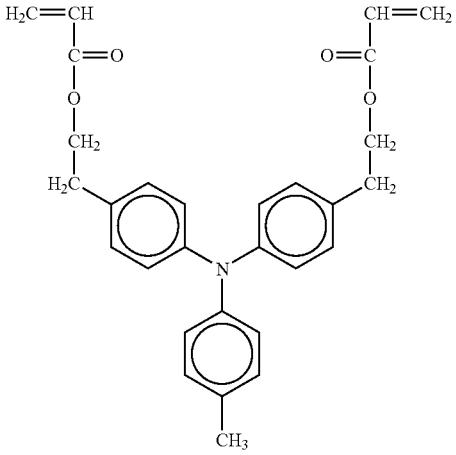
No 343
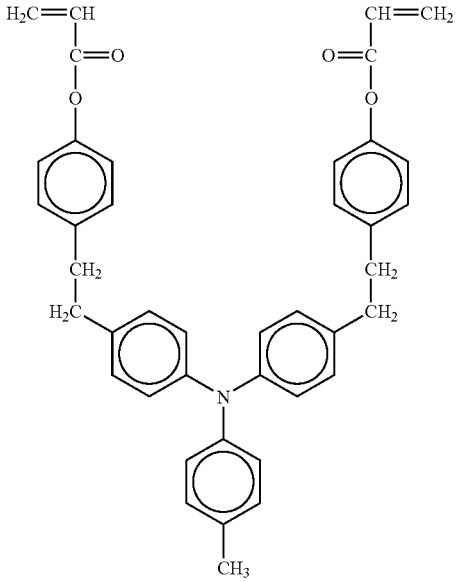

-continued
No 344
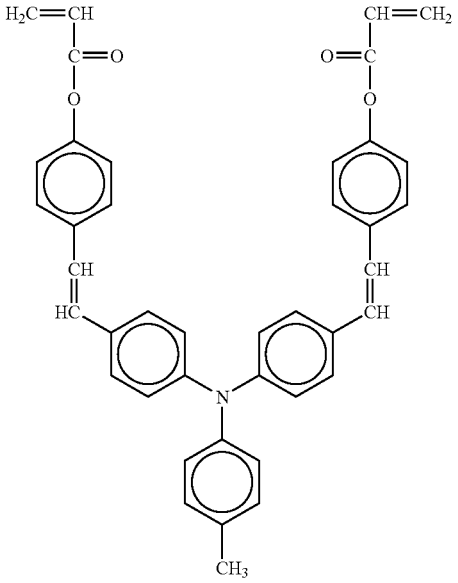
No 345
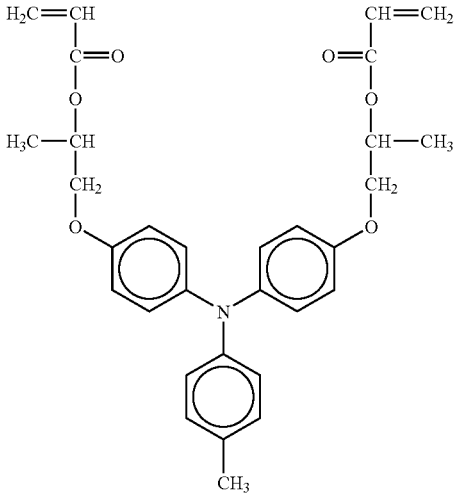
No 346
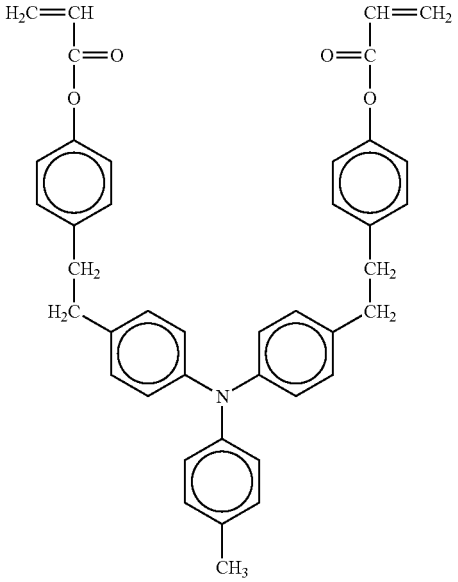
No 347
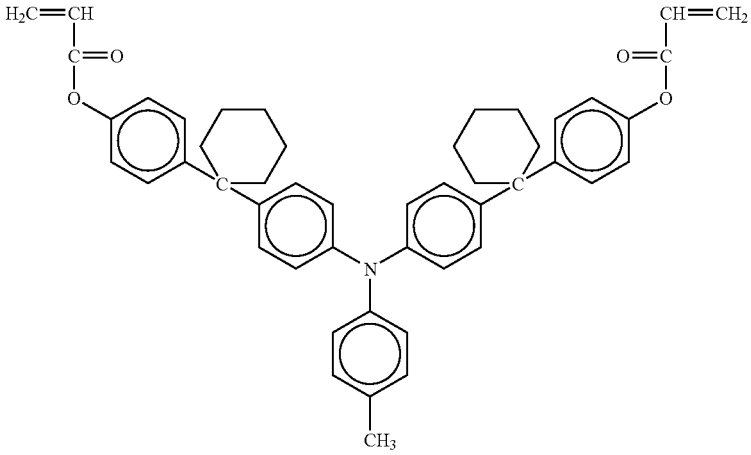

-continued
No 348
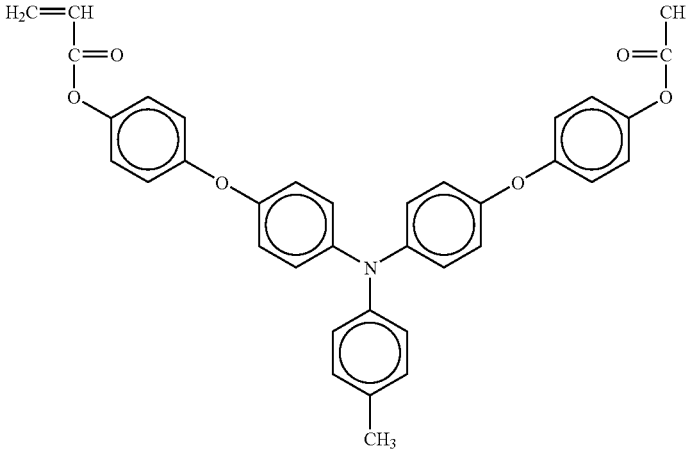
No 349
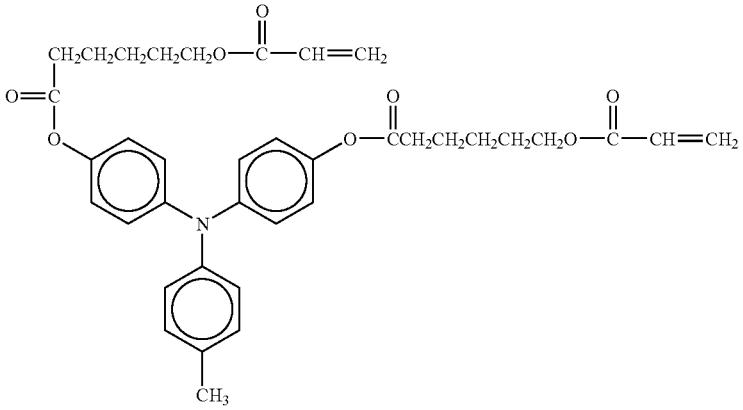
No 350
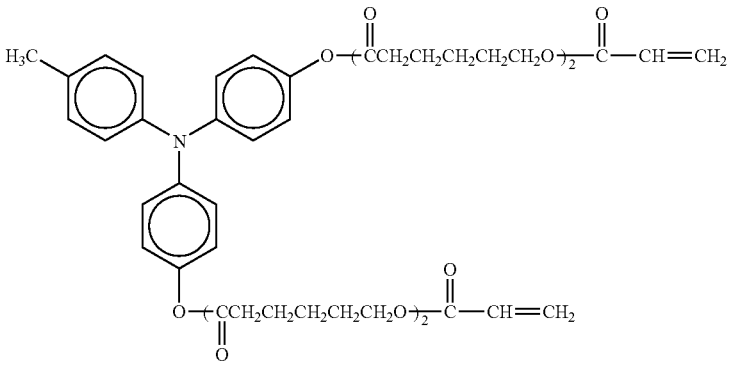

-continued
No 351
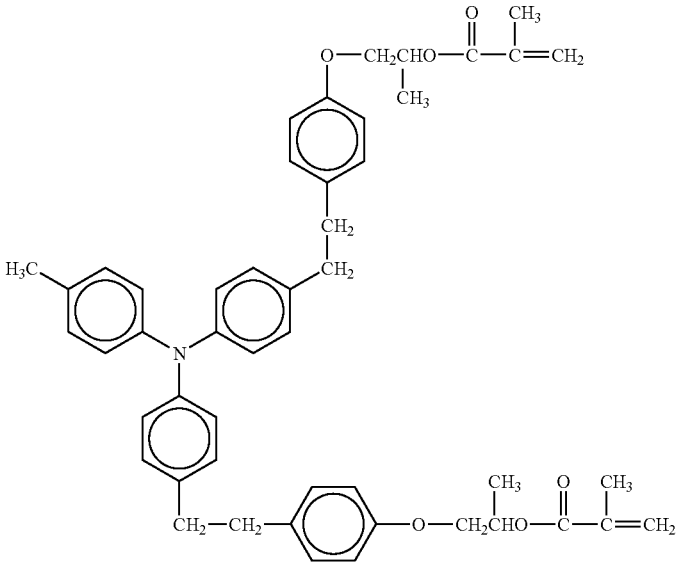
No 352
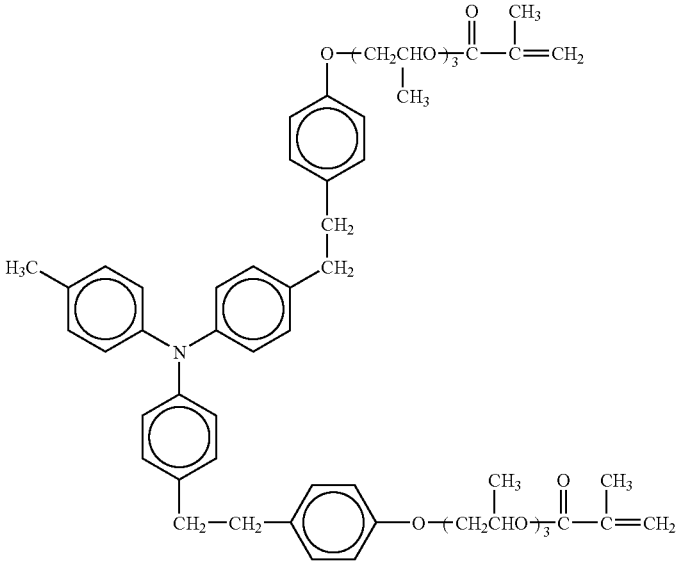
No 353
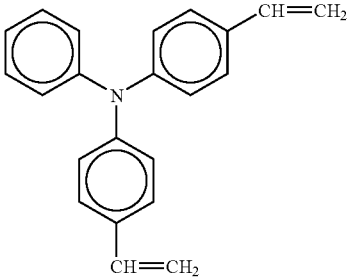
No 354
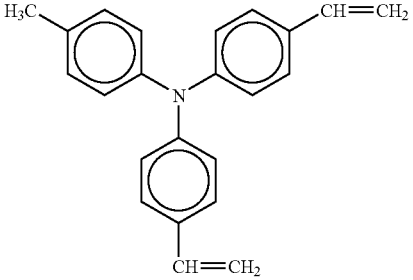

-continued
No 355
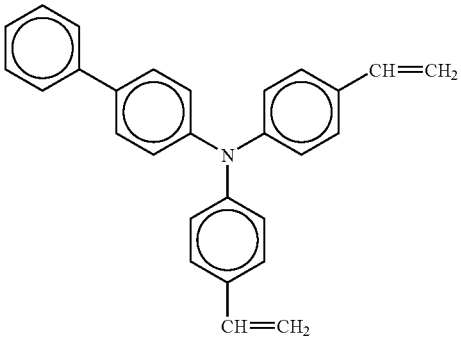
No 356
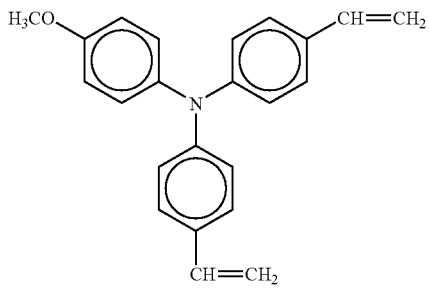
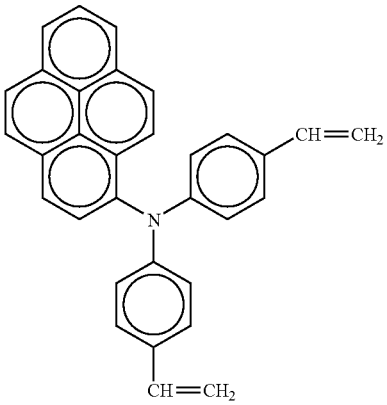
No 359
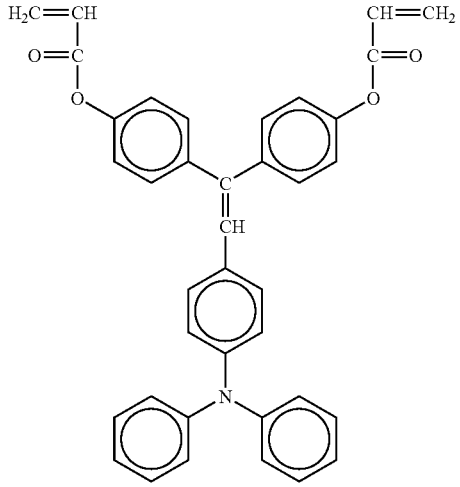
No 360
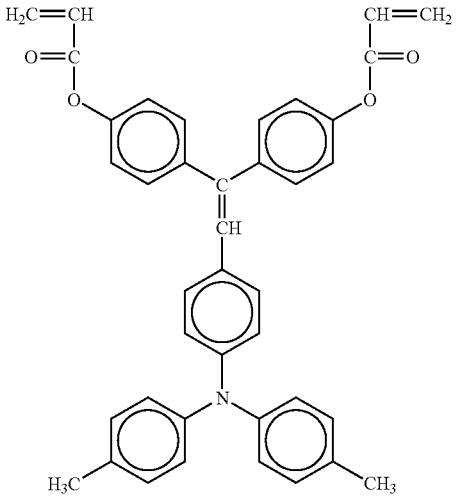
No 361
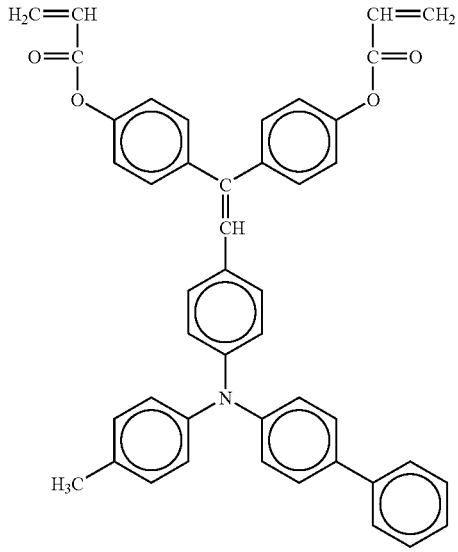

-continued
No 362
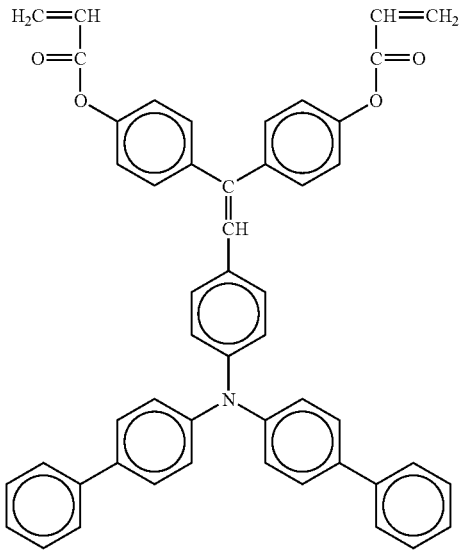
No 363
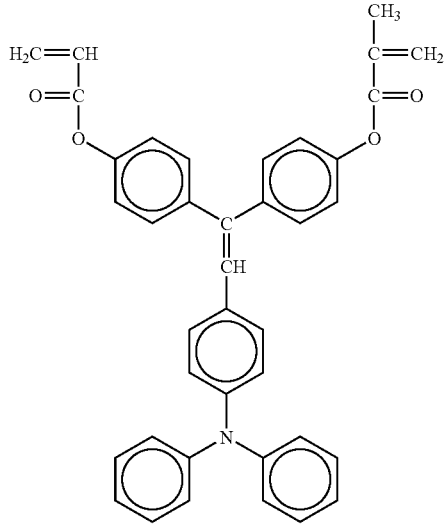
$CH{=}CH_2$
Specific examples of the radically polymerizable trifunctional monomers (B') having a charge transport structure are as follows, but are not limited thereto.
No 364
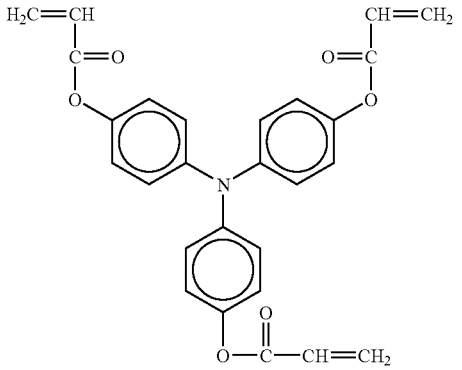
No 365
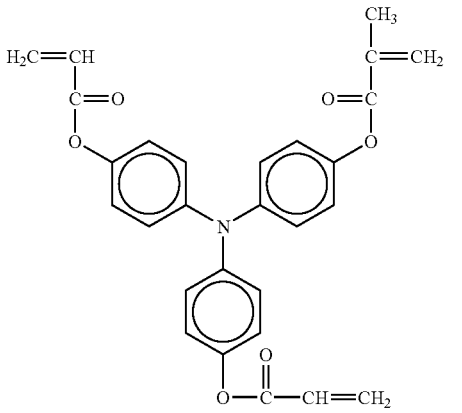
-continued
No 366
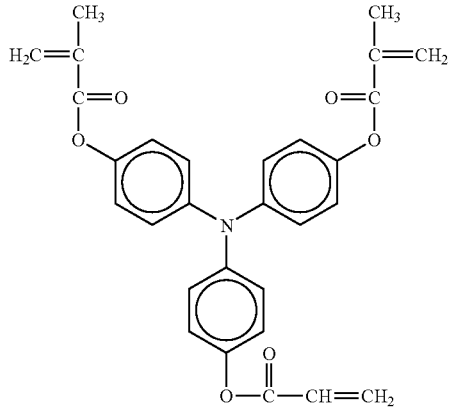
No 367
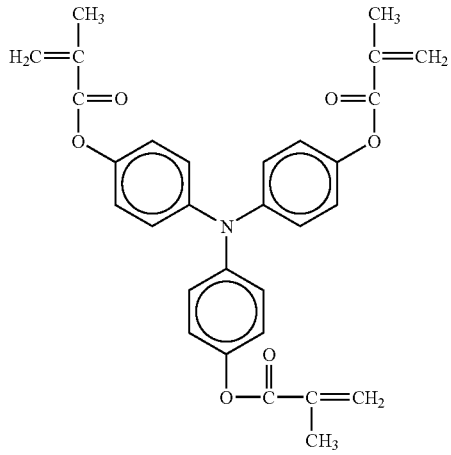

-continued
No 368
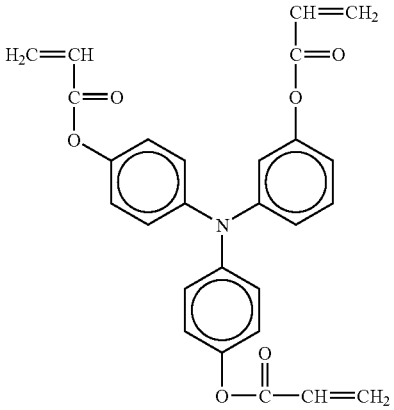
No 369
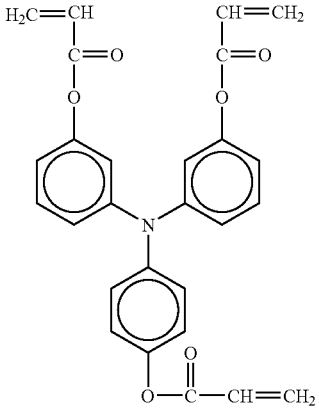
No 370
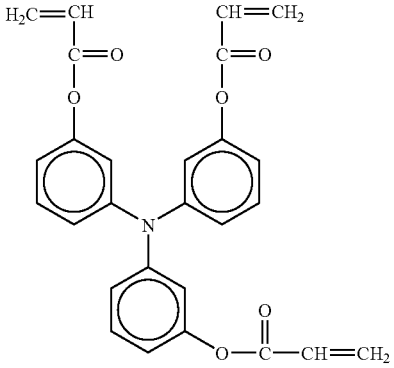
No 371
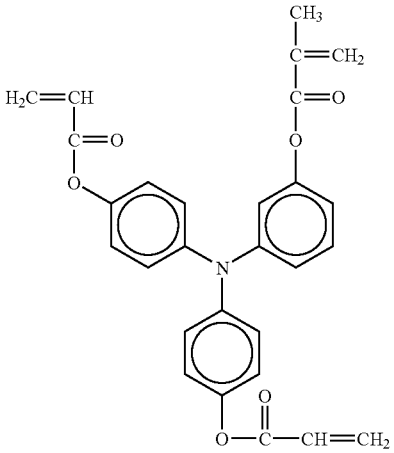
-continued
No 372
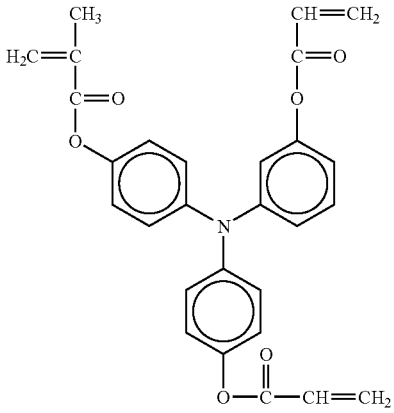
No 373
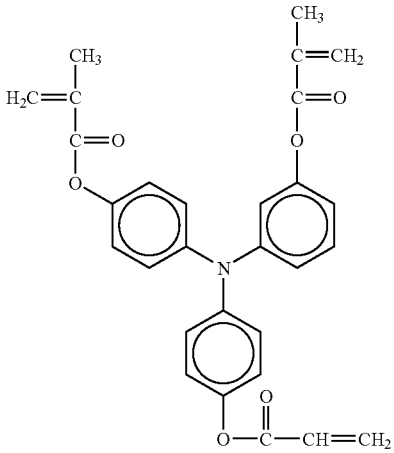
No 374
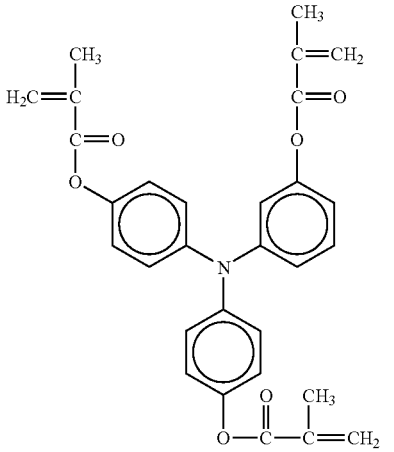

-continued
No 375
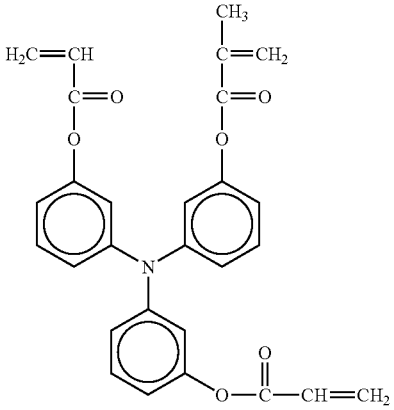
No 376
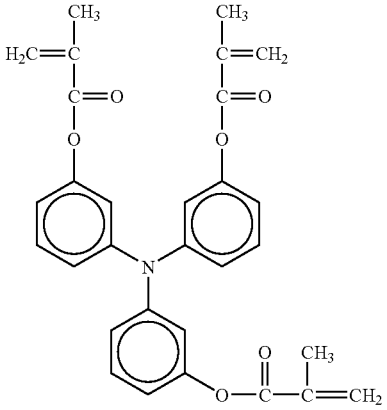
No 377
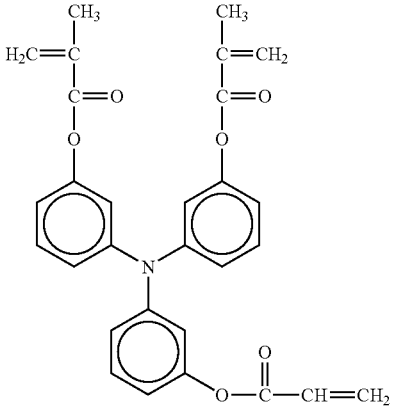
No 378
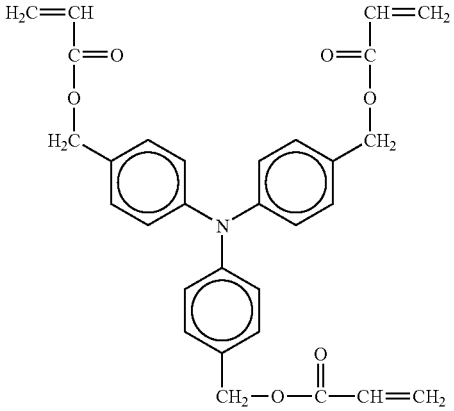
-continued
No 379
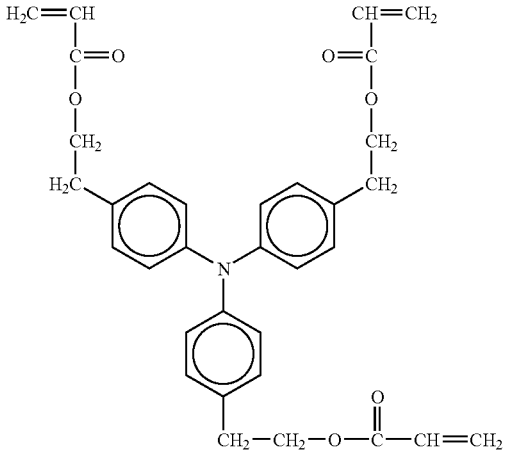
No 380
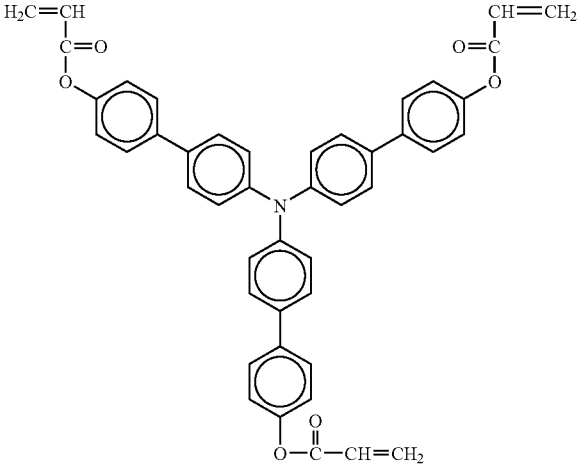
No 381
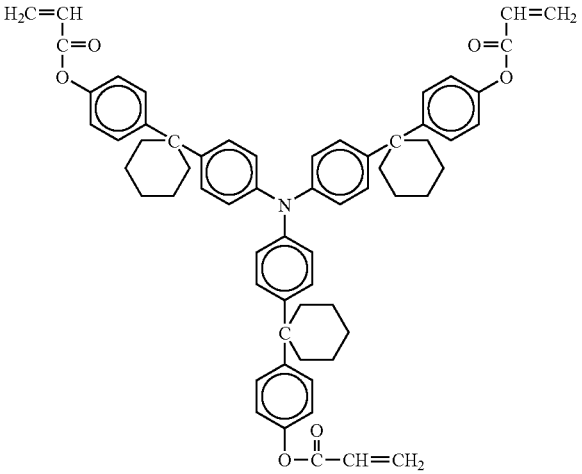

-continued

No 382

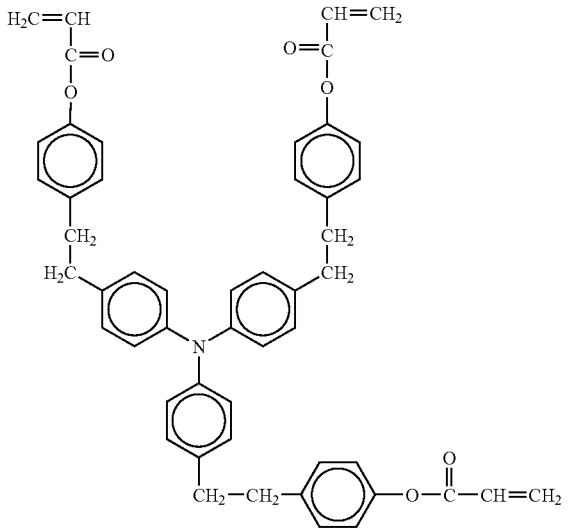

No 383

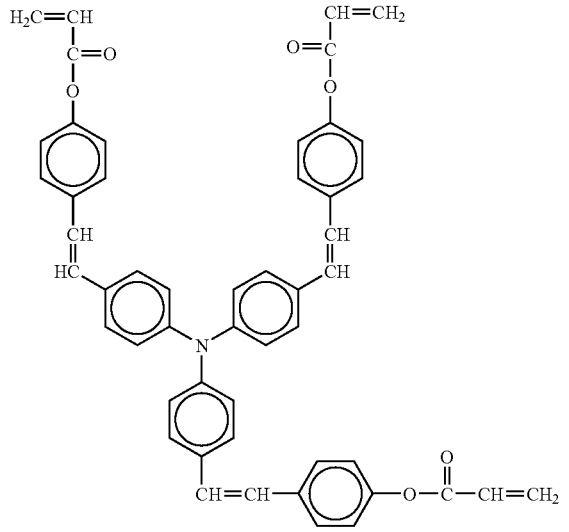

No 358

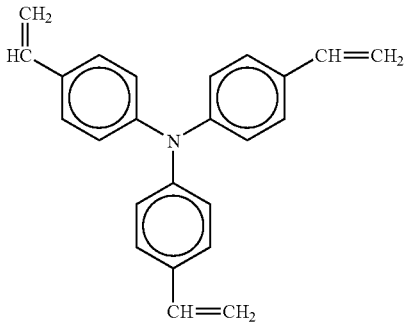

Specific examples of the compounds having two or more functional groups are also disclosed in JP-A 2000-66425.

The radically polymerizable monomers (B') having a charge transport structure are used for imparting a charge transport property to the outermost layer. The content of the units obtained from radically polymerizable monomers (B') in the outermost layer is generally from 20 to 80% by weight, and preferably from 30 to 70% by weight. When the content is too low, the resultant outermost layer has insufficient charge transport property, resulting in deterioration of the electric properties (such as photosensitivity and residual potential) of the photoreceptor after repeated use. In contrast, when the content is too high, the content of the units obtained from radically polymerizable tri- or more-functional monomers (A') having no charge transport structure decreases, resulting in decrease of the crosslinking density, and thereby the abrasion resistance of the photoreceptor is deteriorated. Although the targets of the electric properties and the abrasion resistance change depending on the processes for which the photoreceptor is used, the content of the unit obtained from the radically polymerizable monomers (B') in the outermost layer is preferably from 30 to 70% by weight to balance the two properties of the layer.

The outermost layer of the photoreceptor of the present invention includes a crosslinked material including at least a unit obtained from a radically polymerizable tri- or more-functional monomer (A') having no charge transport structure and a unit obtained from a radically polymerizable monomer (B') having a charge transport structure. In addition, the outermost layer can include other components if desired. For example, in order to adjust the viscosity of the coating liquid, to relax the stress of the outermost layer, and to impart low surface energy and low friction coefficient to the outermost layer, known radically polymerizable mono- or di-functional monomers and oligomers, and functional monomers can be used in combination with radically polymerizable monomers (A') and (B').

Specific examples of the radically polymerizable monofunctional monomers include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isostearyl acrylate, stearyl acrylate, styrene, etc.

Specific examples of the radically polymerizable difunctional monomers include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacralte, neopentylglycol diacrylate, ethyleneoxide-modified binsphenol A diacrylate, ethyleneoxide-modified bisphenol F diacrylate, neopentylglycol diacryalte, etc.

Specific examples of the functional monomers include fluorine-containing monomers such as octafluoropentyl acrylate, 2-perfluorooctylethyl acrylate, 2-perfluorooctylethyl methacrylate, and 2-perfluoroisononylethyl acrylate; and vinyl monomers, acrylates and methacrylates having a polysiloxane group such as siloxane units having a repeat number of from 20 to 70, which are described in published examined Japanese patent applications (JP-Bs) 05-60503 and 06-45770 (e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl).

Specific examples of the radically polymerizable oligomers include epoxyacryalte oligomers, urethane acrylate oligomers, polyester acrylate oligomers, etc.

The added amount of such mono- and di-functional monomers and functional monomers is preferably not greater than 50 parts by weight, and more preferably not greater than 30 parts by weight, per 100 parts by weight of the radically polymerizable tri- or more-functional monomers (A') used. When the added amount is greater than 50 parts by weight, the crosslinking density decreases, and thereby the abrasion resistance of the resultant outermost layer is deteriorated.

The outermost layer is typically prepared by coating a coating liquid including at least a radically polymerizable monomer (A') and a radically polymerizable monomer (B') and then irradiating the coated layer with light (such as UV rays) to crosslink the layer. In order to efficiently perform the crosslinking reaction, a polymerization initiator can be added to the outermost layer coating liquid.

Specific examples of the photopolymerization initiators include acetophenone or ketal type photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acryalted benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, etc.

In addition, photopolymerization accelerators can also be used alone or in combination with the above-mentioned photopolymerization initiators. Specific examples of the photopolymerization accelerators include triethanolamine, methyldiethanolamine, ethyl 4-dimethylaminobenzoate, isoamyl 4-dimethylaminobenzoate, 2-dimethylaminoethyl benzoate, 4,4'-dimethylaminobenzophenone, etc.

The added amount of the polymerization initiators is preferably from 0.5 to 40 parts by weight, and more preferably from 1 to 20 parts by weight, per 100 parts by weight of the total weight of the radically polymerizable monomers used.

In order to relax the stress of the crosslinked outermost layer and to improve the adhesion of the outermost layer to the photosensitive layer, the outermost layer coating liquid can include additives such as plasticizers, leveling agent, and low molecular weight charge transport materials having no radical polymerizability.

Specific examples of the plasticizers include known plasticizers for use in general resins, such as dibutyl phthalate, and dioctyl phthalate. The added amount of the plasticizers in the outermost layer coating liquid is preferably not greater than 20% by weight, and more preferably not greater than 10% by weight, based on the total solid components included in the coating liquid.

Specific examples of the leveling agents include silicone oils (such as dimethylsilicone oils, and methylphenylsilicone oils), and polymers and oligomers having a perfluoroalkyl group in their side chains. The added amount of the leveling agents is preferably not greater than 3% by weight based on the total solid components included in the coating liquid.

The outermost layer is typically prepared by coating a coating liquid including at least a radically polymerizable tri- or more-functional monomer (A') having no charge transport structure and a radically polymerizable monomer (B') having a charge transport structure on the photosensitive layer, and then crosslinking (preferably photocrosslinking) the coated layer. When the radically polymerizable monomer (A') is liquid, it is possible to dissolve other components in the monomer, to prepare the outermost layer coating liquid. In this regard, the coating liquid can optionally include a solvent to well dissolve the other components and/or to reduce the viscosity of the coating liquid.

Specific examples of the solvents include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve and cellosolve acetate; etc. These solvents can be used alone or in combination.

The added amount of the solvents is determined depending on the solubility of the solid components, the coating method used, and the target thickness of the outermost layer. Coating methods such as dip coating methods, spray coating methods, bead coating methods, and ring coating methods can be used for forming the outermost layer.

After coating the outermost layer coating liquid, photo energy is applied to the coated layer to crosslink the outermost layer. In this crosslinking reaction, the oxygen concentration is preferably controlled to be not higher than 2.0%, and more preferably from 0.001 to 2.0%, to avoid insufficient crosslinkilig caused by oxygen. Since air includes oxygen in an amount of about 21%, it is preferable to feed an inert gas such as nitrogen, helium and argon gasses into the crosslinking chamber to replace air in the chamber with the inert gas. By performing the crosslinking reaction under such a low oxygen concentration condition, the resultant outermost layer can have a high crosslinking density and a smooth surface even when the illuminance intensity is relatively low.

The outermost layer has a charge transport structure (which is bulky) and a high crosslinking density so as to have a good combination of electric properties and mechanical strength to the outermost layer. When crosslinking the coated outermost layer by applying high energy thereto, the crosslinking reaction unevenly proceeds, resulting in formation of a layer having rough surface. Therefore, photocrosslinking is preferably used because the speed of the crosslinking reaction can be easily controlled by controlling the illuminance intensity of the light used, and the added amount of the polymerization initiator.

Next, the method for forming the outermost layer will be explained. For example, an outermost layer coating liquid including an acrylate monomer (A'1) having three acryloyloxy groups and a triarylamine compound (B'1) having one acryloyloxy group is used, the weight ratio (A'1/B'1) is preferably from 7/3 to 3/7. In addition, a polymerization initiator is included in the coating liquid in an amount of from 3 to 20% by weight based on the total weight of the monomers A'1 and B'1, and a solvent is added thereto. When the charge transport layer includes a triarylamine based donor serving as a charge transport material, a polycarbonate resin serving as a binder resin, and radically polymerizable monomers (A) and (B), and an outermost layer coating liquid is coated on the charge transport layer using a spray coating method, the solvent of the outermost layer coating liquid is preferably tetrahydrofuran, 2-butanone, ethyl acetate, and the like. In this regard, the weight ratio of the solvent to the total of the monomers A'1 and B'1 in the coating liquid is preferably 3 to 10.

The charge transport layer mentioned above is typically formed on a charge generation layer, which is formed on a substrate such as aluminum cylinders with or without an undercoat layer therebetween. Next, the outermost layer coating liquid prepared above is applied on the charge transport layer using a spray coating method. The coated layer is dried for a short time (of from 1 to 10 minutes) at a relatively low temperature (of from 25 to 80° C., and the dried layer is exposed to light so that the outermost layer and the charge transport layer are crosslinked.

Suitable light sources for use in photo-polymerizing the outermost layer include high pressure mercury lamps, metal halide lamps, etc. When UV light having a wavelength of 365 nm is used, the illuminance intensity is preferably not less than 300 mW/cm$^2$. For example, UV light having an illuminance intensity of 600 mW/cm$^2$ is used, it is preferably to irradiate the aluminum cylinder, which bears the optional undercoate layer, the charge generation layer, the charge transport layer, and the outermost layer on the peripheral surface thereof and which is rotated such that any portion of the peripheral surface is exposed to the UV light for a time of from 45 to 600 seconds. The thus prepared photoreceptor has a good combination of abrasion resistance, durability and electric properties.

When light irradiates the surface of the photoreceptor, the temperature of the surface seriously increases. In this case, the speed of the crosslinking reaction of the outermost layer can be enhanced, but a problem in that the charge transport material included in the photoreceptor is deteriorated, resulting in deterioration of the electric properties of the photoreceptor tends to occur. Therefore, it is preferable to control the temperature of the surface of the photoreceptor so as to fall in a proper temperature range during the light irradiation process. The temperature range is preferably from 20 to 150° C., and more preferably from 40 to 80° C.

After the crosslinking operation, the photoreceptor is preferably heated for a time of from 10 minutes to 30 minutes at a temperature of from 100° C. to 150° C. to reduce the amount of the solvent remaining in the photoreceptor and to stabilize the film of the outermost layer. Thus, the photoreceptor of the present invention is prepared.

Next, the structure of the photoreceptor of the present invention will be explained.

The photoreceptor of the present invention will be explained by reference to FIGS. 1 and 2.

FIG. 1 is a cross section illustrating an example of the photoreceptor of the present invention having a single-layered photosensitive layer. Specifically, the photoreceptor includes an electroconductive substrate 31, a photosensitive layer 33, which has both a charge generation function and a charge transport function and which is located on the electroconductive substrate 31, and an outermost layer 39, which is the outermost layer mentioned above.

Figure 2:
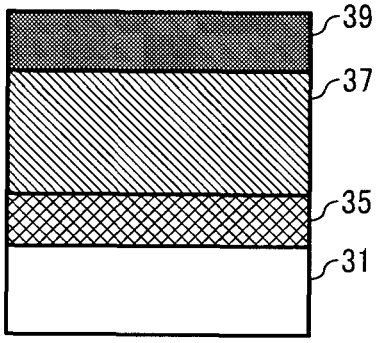
FIG. 2 is a schematic diagram illustrating the sectional view of another photoreceptor of the present invention.

FIG. 2 is a cross section illustrating another example of the photoreceptor of the present invention having a layered photosensitive layer. Specifically, the photoreceptor includes the electroconductive substrate 31, a charge generation layer 35 having a charge generation function, which is located on the electroconductive substrate 31, a charge transport layer 37 having a charge transport function, which is located on the charge generation layer 35, and the outermost layer 39.

The electroconductive substrate is not particularly limited as long as the substrate has a volume resistivity of not greater than $10^{10}$ Ω·cm. Specific examples of such materials include plastic cylinders, plastic films or paper sheets, on the surface of which a layer of a metal such as aluminum, nickel, chromium, nichrome, copper, gold, silver, platinum and the like, or a layer of a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate, which is prepared by tubing a metal such as aluminum, aluminum alloys, nickel and stainless steel by a method such as impact ironing or direct ironing, and then subjecting the surface of the tube to cutting, super finishing, polishing and the like treatments. Further, endless nickel or stainless steel belts disclosed in published unexamined Japanese patent application No. 52-36016 can also be used as the substrate.

Furthermore, substrates, in which a coating liquid including a binder resin and an electroconductive powder is coated on the supports mentioned above, can be used as the substrate. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, etc.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the electroconductive substrate.

The photosensitive layer may have a single-layered structure or a layered structure. The single-layered photosensitive layer has both a charge generation function and a charge transport function. The layered photosensitive layer typically includes a charge generation layer having a charge generation function and a charge transport layer having a charge transport function.

At first, the layered photosensitive layer will be explained.

The charge generation layer includes a charge generation material having a charge generation function as a main component, and optionally includes a binder resin and other components.

Known charge generation materials such as inorganic charge generation materials and organic charge generation materials can be used as the charge generation material. Specific examples of the inorganic charge generation materials include crystalline selenium, amorphous selenium, selenium-tellurium, selenium-tellurium-halogen, selenium-arsenic compound, amorphous silicon, etc. In addition, amorphous silicon in which a dangling bond is terminated with a hydrogen atom or a halogen atom or in which a boron atom, a phosphorous atom is doped can be preferably used.

Known organic charge generation materials can be used. Specific examples thereof include phthalocyanine pigments such as metal phthalocyanine and metal-free phthalocyanine; azulenium salt type pigments; squaric acid methyne pigments; azo pigments having a carbazole skeleton; azo pigments having a triphenyl amine skeleton; azo pigments having a diphenyl amine skeleton; azo pigments having a dibenzothiophene skeleton; azo pigments having a fluorenone skeleton; azo pigments having an oxadiazole skeleton; azo pigments having a bisstilbene skeleton; azo pigments having a distyryloxadiazole skeleton; azo pigments having a distyrylcarbazole skeleton; perylene pigments; anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, benzimidazole pigments, etc. These are used alone or in combination.

Among these charge generation materials, titanyl phthalocyanine compounds are preferably used. Among the titanyl phthalocyanine compounds, titanyl phthalocyanine compounds having an X-ray diffraction spectrum such that strong peaks are observed at least at Bragg (2) angles of 9.6°, 24.0°, and 27.2° (±0.2°) are preferably used because of having a high photosensitivity.

Specific examples of the binder resins, which are optionally included in the charge generation layer, include polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, polyacrylamide, etc. These resins can be used alone or in combination.

In addition, charge transport polymers having a charge transport function such as polymers (e.g., polycarbonates, polyesters, polyurethanes, polyethers, polysiloxanes, and acrylic resins), which have an arylamine skeleton, a benzidine skeleton, a hydrazone skeleton, a carbazole skeleton, a stilbene skeleton, and/or a pyrazoline skeleton, and polymers having a polysilane skeleton can also be used alone or in combination as the binder resin.

Specific examples of the charge transport polymers include charge transport polymers disclosed in JP-As 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, and 09-328539.

Specific examples of the polysilylene polymers are described in JP-As 63-285552, 05-19497, 05-70595 and 10-73944, etc.

The charge generation layer can include a low molecular weight charge transport material. Low molecular weight charge transport materials are broadly classified into electron transport materials and positive hole transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoxy derivatives, etc. These electron transport materials can be used alone or in combination.

Specific examples of the positive hole transport materials include electron donating materials such as oxazole derivatives, oxadiazole derivatives, imidazole derivatives, monoarylamine derivatives, diarylamine derivatives, triphenylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, etc. These positive hole transport materials can be used alone or in combination.

The method for preparing the charge generation layer is not particularly limited, and a proper method is selected while considering the purpose. For example, vacuum thin film forming methods, and casting methods using a solution/dispersion can be used.

Specific examples of such vacuum thin film forming methods include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the charge generation layer include, for example, the steps of preparing a coating liquid by dispersing an inorganic or organic charge generation material in a solvent optionally together with a binder resin using a dispersing machine such as ball mills, attritors, sand mills, and bead mills; and coating the dispersion after diluting the dispersion, if necessary, to prepare the charge generation layer.

Specific examples of the solvent for use in the charge generation layer coating liquid include tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc. The dispersion can optionally include a leveling agent such as dimethylsilicone oils, and methylphenylsilicone oils. Specific examples of the coating methods include dip coating, spray coating, bead coating, ring coating, etc.

The thickness of the charge generation layer is preferably from 0.01 to 5 μm, and more preferably from 0.05 to 2 μm.

The charge transport layer 37 having a charge transport function is formed on the charge generation layer, and the outermost layer is formed on the charge transport layer. The charge transport layer is typically prepared by applying a coating liquid, which is prepared by dissolving or dispersing a composition including a charge transport material having no radically polymerizable group, a binder resin having no radically polymerizable group, a radically polymerizable tri- or more-functional monomer (A) and a radically polymerizable monomer (B) having a charge transport structure, on the charge generation layer, followed by drying. On the thus prepared charge transport layer, an outermost layer coating liquid, which includes a radically polymerizable tri- or more-functional monomer (A') having no charge transport function and a radically polymerizable monomer (B') having a charge transport structure, is applied, followed by application of external energy (such as irradiation of light) thereto to perform crosslinking.

The thickness of the charge transport layer is preferably from 5 to 40 μm, and more preferably from 10 to 30 μm.

Specific examples of the charge transport materials include the charge transport materials (i.e., electron transport materials and hole transport materials) and charge transport polymers mentioned above for use in the charge generation layer.

Specific examples of the binder resin for use in the charge transport layer include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenolic resins, alkyd resins, etc. These resins can be used alone or in combination.

In addition, the charge transport polymers mentioned above can also be preferably used as the binder resin. The charge transport layer formed of a charge transport polymer has a good abrasion resistance. Among the charge transport polymers, polycarbonate resins having a triarylamine structure in the main chain or a side chain thereof are preferably used.

In the photoreceptor of the present invention, a radically polymerizable tri- or more-functional monomer (A) having no charge transport structure and a radically polymerizable monomer (B) having a charge transport structure is included in the charge transport layer in order to enhance adhesion between the charge transport layer and the outermost layer. Specific examples of the radically polymerizable tri- or more-functional monomer (A) and the radically polymerizable monomer (B) having a charge transport structure include the radically polymerizable monomers (A') and (B') mentioned above for use in the outermost layer.

The content of the charge transport material having no radically polymerizable group is preferably from 20 to 80% by weight based on the total weight of the charge transport layer. The content of the binder resin having no radically polymerizable group is preferably from 20 to 80% by weight based on the total weight of the charge transport layer. The content of the radically polymerizable tri- or more-functional monomer (A) having no charge transport structure is preferably from 5 to 40% by weight based on the total weight of the charge transport layer. The content of the radically polymerizable monomer (B) having a charge transport structure is preferably from 5 to 40% by weight based on the total weight of the charge transport layer.

In order to accelerate crosslinking between the charge transport layer and the outermost layer, a polymerization initiator can be included in the charge transport layer. The added amount of the polymerization initiator is from 1 to 10% by weight based on the total amount of the radically polymerizable monomers (A) and (B) included in the charge transport layer.

Specific examples of the solvent for use in preparing the charge transport layer coating liquid include the solvents for use in the charge generation layer coating liquid. Among these solvents, solvents capable of dissolving the charge transport material and the binder resin included in the charge transport layer are preferably used. These solvents are used alone or in combination. In addition, coating methods for use in preparing the charge generation layer can also be used for preparing the charge transport layer.

The charge transport layer can include additives such as plasticizers and leveling agents. Specific examples of the plasticizers include known plasticizers for use in general resins such as dibutyl phthalate and dioctyl phthalate. The added amount of the plasticizers is from 0 to 30 parts by weight per 100 parts by weight of the binder resin included in the charge transport layer.

Specific examples of the leveling agents include silicone oils (such as dimethylsilicone oils, and methylphenylsilicone oils), and polymers and oligomers having a perfluoroalkyl group in their side chains. The added amount of the leveling agents is preferably from 0 to 1 part by weight per 100 parts by weight of the binder resin included in the charge transport layer.

As mentioned above in the explanation of the outermost layer, an outermost layer coating liquid including the radically polymerizable monomers (A') and (B') is applied on the charge transport layer. After the coated outermost layer is optionally dried, external energy such as light energy is applied thereto, resulting in crosslinking of the outermost layer (and crosslinking between the outermost layer and the charge transport layer).

The thickness of the outermost layer is from 1 to 20 μm, and preferably from 2 to 10 μm. When the outermost layer is too thin, good durability cannot be imparted to the photoreceptor due to variation of the thickness. In contrast, when the outermost layer is too thick, the total thickness of the charge transport layer and the outermost layer excessively increases, resulting in deterioration of the image reproducibility due to diffusion of charges through the layers.

Next, the single-layered photosensitive layer will be explained.

The single-layered photosensitive layer 33 has both a charge generation function and a charge transport function. Similarly to the case of the layered photosensitive layer, the outermost layer 39 is formed on the single-layered photosensitive layer 33.

The photosensitive layer 33 can be prepared, for example, by applying a coating liquid, which is prepared by dissolving or dispersing a composition including a charge generation material, a charge transport material having no radically polymerizable group, a binder resin having no radically polymerizable group, a radically polymerizable tri- or more-functional monomer (A) and a radically polymerizable monomer (B) having a charge transport structure, overlying the electroconductive substrate 31, followed by drying. The photosensitive layer coating liquid can optionally include additives such as plasticizers and leveling agents.

The method for dispersing the charge generation material is mentioned above, and specific examples of the charge generation materials, charge transport materials, plasticizers and leveling agents are also mentioned above. Specific examples of the binder resin include the resins for use in the charge transport layer. In addition, the resins mentioned above for use in the charge generation layer can also be used in combination with the resins for use in the charge transport layer.

The thickness of the single-layered photosensitive layer is from 5 to 30 μm, and preferably from 10 to 25 μm.

As mentioned above in the explanation of the outermost layer, an outermost layer coating liquid including the radically polymerizable monomers (A') and (B') is applied on the single-layered photosensitive layer. After the coated outermost layer is optionally dried, external energy such as heat energy and light energy is applied thereto, resulting in crosslinking of the outermost layer (and crosslinking between the outermost layer and the single-layered photosensitive layer).

The thickness of the outermost layer is from 1 to 20 μm, and preferably from 2 to 10 μm. When the outermost layer is too thin, good durability cannot be imparted to the photoreceptor due to variation of the thickness. In contrast, when the outermost layer is too thick, the total thickness of the single-layered photosensitive layer and the outermost layer excessively increases, resulting in deterioration of the image reproducibility due to diffusion of charges through the layers.

The content of the charge transport material having no radically polymerizable group in the single-layered photosensitive layer is preferably from 20 to 80% by weight based on the total weight of the single-layered photosensitive layer. The content of the binder resin having no radically polymerizable group is preferably from 20 to 80% by weight based on the total weight of the single-layered photosensitive layer. The content of the radically polymerizable tri- or more-functional monomer (A) having no charge transport structure is preferably from 5 to 40% by weight based on the total weight of the single-layered photosensitive layer. The content of the radically polymerizable monomer (B) having a charge transport structure is preferably from 5 to 40% by weight based on the total weight of the single-layered photosensitive layer.

In order to accelerate crosslinking between the single-layered photosensitive layer and the outermost layer, a polymerization initiator can be included in the single-layered photosensitive layer. The added amount of the polymerization initiator is from 1 to 10% by weight based on the total amount of the radically polymerizable monomers included in the single-layered photosensitive layer.

The photoreceptor of the present invention can include an undercoat layer between the electroconductive substrate 31 and the charge generation layer 35 (or the photosensitive layer 33). The undercoat layer includes a resin as a main component. Since a charge generation layer or a photosensitive layer is formed on the undercoat layer typically by coating a coating liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer can include a particulate metal oxide such as titanium oxide, silica, alumina, zirconium oxide, tin oxide and indium oxide to prevent occurrence of moiré in the resultant images and to decrease residual potential of the resultant photoreceptor.

The undercoat layer can be formed by coating a coating liquid using a proper solvent and a proper coating method.

The undercoat layer may be formed using a silane coupling agent, titanium coupling agent or a chromium coupling agent. In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method are also preferably used as the undercoat layer. In addition, the undercoat layer can also be formed by any known methods. The thickness of the undercoat layer is preferably 0 to 5 μm.

In order to impart high stability to withstand environmental conditions to the resultant photoreceptor (particularly, to prevent deteriorations of photosensitivity and increase of residual potential), an antioxidant can be included in the above-mentioned layers (i.e., the outermost layer, charge generation layer, charge transport layer, photosensitive layer, and undercoat layer).

Specific examples of the antioxidant are as follows.

(1) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)-benzene, tetrakis-[methylene-3-(3',5'-di-t-butyl-4'-hydroxyphenyl)-propionate]methane, bis[3,3'-bis(4'-hydroxy-3'-t-butylphenyl)butyric acid]glycol ester, tocophenol compounds, etc.

(2) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(3) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(4) Sulfur Containing Organic Compounds dilauryl-3,3'-thiodipropionate, distearyl-3,3'-thiodipropionate, ditetradecyl-3,3'-thiodipropionate, etc.

(5) Phosphorus Containing Organic Compounds triphenylphosphine, tri(nonylphenyl)phosphine, tri(dinonylphenyl)phosphine, tricresylphosphine, tri(2,4-dibutylphenoxy)phosphine, etc.

These compounds are commercialized as antioxidants for rubbers, plastics, oil and fats.

The added amount of an antioxidant in a layer is not particularly limited, and is preferably from 0.01 to 10% by weight based on the weight of the layer to which the antioxidant is added.

Next, the image forming method and apparatus of the present invention will be explained by reference to drawings.

Figure 3:
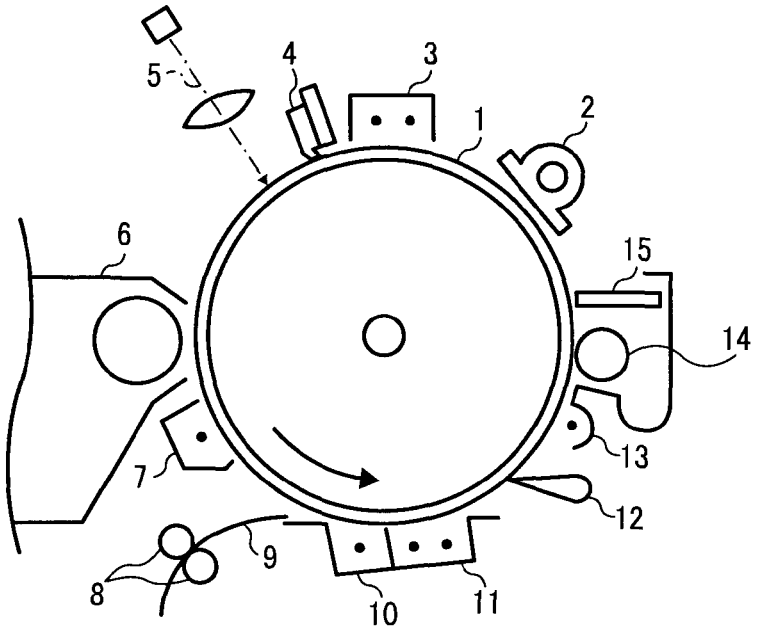
FIG. 3 is a schematic diagram illustrating the sectional view of an image forming apparatus of an embodiment of the present invention.

FIG. 3 is a schematic view illustrating the image forming section of an embodiment of the image forming apparatus of the present invention. The image forming apparatus includes a photoreceptor 1 which is the photoreceptor including the crosslinked outermost layer having a charge transport function and a smooth surface. The image forming method and apparatus perform at least a charging process in which the photoreceptor 1 is charged with a charger 3; a light irradiating process in which a light irradiator 5 irradiates the charged photoreceptor 1 with imagewise light to form an electrostatic image thereon; a developing process in which a developing device 6 develops the electrostatic image with a developer including a toner to form a toner image on the photoreceptor 1; a transfer process in which a transfer device (including a transfer charger 10 and a separation charger 11) transfers the toner image to a receiving material 9; a fixing process in which a fixing device (not shown) fixes the toner image to the receiving material 9; and a cleaning process in which a cleaner (including a fur brush 14 and a blade 15) cleans the surface of the photoreceptor after the transfer process. The photoreceptor 1 is optionally subjected to a discharging process using a discharger 2 after the transfer process. Numerals 4 and 7 respectively denote an eraser configured to erase a part of the charged portion of the photoreceptor 1, and a pre-transfer charger configured to previously charge the photoreceptor 1 so that the toner image can be well transferred onto the receiving material 9. Numerals 8 and 12 respectively denote a pair of registration rollers configured to timely feed the receiving material 9 to the transfer device 10/11, and a separation pick configured to separate the receiving material 9 from the photoreceptor 1. Numeral 13 denotes a pre-cleaning charger configured to previously charge the photoreceptor 1 so that the surface of the photoreceptor can be well cleaned with the cleaner.

The image forming method and apparatus of the present invention are not limited thereto, and, for example, an image forming method and apparatus in which an electrostatic latent image is transferred to a receiving material, followed by development of the electrostatic latent image to form a toner image on the receiving material can also be used.

The photoreceptor has a drum form, however, sheet-form or endless-belt-form photoreceptors can also be used in the present invention.

Suitable chargers for use as the charger 3 include known chargers capable of uniformly charging the photoreceptor, such as corotrons, scorotrons, solid state dischargers, needle electrodes, charging rollers, electroconductive brushes, etc.

Suitable light sources for use in the light irradiator 5 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The developing device 6 develops the electrostatic latent image formed on the photoreceptor 1 with a developer including a toner. Suitable developing methods include dry developing methods (such as one component developing methods using a toner as the developer and two component developing methods using a developer including a carrier and a toner), and wet developing methods.

When the photoreceptor 1, which is previously charged positively (or negatively), is exposed to imagewise light, an electrostatic latent image having a positive (or negative) charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

The toner image formed on the photoreceptor 1 is transferred to the receiving material 9 by the transfer charger 10. In order to well perform the transfer operation, the pre-transfer charger 7 can be used. Suitable transfer methods include transfer methods using a transfer charger, electrostatic transfer methods using a bias roller, mechanical transfer methods such as adhesion transfer methods and pressure transfer methods, magnetic transfer methods, etc. The above-mentioned chargers can be preferably used for the electrostatic transfer methods.

The receiving material 9, on which the toner image has been transferred, is separated from the photoreceptor by the separation charger 11 and the separation pick 12. Other separation devices such as separation methods utilizing electrostatic attraction, separation methods using a belt end, separation methods including griping tip of receiving materials, separation methods utilizing curvature, etc. The above-mentioned chargers can be used for the separation charger 11.

When the toner image formed on the photoreceptor 1 by the developing device 6 is transferred onto the receiving material 9, all of the toner image is not transferred onto the receiving material 9, and toner particles remain on the surface of the photoreceptor 1. The residual toner is removed from the photoreceptor 1 by the fur brush 14 and cleaning blade 15. In order to well clean the surface of the photoreceptor 1, the pre-cleaning charger 13 can be used. Other cleaning methods such as web cleaning methods, and magnet brush cleaning methods can also be used. These cleaning methods can be used alone or in combination.

Suitable devices for use as the discharging device 2 include discharging lamps and discharging chargers. The lamps mentioned above for use in the light irradiator and the chargers mentioned above for use in the charger can be used for the discharging device 2.

The image forming method and apparatus of the present invention can further include a document reading process in which the image of an original image is read with an image reader; a feeding process in which the receiving material 9 is fed toward the photoreceptor 1; and a copy discharging process in which the receiving material 9 bearing a fixed image thereon is discharged from the image forming apparatus.

The image forming section illustrated in FIG. 3 can be fixedly set in an image forming apparatus such as copiers, facsimiles and printers. However, the image forming section can be detachably attached to an image forming apparatus as a process cartridge.

Figure 4:
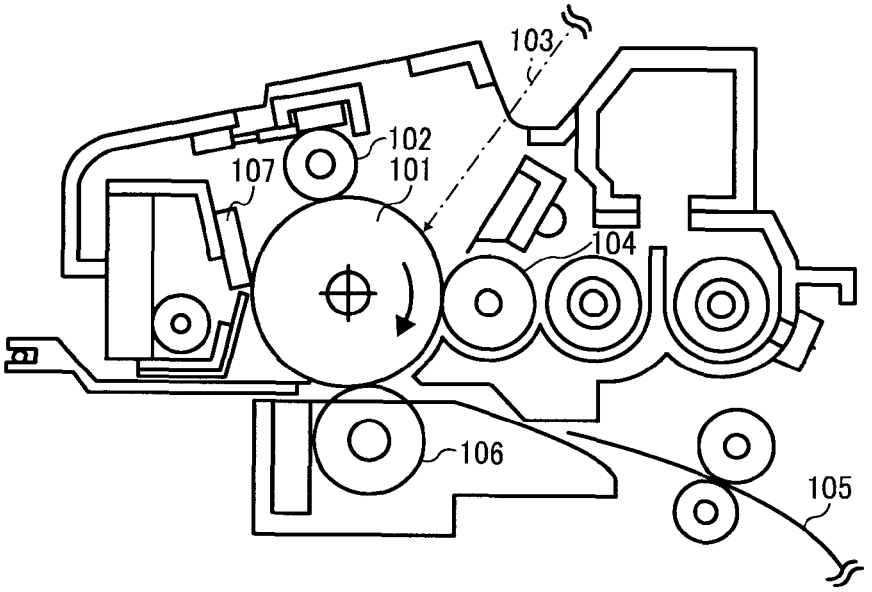
FIG. 4 is a schematic diagram illustrating the sectional view of a process cartridge of an embodiment of the present invention.

FIG. 4 illustrates an example of the process cartridge of the present invention, and a photoreceptor 101 is the photoreceptor of the present invention.

Around the photoreceptor 101, a charger 102 (a charging roller) configured to charge the photoreceptor 101 which rotates in a direction indicated by an arrow; a light beam 103 (emitted by a light irradiator (not shown) irradiating the photoreceptor 101 to form an electrostatic latent image thereon; a developing device (developing roller) 104 configured to develop the latent image with a developer including a toner to form a toner image on the photoreceptor 101; a transfer device 106 configured to transfer the toner image onto a receiving material 105; and a cleaner including a blade 107 and configured to clean the surface of the photoreceptor 101, are arranged. The photoreceptor 101 may be subjected to a discharging process in which charges remaining on the photoreceptor even after the transfer process are reduced with a discharging device (not shown).

The process cartridge illustrated in FIG. 4 is detachably attached to an image forming apparatus as a unit. The process cartridge includes the photoreceptor 101 and at least one of the charger, developing device, transfer device, cleaner and discharger.

As mentioned above, the photoreceptor of the present invention is used, not only for electrophotographic copiers, but also for other electrophotographic equipments such as laser beam printers, CRT printers, LED printers, liquid crystal printers, and laser plating.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1

Synthesis of Radically Polymerizable Monomer Having Charge Transport Structure An example of the method for synthesizing a radically polymerizable monomer having a charge transport structure will be explained.

Such a radically polymerizable monomer having a charge transport structure can be prepared, for example, by the method described in Japanese Patent No. 3,164,426, which is as follows.

(1) Synthesis of Triarylamine Compound Substituted with Hydroxyl Group (i.e., a Compound Having the Below-Mentioned Formula (b))

At first, 113.85 g (0.3 mol) of a triarylamine compound which is substituted with a methoxy group and which has the below-mentioned formula (a), 138 g (0.92 mol) of sodium iodide, and 240 ml of sulforane were mixed and the mixture was heated at 60° C. under a nitrogen gas flow. Then, 99 g (0.91 mol) of trimethylchlorosilane was dropped thereto over 1 hour. The mixture was agitated for 4.5 hours at about 60° C. to complete the reaction. Next, about 1.5 liters of toluene was added to the reaction product, followed by cooling to room temperature. Further, the toluene solution of the reaction product was further washed using water, followed by washing using an aqueous solution of sodium carbonate. The washing treatment was repeated several times. Then toluene was removed from the toluene solution of the reaction product, and the reaction product was subjected to column chromatography using an absorbent of silica gel, and a solvent of toluene/ethyl acetate of 20/1 to be refined. The thus prepared pale yellow oily material was mixed with cyclohexane to precipitate a crystal. Thus, 88.1 g of a white crystal having the below-mentioned formula (b) and a melting point of from 64.0 to 66.0° C. was prepared. In this reaction, the yield was 80.4%.

The crystal was then subjected to an elementary analysis. The results (i.e., the amounts (%) of the elements (C, H and N) in the crystal) are shown in Table 1.

TABLE 1

| | C | H | N |
|---|---|---|---|
| Actual measurement value | 85.06 | 6.41 | 3.73 |
| Calculated value | 85.44 | 6.34 | 3.83 |

Formula (a)

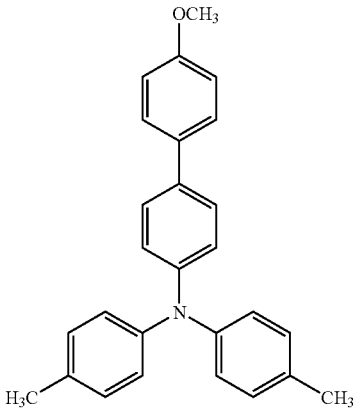

-continued

Formula (b)

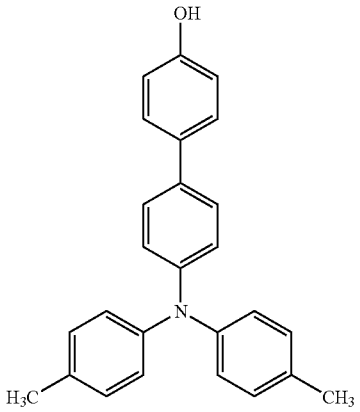

(2) Synthesis of Acrylate Compound Substituted with Triarylamine Group (i.e., Compound No. 54 Listed Before)

At first, 82.9 g (0.227 mol) of the compound having formula (b) was dissolved in 400 ml of tetrahydrofuran. Next, an aqueous solution of sodium hydroxide including 12.4 g of sodium hydroxide and 100 ml of water was dropped into the above-prepared solution. After the mixture was cooled to 5° C., 25.2 g (0.272 mol) of acrylic acid chloride was added thereto over 40 minutes. The mixture was agitated for 3 hours at 5° C. to complete the reaction. The reaction product was then added into water, and then subjected to extraction using toluene. The extraction liquid was subjected to washing using a sodium hydrogen carbonate aqueous solution, followed by washing using water. The washing treatment was performed several times.

After toluene was removed from the toluene solution of the reaction product, the reaction product was subjected to column chromatography using an absorbent of silica gel, and a solvent of toluene to be refined. The thus prepared colorless oily material was mixed with n-hexane to precipitate a crystal. Thus, 80.73 g of a white crystal which is the compound No. 54 listed before and has a melting point of from 117.5 to 119.0° C. was prepared. In this reaction, the yield was 84.8%.

The crystal was then subjected to an elementary analysis. The results (i.e., the amounts (%) of the elements (C, H and N) in the crystal) are shown in Table 2.

TABLE 2

| | C | H | N |
|---|---|---|---|
| Actual measurement value | 83.13 | 6.01 | 3.16 |
| Calculated value | 83.02 | 6.00 | 3.33 |

Synthesis Example 2

One of the methods for preparing titanyl phthalocyanine pigments for use as a charge generation material in the photoreceptor of the present invention will be explained.

Specifically, in a container 292 g of 1,3-diiminoisoindoline and 2000 ml of sulforane were mixed while agitated. Under a nitrogen gas flow, 204 g of titanium tetrabutoxide was dropped therein. After addition of titanium tetrabutoxide was completed, the temperature of the mixture was gradually increased to 180° C. The temperature of the mixture was maintained in a range of from 170° C. to 180° C. for 5 hours while agitating the mixture to react the compounds. After the reaction was terminated, the reaction product was cooled. Then the reaction product was filtered to obtain the precipitate. Then the precipitate was washed with chloroform until the precipitate colored blue. The precipitate was then washed with methanol several times, followed by washing with hot water of 80° C. several times. Thus, a crude titanyl phthalocyanine was prepared.

One part of the thus prepared crude titanyl phthalocyanine was gradually added to 20 parts of concentrated sulfuric acid to be dissolved therein. The solution was gradually added to 100 parts of ice water while agitated, to precipitate a titanyl phthalocayaine pigment. The pigment was obtained by filtering. The pigment was washed with water until the filtrate became neutral. Twenty (20) grams of the thus prepared aqueous wet cake of the titanyl phthalocyanine pigment was added to 200 g of 1,2-dichloroethane and the mixture was agitated for about 4 hours. Further, 1000 g of methanol was added to the mixture, and the mixture was agitated for 1 hour. Furthermore, the mixture was filtered and the wet cake was dried to prepare a titanyl phthalocyanine pigment 1.

Figure 5:
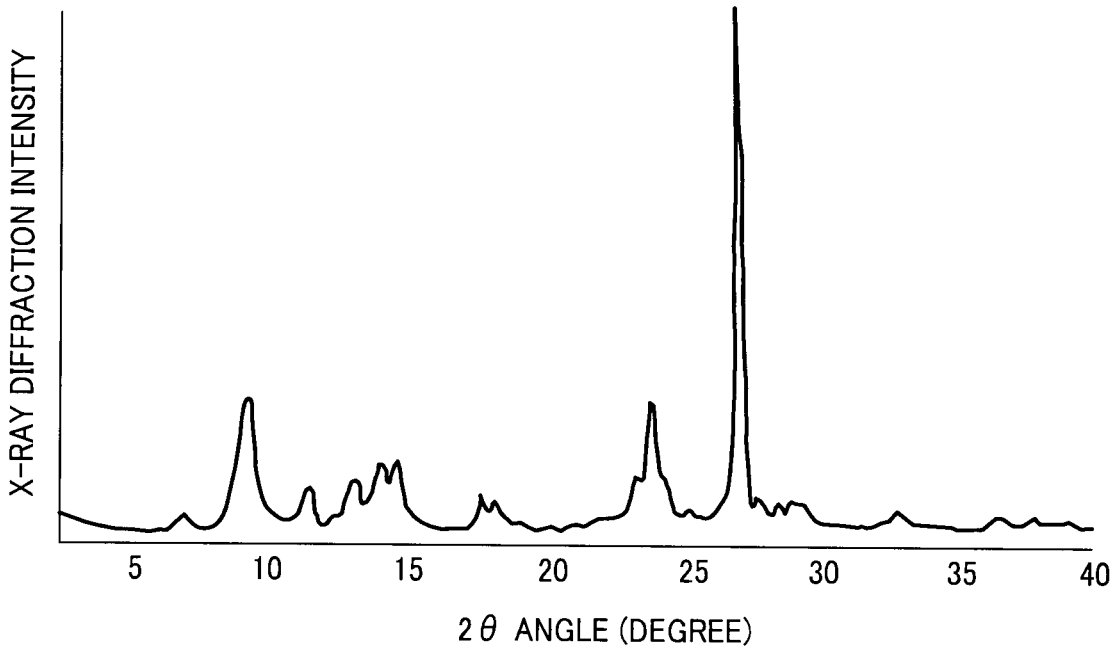
FIG. 5 is an X-ray diffraction spectrum of a titanyl phthalocyanine pigment for use in the photoreceptor of the present invention.

When the thus prepared titanyl phthalocyanine pigment 1 was subjected to an X-ray diffraction analysis using a Cu-K α X-ray having a wavelength of 1.542 Å, it was confirmed that the titanyl phthalocyanine pigment has an X-ray diffraction spectrum such that main peaks are observed at Bragg (2 θ) angles of 9.6±0.2°, 24.0±0.2°, and 27.2±0.2°. The X-ray diffraction spectrum thereof is illustrated in FIG. 5.

The X-ray diffraction analysis was performed under the following conditions:

X-ray tube: Cu
Voltage: 40 kV
Current: 20 mA
Scanning speed: 1°/min
Scanning range: 3° to 40°
Time constant: 2 seconds

Example 1

Formation of Undercoat Layer

The following components were mixed to prepare an undercoat layer coating liquid.

| | |
|---|---|
| Alkyd resin (BEKKOSOL 1307-60-EL from Dainippon Ink And Chemicals, Inc.) | 6 parts |
| Melamine resin (SUPER BEKKAMINE G-821-60 from Dainippon Ink And Chemicals, Inc.) | 4 parts |
| Titanium oxide (CR-EL from Ishihara Sangyo Kaisha Ltd.) | 40 parts |
| Methyl ethyl ketone | 50 parts |

The undercoat layer coating liquid was applied on an aluminum drum having an outside diameter of 30 mm using a dip coating method, and the coated liquid was dried. Thus, an undercoat layer having a thickness of about 4.5 μm was prepared.

(Formation of Charge Generation Layer)

The following components were mixed to prepare a charge generation layer coating liquid.

| | |
|---|---|
| Titanyl phthalocyanine pigment 1 prepared above | 2.5 parts |
| Polyvinyl butyral resin (BX-1 from Sekisui Chemical Co., Ltd.) | 0.5 parts |
| Methyl ethyl ketone | 280 parts |

The charge generation layer coating liquid was applied on the undercoat layer, and the coated liquid was dried to prepare a charge generation layer having a thickness of 0.3 μm.

(Formation of charge Transport Layer)

The following components were mixed to prepare a charge transport layer coating liquid.

| | |
|---|---|
| Bisphenol Z-form polycarbonate | 9 parts |
| CTM having the following formula | 9 parts |

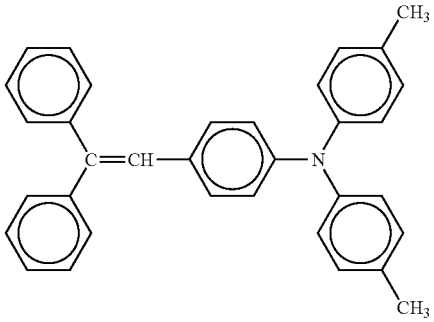

| | |
|---|---|
| Radically polymerizable tri- or more-functional monomer having no charge transport structure (KAYARAD TMPTA from Nippon Kayaku Co., Ltd. having the following formula) | 1 part |

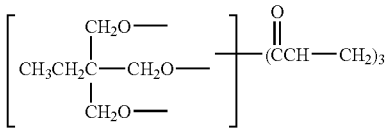

| | |
|---|---|
| Radically polymerizable monofunctional monomer having charge transport structure (Compound No. 54 mentioned above) | 1 part |
| Photopolymerization initiator having the following formula | 0.05 parts |

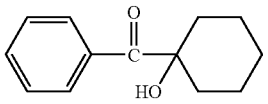

| | |
|---|---|
| Tetrahydrofuran | 80 parts |
| 1% tetrahydrofuran solution of silicone oil (Silicone oil: KF50 from Shin-Etsu Chemical Co., Ltd.) | 0.2 part |

The charge transport layer coating liquid was applied on the charge generation layer by a dip coating method, and the coated liquid was heated to be dried, resulting in preparation of a charge transport layer having a thickness of 24 μm.

(Formation of Outermost Layer)

The following components were mixed to prepare an outermost layer coating liquid.

| | |
|---|---|
| Radically polymerizable tri- or more-functional monomer having no charge transport structure (KAYARAD TMPTA from Nippon Kayaku Co., Ltd. having the following formula) | 10 part |

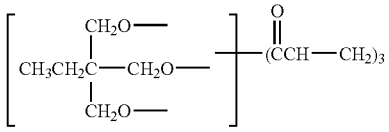

-continued

| | |
|---|---|
| Radically polymerizable monofunctional monomer having charge transport structure (Compound No. 56 mentioned above). | 10 part |
| Photopolymerization initiator having the following formula | 0.5 parts |

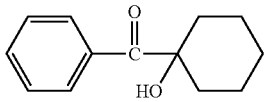

| | |
|---|---|
| Tetrahydrofuran | 80 parts |

The thus prepared outermost layer coating liquid was coated on the charge transport layer by a spray coating method. In addition, the drum was set in a light irradiator to be exposed to light. The light irradiation conditions were as follows.

Light irradiator: UV irradiator from Fusion Co.

Light source: H-valve having strong luminescence peak in a wavelength range of from 200 to 280 nm Input power: 240 mW/cm$^2$ Irradiation time 180 seconds The outermost layer was further heated for 30 minutes at 130° C., resulting in formation of an outermost layer having a thickness of 10.0 μm. Thus, a photoreceptor of Example 1 was prepared.

Example 2

The procedure for preparation of the photoreceptor in Example 1 was repeated except that the radically polymerizable tri- or more-functional monomer having no charge transport structure was replaced with a radically polymerizable tri- or more-functional monomer having no charge transport structure (KAYARADA DPCA 120 from Nippon Kayaku Co., Ltd.) having the following formula.

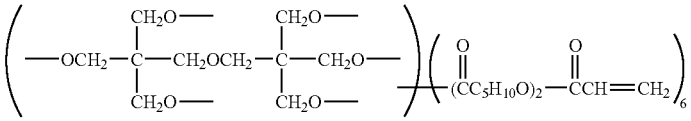

Thus, a photoreceptor of Example 2 was prepared.

Comparative Example 1

The procedure for preparation of the photoreceptor in Example 1 was repeated except that the charge transport layer coating liquid was replaced with the following charge transport layer coating liquid, and the coated charge transport layer was heated for 30 minutes at 150° C. to be crosslinked before coating the outermost layer coating liquid.

-continued

| (Charge transport layer coating liquid) | |
|---|---|
| Polyol (Styrene-acrylic copolymer LZR-170 from Fujikura Kasel Co., Ltd. obtained from styrene, methyl methacrylate and hydroxyethyl methacrylate, and having hydroxyl value of about 367 mgKOH/g and solid content of 41% by weight) | 20 parts |
| Charge transport material (1,2-dihydroxy-3-[4'-di(di-p-tolylamino)stilbene-4-yloxy]propane having the below-mentioned formula, i.e., TAKENATE 500 from Mitsui Chemicals Polyurethanes, Inc. having NCO ratio of 45%) | 10 parts |

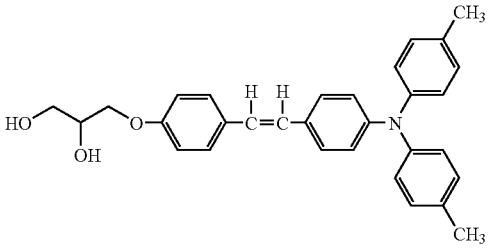

| | |
|---|---|
| Cyclohexanone | 60 parts |
| Tetrahydrofuran | 200 parts |

Thus, a photoreceptor of Comparative Example 1 was prepared.

Example 3

In this example, an aluminum cylinder having a diameter of 30 mm, which had been subjected to an anodic oxidation treatment, followed by a hole sealing treatment, was used as the electroconductive substrate.

(Formation of Undercoat Layer)

The following components were mixed to prepare an undercoat layer coating liquid.

| | |
|---|---|
| Alcohol-soluble nylon (CM-8000 from Toray Industries Inc.) | 5 parts |
| Methanol | 50 parts |
| Butanol | 20 parts |

The thus prepared coating liquid was coated on the surface of the aluminum cylinder by a dip coating method, followed by drying to prepare an undercoat layer having a thickness of 0.7 μm.

(Formation of Charge Generation Layer)

The following components were mixed to prepare a charge generation layer coating liquid.

| | |
|---|---|
| Titanyl phthalocyanine pigment 1 prepared above | 2.5 parts |
| Polyvinyl butyral resin (BX-1 from Sekisui Chemical Co., Ltd.) | 0.5 parts |
| Methyl ethyl ketone | 280 parts |

The charge generation layer coating liquid was applied on the undercoat layer, and the coated liquid was dried to prepare a charge generation layer having a thickness of 0.3 μm.

(Formation of Charge Transport Layer)

The following components were mixed to prepare a charge transport layer coating liquid.

| | |
|---|---|
| Bisphenol Z-form polycarbonate | 10 parts |
| Charge transport material having the following formula | 10 parts |

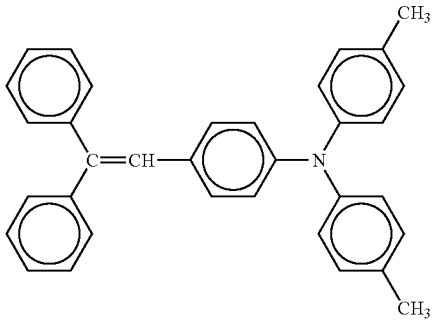

| | |
|---|---|
| Radically polymerizable tri- or more-functional monomer having no charge transport structure (KAYARAD TMPTA from Nippon Kayaku Co., Ltd. having the following formula) | 0.5 parts |

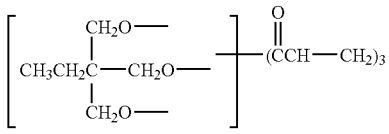

| | |
|---|---|
| Radically polymerizable monomer having charge transport structure (Compound No. 105 mentioned above) | 0.5 parts |
| Photopolymerization initiator having the following formula | 0.05 parts |

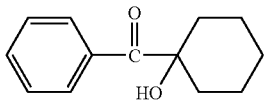

| | |
|---|---|
| Tetrahydrofuran | 80 parts |
| 1% tetrahydrofuran solution of silicone oil (Silicone oil: KiF5O from Shin-Etsu Chemical Co., Ltd.) | 0.2 part |

The charge transport layer coating liquid was applied on the charge generation layer by a dip coating method, and the coated liquid was heated to be dried, resulting in preparation of a charge transport layer having a thickness of 24 μm.

(Formation of Outermost Layer)

The following components were mixed to prepare an outermost layer coating liquid.

| | |
|---|---|
| Radically polymerizable tri- or more-functional monomer (KAYARAD DPHA from Nippon Kayaku Co., Ltd. having the following formula) | 10 part |

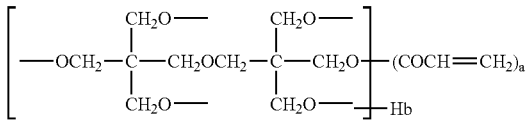

(a = 6 and b = 0, or a = 5 and b = 1)

-continued

| | |
|---|---|
| Radically polymerizable monofunctional monomer having charge transport structure (Compound No. 105 mentioned above) | 10 part |
| Photopolymerization initiator having the following formula | 0.5 parts |

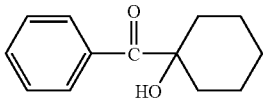

| | |
|---|---|
| Tetrahydrofuran | 80 parts |

The thus prepared outermost layer coating liquid was coated on the charge transport layer by a spray coating method. In addition, the drum was set in a light irradiator to be exposed to light. The light irradiation conditions were as follows.

Light irradiator: UV irradiator from Fusion Co.

Light source: H-valve having strong luminescence peak in a wavelength range of from 200 to 280 nm Input voltage: 240 mW/cm$^2$ Irradiation time 180 seconds The outermost layer was further heated for 30 minutes at 130° C., resulting in formation of an outermost layer having a thickness of 10.0 μm. Thus, a photoreceptor of Example 3 was prepared.

Example 4

The procedure for preparation of the photoreceptor in Example 3 was repeated except that the radically polymerizable tri- or more-functional monomer having a charge transport structure (KAYARAD TMPTA) was replaced with the above-mentioned radically polymerizable tri- or more-functional monomer having a charge transport structure used in Example 2 (i.e., KAYARAD DPCA120 from Nippon Kayaku Co., Ltd.).

Comparative Example 2

The procedure for preparation of the photoreceptor in Example 3 was repeated except that the charge transport layer coating liquid was replaced with the following charge transport layer coating liquid, and the coated charge transport layer was heated for 30 minutes at 150° C. to be crosslinked before coating the outermost layer coating liquid.

| (Charge transport layer coating liquid) | |
|---|---|
| Polyol (Styrene-acrylic copolymer LZR-170 from Fujikura Kasei Co., Ltd. obtained from styrene, methyl methacrylate and hydroxyethyl methacrylate, and having hydroxyl value of about 367 mgKOH/g and solid content of 41% by weight) | 20 parts |
| Charge transport material (1,2-dihydroxy-3-[4'-di(di-p-tolylamino)stilbene-4-yloxy]propane having the below-mentioned formula, i.e., TAKENATE 500 from Mitsui Chemicals Polyurethanes, Inc. having NCO ratio of 45%) | 10 parts |

-continued (Charge transport layer coating liquid)

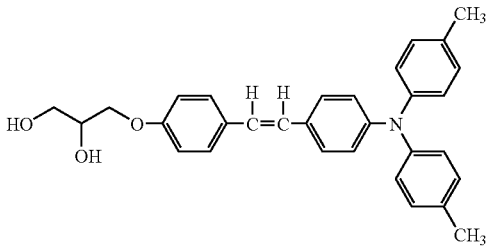

| | |
|---|---|
| Cyclohexanone | 60 parts |
| Tetrahydrofuran | 280 parts |

Thus, a photoreceptor of Comparative Example 2 was prepared.

The thus prepared photoreceptors of Examples 1-4 and Comparative Examples 1 and 2 were evaluated with respect to the following items.

(1) Peel Strength

The outermost layer is cut at regular intervals in the vertical and horizontal directions using a peel strength measuring instrument, i.e., AURFACE AND INTERFACIAL CUTTING ANALYSIS SYSTEM (SAICAS) DN-20 from DAIPLA WINTES co., LTD.). The peel strength is measured as follows. The portion of from the surface of a sample (photoreceptor) to the interface between the outermost layer and the photosensitive layer is cut and peeled with a sharp blade at a low speed while measuring the horizontal force applied to the blade. The peel strength of the outermost layer is equal to the horizontal force per unit width of the blade. The measuring conditions are as follows.

Width of cutting blade: 0.5 mm

Cutting speed (horizontal direction): 0.1 μm/s

Cutting speed (vertical direction): 0.01 μm/s

Cutting depth: greater than the thickness of the outermost layer

The peel strength (PS) in units of N/m is determined by the following equation:

$$PS=P/W$$

wherein P represents the horizontal force applied to the blade measured when the cutting depth is equal to the thickness of the outermost layer; and W represents the width of the cutting blade. In this regard, the greater the peel strength, the better the adhesiveness of the outermost layer with the charge transport layer.

(2) Running Test

Each of the photoreceptors is set in an image forming apparatus IMAGIO NEO 270 from Ricoh Co., Ltd., which uses a laser diode emitting light having a wavelength of 780 nm, to perform a running test in which 100,000 copies of an image (S3 chart) of A-4 size are produced on sheets of a receiving material (MY PAPER from NBS Ricoh) while checking the potentials of an irradiated portion (i.e., image portion) and a dark portion (i.e., background portion) before the running test and after production of 50,000 copies and 100,000 copies and the abrasion loss of the outermost layer after production of 50,000 copies and 100,000 copies. In this regard, the initial potential of the dark portion is −700V. The first, 50,000$^{th}$ and 100,000$^{th}$ images are visually observed to determine whether the images have a streak image caused by scratch formed on the outermost layer. The images are graded as follows.

○: No streak image is observed in the image.

Δ: A streak image is observed in a part of the image.

X: Streak images are observed in the entire image.

The results are shown in Tables 3 and 4.

TABLE 3

| | Peel strength (N/m) | Abrasion loss (μm) After 50,000 copies | Abrasion loss (μm) After 100,000 copies | Streak image First image | Streak image 50,000th image | Streak image 100,000th image |
|---|---|---|---|---|---|---|
| Ex. 1 | 0.74 | 0.79 | 1.74 | ○ | ○ | ○ |
| Ex. 2 | 0.78 | 0.87 | 1.73 | ○ | ○ | ○ |
| Ex. 3 | 0.68 | 0.81 | 1.81 | ○ | ○ | ○ |
| Ex. 4 | 0.70 | 0.74 | 1.04 | ○ | ○ | ○ |
| Comp. Ex. 1 | 0.28 | 1.02 | 5.71 | ○ | Δ | X |
| Comp. Ex. 2 | 0.24 | 1.13 | 4.84 | ○ | Δ | X |

TABLE 4

| | Potential of photoreceptor (−V) | | | | | |
|---|---|---|---|---|---|---|
| | Initial potential | | Potential after 50,000 copies | | Potential after 100,000 copies | |
| | Dark portion | Irradiated portion | Dark portion | Irradiated portion | Dark portion | Irradiated portion |
| Ex. 1 | 700 | 147 | 684 | 146 | 672 | 152 |
| Ex. 2 | 700 | 146 | 688 | 145 | 673 | 151 |
| Ex. 3 | 700 | 145 | 686 | 146 | 689 | 150 |
| Ex. 4 | 700 | 132 | 687 | 141 | 663 | 143 |
| Comp. Ex. 1 | 700 | 141 | 621 | 161 | 516 | 253 |
| Comp. Ex. 2 | 700 | 141 | 587 | 164 | 463 | 283 |

It is clear from FIGS. 3 and 4 that the photoreceptors of the present invention can maintain a good combination of peel strength, abrasion resistance and electric properties and can produce images without a streak image over a long period of time.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2007-161275 and 2008-070084, filed on Jun. 19, 2007, and Mar. 18, 2008, respectively, the entire contents of which are herein incorporated by reference.

What is claimed is:

1. A photoreceptor comprising:

an electroconductive substrate;

a photosensitive layer, which includes a charge generation layer including a charge generation material, a charge transport layer located on the charge generation layer and including a charge transport material having no radical polymerizability, a binder resin having no radical polymerizability, and a crosslinked polymer including a first radically polymerizable monomer unit having three or more functional groups and no charge transport structure and a second radically polymerizable monomer unit having a charge transport structure; and an outermost layer, which is located on the charge transport layer and which includes a crosslinked polymer including a third radically polymerizable monomer having three or more functional groups and no charge transport structure and a fourth radically polymerizable monomer having a charge transport structure, wherein the first radically polymerizable monomer and the second radically polymerizable monomer are reacted with the third radically polymerizable monomer and the fourth radically polymerizable monomer.

2. A photoreceptor comprising:

an electroconductive substrate;

a photosensitive layer, which includes a charge generation layer including a charge generation material, a charge transport layer located on the charge generation layer and including a charge transport material having no radical polymerizability, a binder resin having no radical polymerizability, and a crosslinked polymer including a first radically polymerizable monomer unit having three or more functional groups and no charge transport structure and a second radically polymerizable monomer unit having a charge transport structure; and an outermost layer, which is located on the charge transport layer and which includes a crosslinked polymer including a third radically polymerizable monomer having three or more functional groups and no charge transport structure and a fourth radically polymerizable monomer having a charge transport structure, wherein each of the second and fourth radically polymerizable monomers is a radically polymerizable monofunctional monomer.

3. The photoreceptor according to claim 1, wherein each of the first and third radically polymerizable monomers has at least one member selected from the group consisting of acryloyloxy groups and methacryloyloxy groups.

4. The photoreceptor according to claim 1, wherein each of the second and fourth radically polymerizable monomers has at least one member selected from the group consisting of acryloyloxy groups and methacryloyloxy groups.

5. The photoreceptor according to claim 1, wherein the charge transport structure of each of the second and fourth radically polymerizable monomers is a triarylamine structure.

6. The photoreceptor according to claim 1, wherein each of the second and fourth radically polymerizable monomers has the following formula (1) or (2):

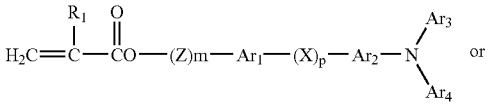

(1)

or

-continued

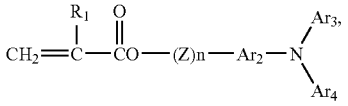

(2)

wherein $R_1$ represents a hydrogen atom, a halogen atom, a substituted or unsubstituted alkyl group, a substituted or unsubstituted aralkyl group, a substituted or unsubstituted aryl group, a cyano group, a nitro group, an alkoxy group, a —$COOR^7$ group (wherein $R^7$ represents a hydrogen atom, a substituted or unsubstituted alkyl group, a substituted or unsubstituted aralkyl group or a substituted or unsubstituted aryl group), a halogenated carbonyl group or a —$CONR^8R^9$ (wherein each of $R^8$ and $R^9$ represents a hydrogen atom, a substituted or unsubstituted alkyl group, a substituted or unsubstituted aralkyl group or a substituted or unsubstituted aryl group); each of $Ar_1$ and $Ar_2$ represents a substituted or unsubstituted arylene group; each of $Ar_3$ and $Ar_4$ represents a substituted or unsubstituted arylene group; X represents a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group, or a substituted or unsubstituted divalent alkyleneoxy carbonyl group; each of m and n is 0 or an integer of from 1 to 3; and p is 0 or 1.

7. The photoreceptor according to claim 6, wherein each of the second and fourth radically polymerizable monomers has the following formula (3):

formula (3)

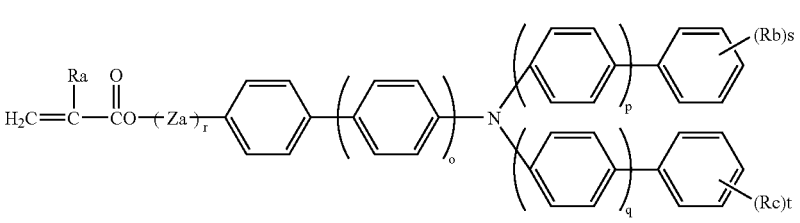

wherein each of o, p and q is 0 or 1; Ra represents a hydrogen atom, or a methyl group; each of Rb and Rc represents an alkyl group having from to 6 carbon atoms, wherein each of Rb and Rc can include plural groups which are the same as or different from each other; each of s and t is 0, 1, 2 or 3; r is 0 or 1; and Za represents a methylene group, an ethylene group or a group having one of the following formulae:

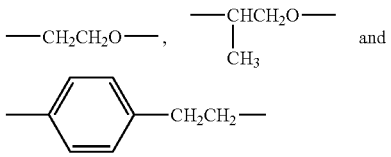

8. The photoreceptor according to claim 1, wherein the photosensitive layer further includes a titanyl phthalocyanine compound as the charge generation material.

9. The photoreceptor according to claim 8, wherein the titanyl phthalocyanine compound has an X-ray diffraction spectrum such that at least a peak is observed at each of Bragg 2θ angles of 9.6°±0.2°, 24.0°±0.2°, and 27.2°±0.2°.

10. A method for preparing a photoreceptor, comprising:

forming a charge generation layer including a charge generation material, on a surface of an electroconductive substrate;

applying a coating liquid, which includes a charge transport material having no radical polymerizability, a binder resin having no radical polymerizability, a first radically polymerizable monomer unit having three or more functional groups and no charge transport structure and a second radically polymerizable monomer unit having a charge transport structure, to form a charge transport layer on the charge generation layer;

applying an outermost layer coating liquid, which includes a third radically polymerizable monomer having three or more functional groups and no charge transport structure, a fourth radically polymerizable monomer having a charge transport structure and a solvent, to form an outermost layer on the charge transport layer; and irradiating the outermost layer with light to crosslink the outermost layer and the photosensitive layer, wherein the first radically polymerizable monomer and the second radically polymerizable monomer are reacted with the third radically polymerizable monomer and the fourth radically polymerizable monomer when irradiating the outermost layer with light.

11. The method according to claim 10, wherein the solvent in the outermost layer coating liquid includes tetrahydrofuran.

12. The method according to claim 10, wherein the photosensitive layer coating liquid applying step includes:

applying a charge generation layer coating liquid including a charge generation material on the surface of an electroconductive substrate with or without a layer therebetween to form a charge generation layer; and applying a charge transport layer coating liquid, which includes a charge transport material having no radical polymerizability, a binder resin having no radical polymerizability, a first radically polymerizable monomer having three or more functional groups and no charge transport structure and a second radically polymerizable monomer having a charge transport structure, on the charge generation layer to form a charge transport layer on the charge generation layer.

13. An image forming method comprising:

charging the photoreceptor according to claim 1;

irradiating the charged photoreceptor with imagewise light to form an electrostatic latent image on the photoreceptor;

developing the electrostatic latent image with a developer including a toner to form a toner image on the photoreceptor; and transferring the toner image onto a receiving material.

14. An image forming apparatus comprising:

the photoreceptor according to claim 1;

a charging device configured to charge the photoreceptor;

a light irradiating device configured to irradiate the charged photoreceptor with imagewise light to form an electrostatic latent image on the photoreceptor;

a developing device configured to develop the electrostatic latent image with a developer including a toner to form a toner image on the, photoreceptor; and a transferring device configured to transfer the toner image onto a receiving material.

15. A process cartridge comprising:

the photoreceptor according to claim 1; and at least one of a charging device configured to charge the photoreceptor, a developing device configured to develop the electrostatic latent image with a developer including a toner to form a toner image on the photoreceptor, a transferring device configured to transfer the toner image onto a receiving material, a cleaning device configured to clean a surface of the photoreceptor, and a discharging device configured to reduce charges remaining on a surface of the photoreceptor.

16. The photoreceptor according to claim 1, wherein the binder resin is a polycarbonate resin having a triarylamine structure in a side chain or main chain.

* * * * *